US007161555B2

(12) United States Patent
Ohno et al.

(10) Patent No.: US 7,161,555 B2
(45) Date of Patent: Jan. 9, 2007

(54) DIELECTRIC ANTENNA AND RADIO DEVICE USING THE SAME

(75) Inventors: Takeshi Ohno, Osaka (JP); Koichi Ogawa, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 132 days.

(21) Appl. No.: 10/937,621

(22) Filed: Sep. 10, 2004

(65) Prior Publication Data

US 2005/0057402 A1 Mar. 17, 2005

(30) Foreign Application Priority Data

Sep. 11, 2003 (JP) ..... 2003-320225
Oct. 1, 2003 (JP) ..... 2003-343847

(51) Int. Cl.
*H01Q 15/08* (2006.01)
*H01Q 13/00* (2006.01)

(52) U.S. Cl. ..... 343/911 R; 343/785

(58) Field of Classification Search ..... 343/700 MS, 343/785, 911 R
See application file for complete search history.

(56) References Cited

U.S. PATENT DOCUMENTS 5,523,768 A * 6/1996 Hemmie et al. ..... 343/840
5,831,581 A * 11/1998 Keough ..... 343/725
5,922,081 A * 7/1999 Seewig et al. ..... 343/785
6,661,389 B1 * 12/2003 Griessbaum et al. ..... 343/786
6,891,513 B1 * 5/2005 Kienzle et al. ..... 343/786
6,911,939 B1 * 6/2005 Carson et al. ..... 343/700 MS
2004/0119646 A1 * 6/2004 Ohno et al. ..... 343/700 MS

FOREIGN PATENT DOCUMENTS

JP 2000-209022 7/2000
JP 2000-278030 10/2000
JP 2002-185240 * 6/2002

* cited by examiner

*Primary Examiner*—Hoanganh Le
*Assistant Examiner*—Hung T. Vy
(74) *Attorney, Agent, or Firm*—Wenderoth, Lind & Ponack, L.L.P.

(57) ABSTRACT

A dielectric antenna of the present invention includes a pillar-shaped dielectric section for radiating an electromagnetic wave being fed thereto. The dielectric section includes a depressed portion in an upper portion thereof. The vertical cross section of the depressed portion has such a shape that the height of the dielectric section gradually increases toward the side surface of the dielectric section. For example, the depressed portion is a notch having a V-shaped vertical cross section. Alternatively, the depressed portion includes a flat surface portion.

31 Claims, 50 Drawing Sheets

DIELECTRIC ANTENNA AND RADIO DEVICE USING THE SAME

BACKGROUND OF THE INVENTION

1. Field of the Invention

The present invention relates to an antenna for use in the microwave and millimeter-wave range, and more particularly to a dielectric antenna for radiating an electromagnetic wave from a dielectric.

2. Description of the Background Art

Dielectric antennas loaded with a dielectric block placed over a feed circuit, which includes a microstrip line, a waveguide, etc., have been widely used in the art for radio communications in the microwave and millimeter-wave range (see Japanese Laid-Open Patent Publication Nos. 2000-209022 and 2000-278030). Such dielectric antennas are called "waveguide-fed dielectric antennas".

FIG. 62 is an exploded perspective view illustrating a conventional waveguide-fed dielectric antenna. Referring to FIG. 62, the conventional dielectric antenna includes a lower conductor plate 101, an upper conductor plate 102 and a loading dielectric block 103 having a cylindrical shape. The lower conductor plate 101 includes a feed port 104, a first waveguide groove 105 and a depressed portion 106. The upper conductor plate 102 includes a second waveguide groove 107 and an aperture 108.

The upper surface of the lower conductor plate 101 and the lower surface of the upper conductor plate 102 are attached to each other. As the plates are attached to each other, the first waveguide groove 105 and the second waveguide groove 107 together form a waveguide.

The loading dielectric block 103 is bonded to the upper conductor plate 102 over the aperture 108. Placing a dielectric block on a substrate is termed "loading with a dielectric block".

An electromagnetic wave inputted to the feed port 104 travels through the inside of the waveguide, leaks through the aperture 108, and is fed to the loading dielectric block 103 and radiated therefrom. In this process, there appear two types of electromagnetic waves. The first is an electromagnetic wave traveling through the inside of the loading dielectric block 103. The second is an electromagnetic wave traveling along the surface of the loading dielectric block 103 ("surface wave"). The loading dielectric block 103 has such a size that the two types of electromagnetic waves are in phase with each other at the upper surface of the loading dielectric block 103. As the two types of electromagnetic waves are brought in phase with each other at the upper surface of the loading dielectric block 103, it is possible to provide an antenna with a high gain.

For example, consider a conventional dielectric antenna having a structure as illustrated in FIG. 62. In the conventional dielectric antenna, the lower conductor plate 101 is made of aluminum, and has a size of 100 mm×100 mm and a thickness of 3 mm. The upper conductor plate 102 is made of aluminum, and has a size of 100 mm×100 mm and a thickness of 2.5 mm. The waveguide formed by the first waveguide groove 105 and the second waveguide groove 107 has a size of 3.76 mm×1.88 mm. The aperture 108 has a size of 2.8 mm×2.8 mm. The loading dielectric block 103 is made of polypropylene (relative dielectric constant: 2.26), the diameter $\phi$ thereof is 6 mm, and the height L thereof is 7 mm.

FIG. 63 is a graph showing the radiation pattern along the xz plane (electric field plane) for a dielectric antenna as described above. In FIG. 63, the vertical axis represents the gain of the antenna. The horizontal axis represents the angle in the xz plane with respect to the center of the loading dielectric. As shown in FIG. 63, the dielectric antenna exhibits a high gain in the range of about ±30 degrees.

An antenna using a post-wall waveguide is described in "Reflection-Canceling Slot Pair Array with Cosecant Radiation Pattern Using a Millimeter-Wave Post-Wall Waveguide" by Jiro Hirokawa, 2000 IEICE Communications Society Conference (2000), B-1-61, p. 61, and "Slot Antenna with a Sector Beam on a Millimeter-Wave Post-Wall Waveguide" by Jiro Hirokawa and one other, 2000 IEICE General Conference (2000), B-1-133, p. 133.

However, as shown in FIG. 63, the conventional dielectric antenna has a high gain only in the range of about ±30 degrees with respect to the center of the loading dielectric block 103. Therefore, the conventional dielectric antenna has a small beam width. Thus, the conventional dielectric antenna has a narrow coverage. In a frequency range where the space attenuation is substantial, such as a millimeter-wave range, for example, it is of course necessary to use an antenna with a high gain, and the antenna may also be required to have a wide coverage for some applications. Thus, it is in some cases necessary to use an antenna with a high gain and a large primary beam width.

Moreover, the conventional dielectric antenna as illustrated in FIG. 62 uses a metal waveguide including two metal plates attached together as the feed circuit, whereby the dielectric antenna is large and heavy. Thus, the conventional dielectric antenna requires high machining cost. The antenna as a whole can be downsized by filling the inside of the waveguide with a dielectric. However, it requires a difficult operation to evenly fill the inside of the waveguide with a dielectric. Therefore, the dielectric filling has not been a practical option.

SUMMARY OF THE INVENTION

Therefore, a first object of the present invention is to provide a dielectric antenna with a high gain and a large primary beam width.

A second object of the present invention is to provide a small and inexpensive dielectric antenna that can easily be manufactured.

The present invention has the following features to attain the objects mentioned above. A first aspect of the present invention is directed to a dielectric antenna, including a pillar-shaped dielectric section for radiating an electromagnetic wave being fed thereto, wherein: the dielectric section includes a depressed portion in an upper portion thereof; and a vertical cross section of the depressed portion has such a shape that a height of the dielectric section gradually increases toward a side surface of the dielectric section.

Preferably, the depressed portion is a notch having a V-shaped vertical cross section. Preferably, the depressed portion includes a flat surface portion. Preferably, the dielectric section has an elliptic cylinder shape.

Preferably, the dielectric section is a pillar-shaped loading dielectric block; and the dielectric antenna further includes a feed section for feeding the electromagnetic wave to a bottom surface of the loading dielectric block.

In a preferred embodiment, the feed section includes: a waveguide; and an aperture for feeding the electromagnetic wave to the loading dielectric block; and the loading dielectric block is placed over the aperture.

For example, an inside of the waveguide is preferably filled with a dielectric.

For example, the aperture preferably has a hexagonal shape. For example, the aperture preferably includes two rectangular apertures which are not parallel to each other.

In a preferred embodiment, the feed section includes: a high frequency line formed on a dielectric substrate; and a feed patch formed at an end of the high frequency line; and the loading dielectric block is placed over the feed patch.

For example, the feed patch preferably has a hexagonal shape.

In a preferred embodiment, the dielectric antenna further includes: a dielectric block integrally including the dielectric section in the form of a protrusion therefrom; and a conductor portion covering a surface of the dielectric block except for a feed port for feeding the electromagnetic wave and the protrusion.

Preferably, the dielectric block includes a matching protrusion for impedance matching.

In a preferred embodiment, the dielectric antenna further includes: a dielectric block integrally including the dielectric section in the form of a protrusion therefrom; a plurality of through holes each passing through the dielectric block from a first surface of the dielectric block on which the protrusion is formed to a second surface opposing the first surface, wherein the through holes are arranged so as to surround the protrusion; and a conductor portion covering a surface of the dielectric block except for a feed port for feeding the electromagnetic wave and the protrusion, the conductor portion covering at least the first surface, the second surface and an inner wall surface of each of the through holes.

Preferably, the dielectric block includes a matching protrusion for impedance matching.

In a preferred embodiment, the dielectric section is a pillar-shaped loading dielectric block; the dielectric antenna further includes a dielectric substrate including a feed port for feeding the electromagnetic wave to a bottom surface of the loading dielectric block and a slot aperture for radiating the electromagnetic wave over which the loading dielectric block is placed, wherein both surfaces of the dielectric substrate are covered with a conductor except for the feed port and the slot aperture; and a plurality of through holes, each having an inner wall covered with a conductor, pass through the dielectric substrate, wherein the through holes are arranged so as to surround the feed port and the slot aperture.

Preferably, the slot aperture includes two rectangular apertures which are not parallel to each other. Preferably, the slot aperture has a hexagonal shape.

Preferably, the plurality of through holes are periodically arranged with an interval which is less than or equal to ⅕ a wavelength of an electromagnetic wave to be transmitted.

Preferably, the feed port is H-shaped. Preferably, the slot aperture is H-shaped.

In a preferred embodiment, the dielectric section is at least one of a plurality of pillar-shaped loading dielectric blocks which are arranged in an array; the dielectric antenna further includes a feed section for feeding the electromagnetic wave to a bottom surface of each of the loading dielectric blocks; and each of the loading dielectric blocks other than the dielectric section includes a sloped upper portion facing a direction in which the electromagnetic wave is intended to be radiated.

Preferably, the plurality of loading dielectric blocks other than a central loading dielectric block are arranged in various directions according to an intended directivity.

Preferably, the dielectric antenna further includes a switch circuit for feeding the electromagnetic wave to at least one of the loading dielectric blocks.

A second aspect of the present invention is directed to a radio device for high frequency communications applications, including: a dielectric antenna for radiating an electromagnetic wave being fed thereto; and a communications circuit connected to the dielectric antenna, wherein: the dielectric antenna includes a pillar-shaped dielectric section for radiating the electromagnetic wave; the dielectric section includes a depressed portion in an upper portion thereof; and a vertical cross section of the depressed portion has such a shape that a height of the dielectric section gradually increases toward a side surface of the dielectric section.

In a preferred embodiment, the communications circuit is provided in a feed section for feeding the electromagnetic wave. Alternatively, the communications circuit may be provided on a bottom surface of a feed section for feeding the electromagnetic wave. Alternatively, the communications circuit may be provided on a patch feed substrate for patch feeding of the electromagnetic wave.

Preferably, the electromagnetic wave from the communications circuit is fed via a waveguide; the communications circuit includes a high frequency line for feeding the electromagnetic wave to the waveguide; and the radio device further includes a converter for impedance matching between the waveguide and the high frequency line.

The effects of the present invention will now be described. The dielectric antenna of the present invention includes a dielectric section having a depressed portion in an upper portion thereof, whereby it is possible to provide a phase distribution. Therefore, it is possible to provide a dielectric antenna with a high gain and a large primary beam width.

Where the vertical cross section of the depressed portion is a V-shaped notch, the dielectric antenna is easy to design and manufacture. If the depressed portion includes a flat surface portion, it is possible to obtain a sector directivity. Moreover, where a bowl-shaped depressed portion is used, an omni directional slope is formed toward the periphery with a flat bottom portion at the center, whereby the primary beam width is increased for all of the radiating surfaces. Moreover, where a bowl-shaped depressed portion is used, ripples can be suppressed by employing a dielectric section having an elliptic cylinder shape.

Moreover, if the feed section uses a waveguide for feeding an electromagnetic wave to the dielectric section, feeding with little loss can be done even in a high frequency range such as a millimeter-wave range. By filling the inside of the waveguide with a dielectric, it is possible to reduce the thickness and size of the dielectric antenna.

If the aperture has a hexagonal shape, it is possible to provide a dielectric antenna that can be operated with circularly- or elliptically-polarized waves. Moreover, if the aperture includes two rectangular apertures that are not parallel to each other, it is possible to provide a dielectric antenna that can be operated with elliptically-polarized waves. Where a dielectric antenna is operated with circularly- or elliptically-polarized waves, as opposed to a case where it is operated with vertically-polarized waves, it is not necessary to align the antenna polarization direction for transmission with that for reception, which is advantageous in mobile communications applications, etc.

Moreover, if the feed section uses a high frequency line for feeding an electromagnetic wave to the dielectric section, it is possible to reduce the thickness and size of the dielectric antenna. In such a case, if the feed patch has a hexagonal shape, the dielectric antenna can be operated with elliptically- or circularly-polarized waves.

If the dielectric antenna uses a dielectric block integrally including the dielectric section, it is possible to reduce the thickness and size of the dielectric antenna. Moreover, as compared with a case where a metal waveguide is used as the feed circuit, the dielectric antenna can be lighter in weight and less expensive. Moreover, since the feed section dielectric and the protrusion to bet he radiating section are formed as an integral dielectric block, the number of components is reduced. Moreover, impedance matching can be achieved by providing a matching protrusion.

Moreover, in the present invention, the upper and lower surfaces of the dielectric block including a protrusion are covered with a conductor with through holes passing between the two surfaces, whereby it is possible to form a waveguide without plating the side surfaces of the dielectric block with a conductor, or the like, thus increasing the freedom in the size of the dielectric antenna itself. Moreover, with such a structure, an array structure can be employed.

Moreover, in the present invention, a dielectric block is placed on a dielectric substrate plated on both sides and including a plurality of through holes arranged in an array, whereby it is possible to provide a small and inexpensive dielectric antenna. If the slot aperture has a hexagonal shape, the dielectric antenna can be operated with circularly- or elliptically-polarized waves. Moreover, if the slot aperture includes two rectangular apertures that are not parallel to each other, the dielectric antenna can be operated with elliptically-polarized waves. In such a case, if the through holes are periodically arranged, the impedance and wavelength inside the dielectric waveguide can be made constant. Therefore, the dielectric antenna can be operated stably. Moreover, if the feed port is H-shaped, the size of the feed port can be increased effectively, whereby the coupling with the dielectric waveguide can be enhanced. Moreover, if the slot aperture is H-shaped, the coupling between the loading dielectric and the waveguide can be enhanced.

If a plurality of protrusions are provided on a dielectric block or a plurality of loading dielectrics are provided thereon, an array antenna is formed, whereby it is possible to further increase the gain. Moreover, any directivity can be realized by controlling the amplitude and phase of each element.

Moreover, if the through holes are arranged so as to provide a branching structure, it is possible to reduce the feeding loss to each element of the array antenna. Moreover, it is possible to realize any pattern of power distribution among the elements.

By using a dielectric antenna array, it is possible to realize radiation directivities in various directions. Moreover, if a switch is used to select a dielectric section for radiating an electromagnetic wave, it is possible to increase the coverage.

By forming a radio device integrated with a dielectric antenna of the present invention, it is possible to reduce the size of a radio device. Moreover, impedance mismatch occurring at the junction between the antenna feed circuit and the communications circuit can be eliminated by using a converter. Moreover, a small radio device can also be provided by using a patch feed dielectric antenna.

As described above, the dielectric antenna of the present invention has a small size and a high gain. The dielectric antenna of the present invention can be manufactured more easily and is less expensive than a conventional dielectric antenna. Moreover, by forming a radio device using such an antenna, it is possible to provide a radio device with a small size and a high sensitivity.

These and other objects, features, aspects and advantages of the present invention will become more apparent from the following detailed description of the present invention when taken in conjunction with the accompanying drawings.

DESCRIPTION OF THE PREFERRED EMBODIMENTS

Preferred embodiments of the present invention will now be described with reference to FIG. 1 to FIG. 61. Note that the following embodiments are merely illustrative, and the present invention is not limited thereto.

First Embodiment

Figure 1:
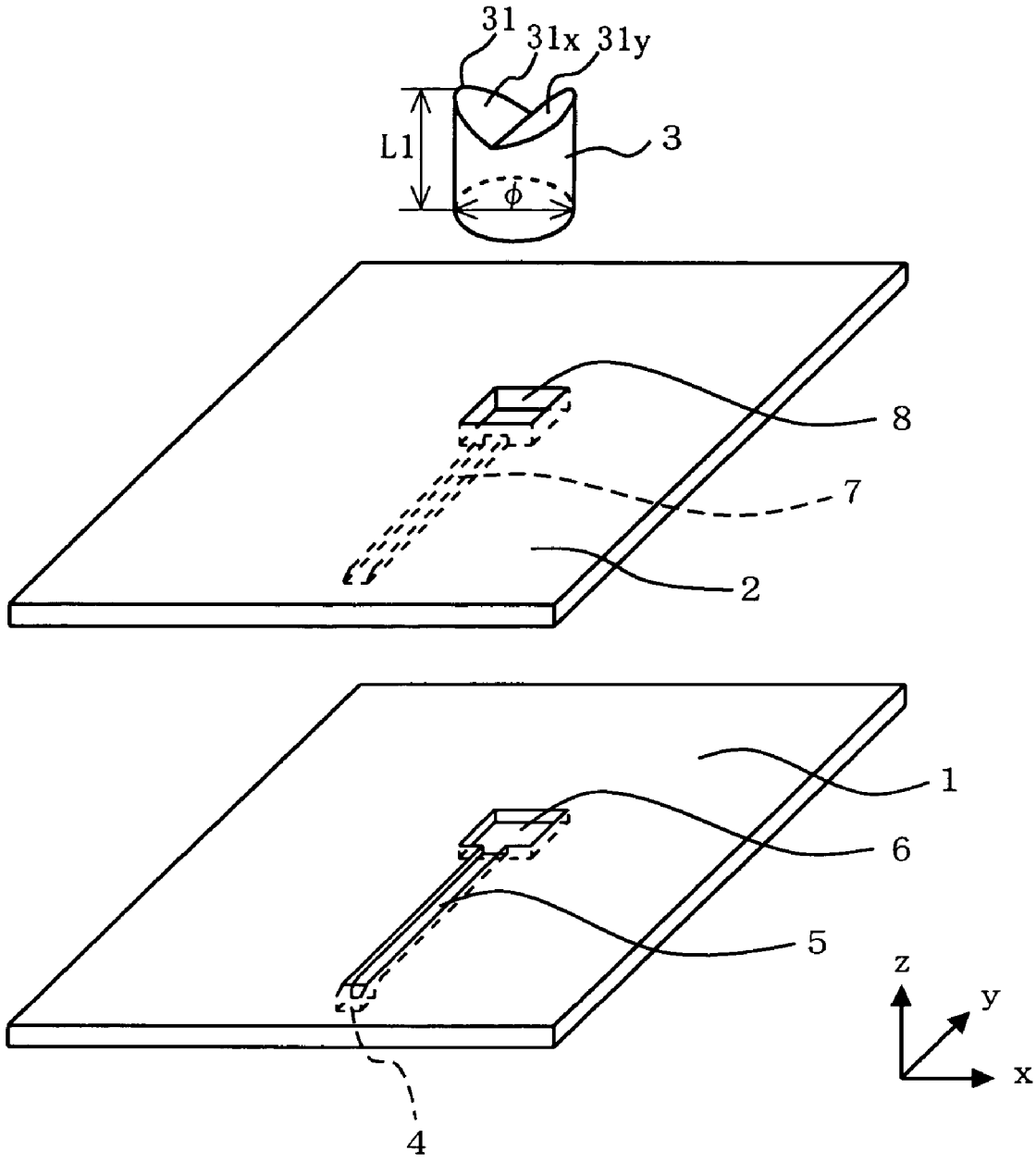
FIG. 1 is an exploded perspective view illustrating a dielectric antenna according to a first embodiment of the present invention.
Figure 2:
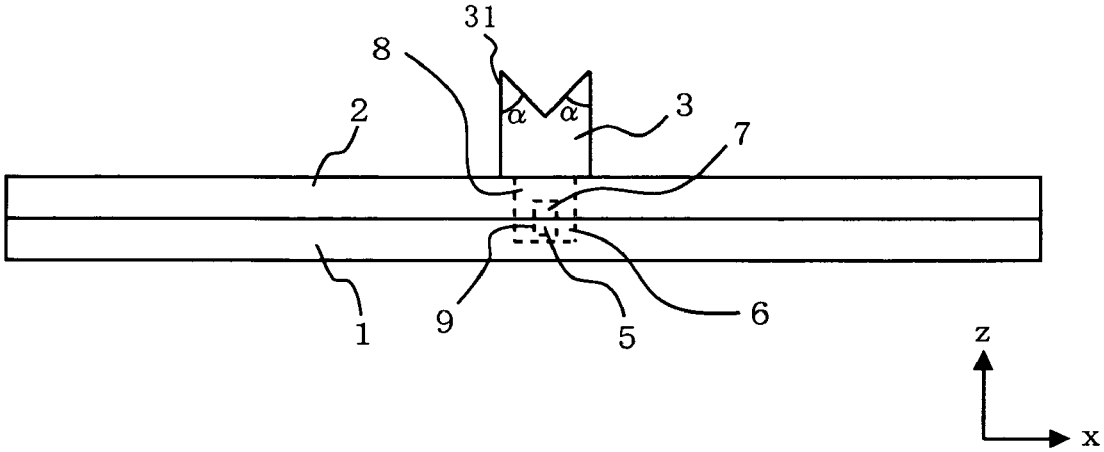
FIG. 2 is a front view of the dielectric antenna illustrated in FIG. 1.

FIG. 1 is an exploded perspective view illustrating a dielectric antenna according to the first embodiment of the present invention. FIG. 2 is a front view of the dielectric antenna illustrated in FIG. 1. In these and subsequent figures, it is assumed that the xz plane represents the electric field plane, and the yz plane represents the magnetic field plane. Referring to FIG. 1 and FIG. 2, the dielectric antenna includes a lower conductor plate 1, an upper conductor plate 2 and a loading dielectric block 3.

The loading dielectric block 3 is made of a dielectric material such as polypropylene. A notch 31 is formed in an upper portion of the loading dielectric block 3. The notch 31 is formed by cutting off an upper portion of a cylindrical dielectric with an edged tool, or the like. The notch 31 is formed by cutting the cylindrical dielectric from two opposite points along the circumference of the upper surface of the cylindrical dielectric in an inclined downward direction at an angle of a. Note that the notch 31 may alternatively be formed by pouring a dielectric into a mold, or may be formed by any other suitable method as long as a notch is formed such that the central portion of the upper surface of the cylindrical dielectric is lower than the other portions. The cross section (vertical cross section) of the notch 31, taken along a plane perpendicular to the upper conductor plate 2, is V-shaped.

The lower conductor plate 1 is a plate-shaped member made of a conductor such as aluminum. The lower conductor plate 1 includes a feed port 4, a first waveguide groove 5 and a depressed portion 6. The first waveguide groove 5 is formed on the upper surface of the lower conductor plate 1 so as to extend parallel to the side surfaces of the lower conductor plate 1. The depressed portion 6 is a square-shaped recess formed on the upper surface of the lower conductor plate 1 so that the center of the depressed portion 6 is aligned with the center of the lower conductor plate 1. One end of the first waveguide groove 5 is connected to the depressed portion 6. The depressed portion 6 is deeper and wider than the first wave guide groove 5. The connecting portion between the depressed portion 6 and the first waveguide groove 5 has a step. The feed port 4 is a hole connecting the other end of the first waveguide groove 5 to the bottom surface of the lower conductor plate 1. The lower conductor plate 1 may be formed by pouring a conductor into a mold such that the feed port 4, the first waveguide groove 5 and the depressed portion 6 are formed, or by shaving a single conductor plate.

The upper conductor plate 2 is a plate-shaped member made of a conductor such as aluminum. The lower surface of the upper conductor plate 2 has the same size as the upper surface of the lower conductor plate 1. The upper conductor plate 2 includes a second waveguide groove 7 and an aperture 8. The second waveguide groove 7 is formed on the bottom surface of the upper conductor plate 2 so as to extend parallel to the side surfaces of the upper conductor plate 2. The aperture 8 is a square-shaped hole passing from the upper surface of the upper conductor plate 2 to the bottom surface thereof so that the center of the aperture 8 is aligned with the center of the upper conductor plate 2. The size of the upper opening of the aperture 8 is such that the upper opening is covered by the loading dielectric block 3 being placed over the aperture 8. The aperture 8 and the second wave guide groove 7 are connected to each other. The upper conductor plate 2 may be formed by pouring a conductor into a mold such that the second waveguide groove 7 and the aperture 8 are formed, or by shaving a single conductor plate.

The first waveguide groove 5 has the same length and width as the second waveguide groove 7. The square shape of the opening of the depressed portion 6 has the same size as the square shape of the opening of the aperture 8. The depressed portion 6, the aperture 8, the first waveguide groove 5 and the second waveguide groove 7 are appropriately positioned on the lower conductor plate 1 and the upper conductor plate 2 so that when the lower conductor plate 1 and the upper conductor plate 2 are attached together while aligning their side surfaces with each other, the opening of the depressed portion 6 is aligned with the lower opening of the aperture 8, and the first waveguide groove 5 and the second waveguide groove 7 are aligned with each other to form a hollow waveguide 9.

The lower conductor plate 1 and the upper conductor plate 2 can be attached together by an adhesive, screws, welding, etc. The loading dielectric block 3 is attached to the upper conductor plate 2 by an adhesive, or the like, so as to cover the aperture 8. Thus, there is provided a dielectric antenna having the waveguide 9.

In the dielectric antenna as described above, an electromagnetic wave inputted to the feed port 4 from an external communications circuit (not shown) is guided through the waveguide 9 and fed to the loading dielectric block 3 through the aperture 8. The electromagnetic wave fed to the loading dielectric block 3 is radiated from the loading dielectric block 3.

Moreover, an electromagnetic wave propagating through the air passes through the loading dielectric block 3 and the waveguide 9 to be inputted to the external communications circuit (not shown) through the feed port 4.

Thus, the dielectric antenna of the first embodiment uses the cylindrical loading dielectric block 3 with the notch 31 such that the center of the upper surface thereof is at the lowest level. In other words, the loading dielectric block 3 has such a shape that its height is smallest at the center of the upper surface thereof and the height gradually increases toward the side surface thereof. The speed of an electromagnetic wave is generally lower when traveling through a dielectric than when traveling through a free space. Therefore, with a loading dielectric block as described above, it is possible to obtain a phase distribution where the phase of the electromagnetic wave is gradually delayed from the center of the upper surface of the loading dielectric block toward the periphery thereof. A substantial phase distribution results in a large primary beam width (see FIG. 28 to be described later).

Note that while the loading dielectric block 3 includes the notch 31 that is shaped so that the height of the block is smallest at the center of the upper surface thereof and gradually increases toward the periphery thereof in the embodiment above, the position where the height of the block is smallest is not limited to the center of the upper surface of the block. Similar effects can be obtained as long as an upper portion of the loading dielectric block includes a notch having a vertical cross section which has such a shape that the height of the block gradually increases toward the side surface thereof.

Figure 3A:
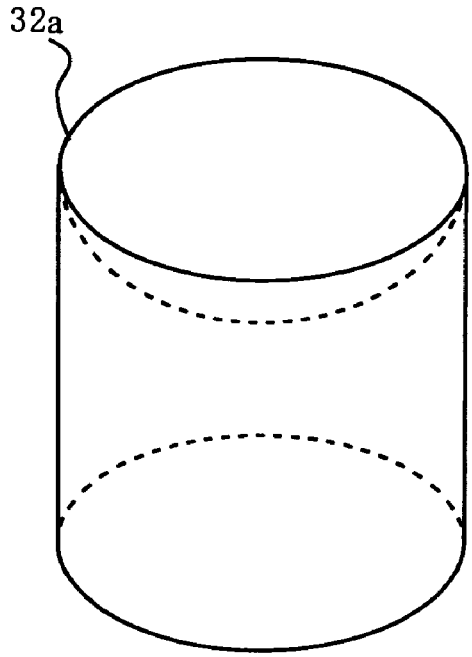
FIG. 3A is a perspective view illustrating a loading dielectric block whose upper depressed portion is in a concave shape.
Figure 3B:
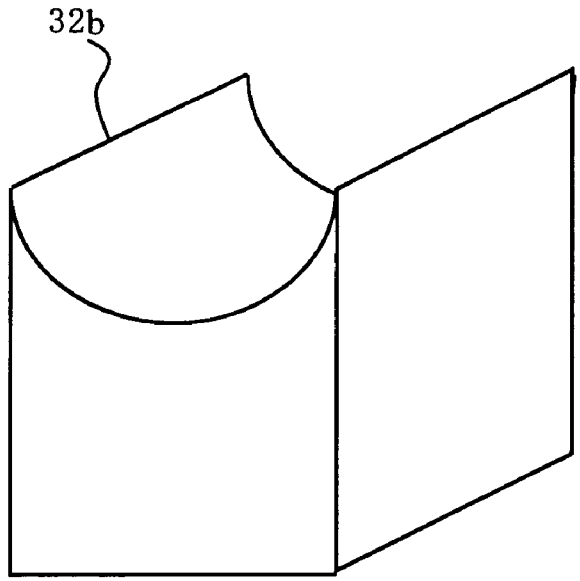
FIG. 3B is a perspective view illustrating a loading dielectric block whose upper depressed portion has a semi-cylindrical shape.

Note that the loading dielectric block may have an upper depressed portion 32*a* of a concave shape as illustrated in FIG. 3A. Alternatively, the loading dielectric block may have an upper depressed portion 32*b* of a semi-cylindrical shape as illustrated in FIG. 3B. Thus, similar effects can be obtained as long as an upper portion of the loading dielectric block is a depressed portion having a vertical cross section which has such a shape that the height of the block gradually increases toward the side surface thereof.

Figure 4:
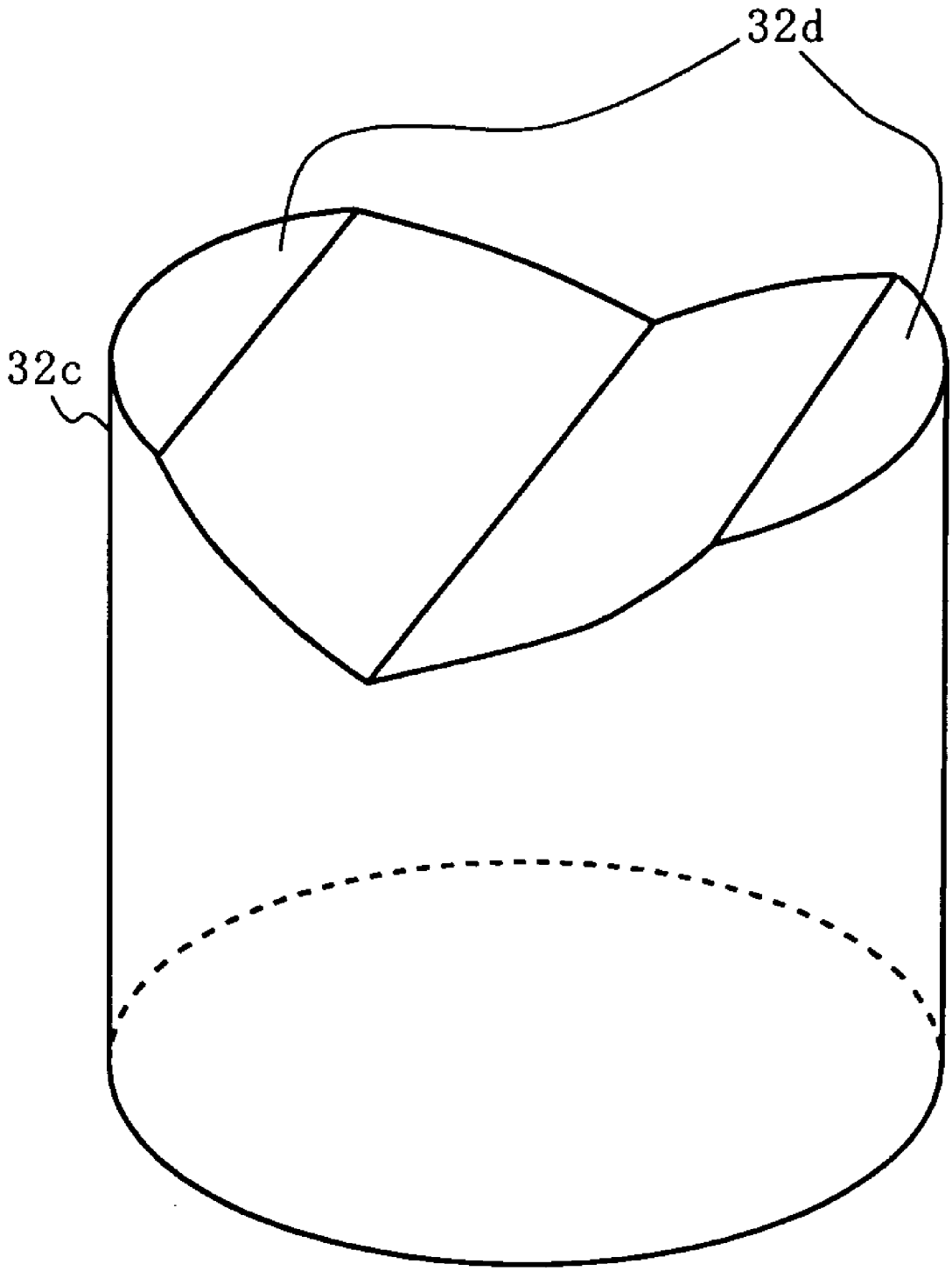
FIG. 4 is a perspective view illustrating a loading dielectric block whose upper depressed portion is formed by cutting off an upper surface portion.

Note that in the embodiment above, the notch or depressed portion in an upper portion of the loading dielectric block is formed by cutting the loading dielectric block from each side surface thereof in an inclined downward direction at an acute angle. Alternatively, a depressed portion 32*c* may be formed by cutting the loading dielectric block from an upper surface 32*d* thereof, rather than from each side surface thereof, as illustrated in FIG. 4.

Note that the primary beam width can be controlled by adjusting the inclination angle a. For example, the primary beam width is generally increased by decreasing the inclination angle α, i.e., by increasing the depth of the depression at the center of the upper surface. Of course, the inclination angle α needs to be set to an appropriate value in order to obtain a desired primary beam width.

Figure 5:
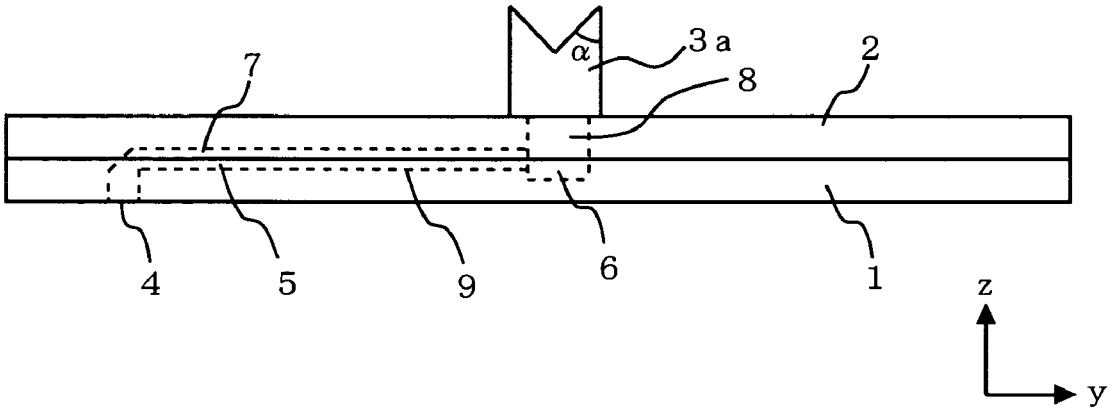
FIG. 5 is a side view illustrating a dielectric antenna similar to that of FIG. 1 except that the loading dielectric block is rotated by 90 degrees.

Note that while slopes 31*x* and 31*y* of the notch 31 are formed in the direction of the magnetic field plane in the embodiment above, the direction of the slopes is not dependent on the antenna polarization. FIG. 5 is a side view illustrating a dielectric antenna similar to that of FIG. 1 except that the loading dielectric block is rotated by 90 degrees. By placing a loading dielectric block 3*a* as illustrated in FIG. 5, the slopes can be formed in the direction of the electric field plane, thereby increasing the primary beam width in the yz plane.

Note that while the embodiment above uses a loading dielectric block having a shape obtained by cutting off an upper portion of a cylindrical block, the present invention is not limited thereto. For example, the loading dielectric block may have a shape obtained by cutting off an upper portion of a quadratic prism block, the cut-off portion being in a triangular prism shape. Where a cylindrical block is used, the gain is dominantly influenced by the surface area of the upper surface thereof, and the directivity is dominantly influenced by the diameter thereof. Where a quadratic prism block is used, the gain is dominantly influenced by the surface area of the upper surface thereof, and the directivity is dominantly influenced by the length of the major axis, the length of the minor axis, and the ratio therebetween.

Figure 6:
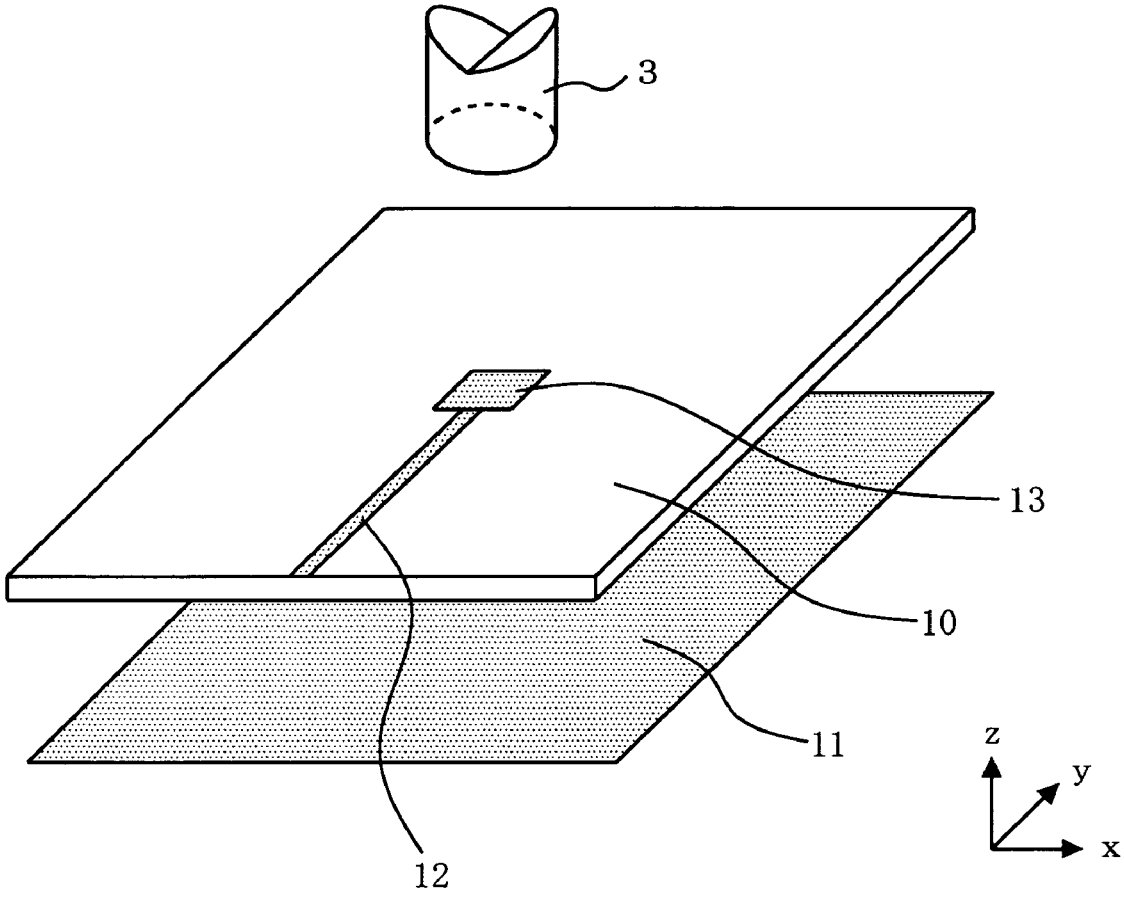
FIG. 6 is an exploded perspective view illustrating a dielectric antenna in which a microstrip line is used as the feed path.

Note that while a hollow waveguide is formed by two grooves on the upper and lower conductor plates in the embodiment above, the path along which an electromagnetic wave is fed is not limited to a waveguide. FIG. 6 is an exploded perspective view illustrating a dielectric antenna in which a microstrip line is used as the feed path. In FIG. 6, elements that are functionally the same as those of the dielectric antenna illustrated in FIG. 1 will be denoted by the same reference numerals and will not be further described below. Referring to FIG. 6, the dielectric antenna includes the loading dielectric block 3, a dielectric substrate 10, a ground conductor 11, a microstrip line 12 formed on the dielectric substrate 10, and a driven patch 13 formed on the dielectric substrate 10. The loading dielectric block 3 is placed over the driven patch 13. An electromagnetic wave inputted to the microstrip line 12 travels along the microstrip line 12, is fed to the loading dielectric block 3 via the driven patch 13, and is radiated from the loading dielectric block 3. Where an electromagnetic wave is fed by using a microstrip line, as compared to a case where a waveguide is used, although some transmission loss occurs, a thin feed section is obtained, thereby reducing the size of the antenna as a whole.

Figure 7:
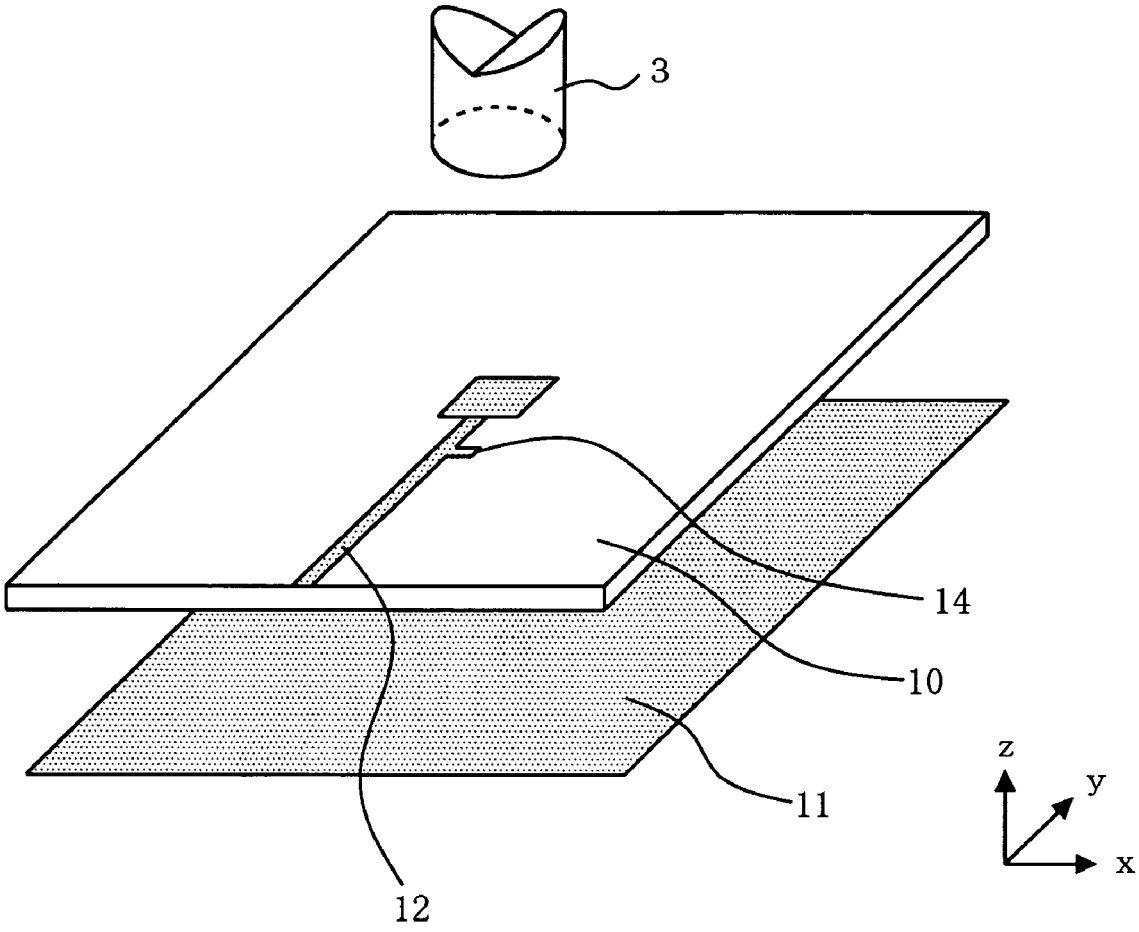
FIG. 7 is an exploded perspective view illustrating a dielectric antenna provided with a stub for impedance matching.

Note that where an electromagnetic wave is fed by using a microstrip line, impedance matching may be achieved by providing a stub 14 as illustrated in FIG. 7 and adjusting the length thereof.

Figure 8:
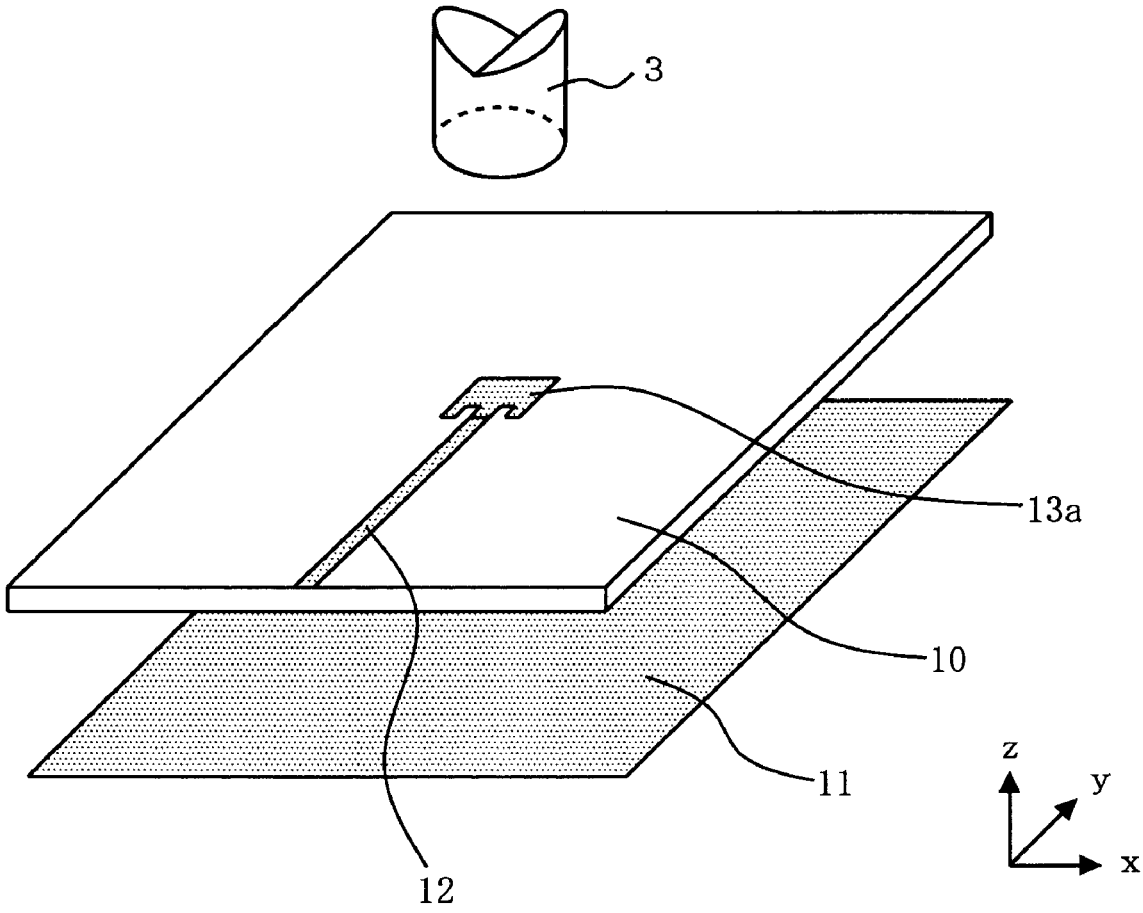
FIG. 8 is an exploded perspective view illustrating a dielectric antenna in which the driven patch has recessed portions for impedance matching.

Alternatively, impedance matching may be achieved by providing recessed portions in a driven patch 13*a* as illustrated in FIG. 8.

Note that while a hollow waveguide is used in the embodiment above, the inside of the waveguide may be filled with a dielectric. Then, the size of the waveguide may be reduced.

Note that while the shape of the aperture is a square shape in the embodiment above, the shape of the aperture is not limited thereto, and may alternatively be an oblong rectangular shape, any other polygonal shape, a circular shape or an elliptical shape.

Second Embodiment

Figure 9:
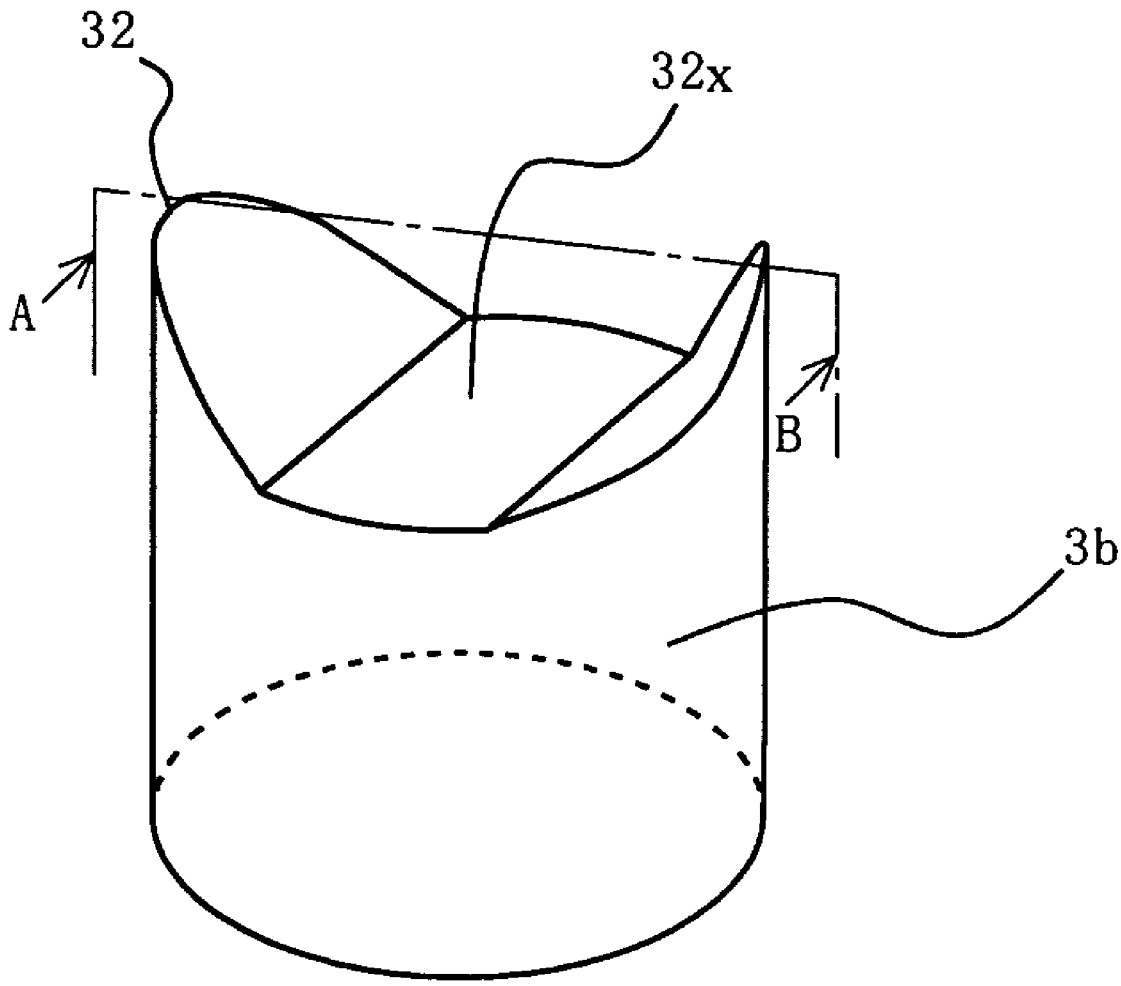
FIG. 9 is a perspective view illustrating a loading dielectric block used in a dielectric antenna according to a second embodiment of the present invention.
Figure 10:
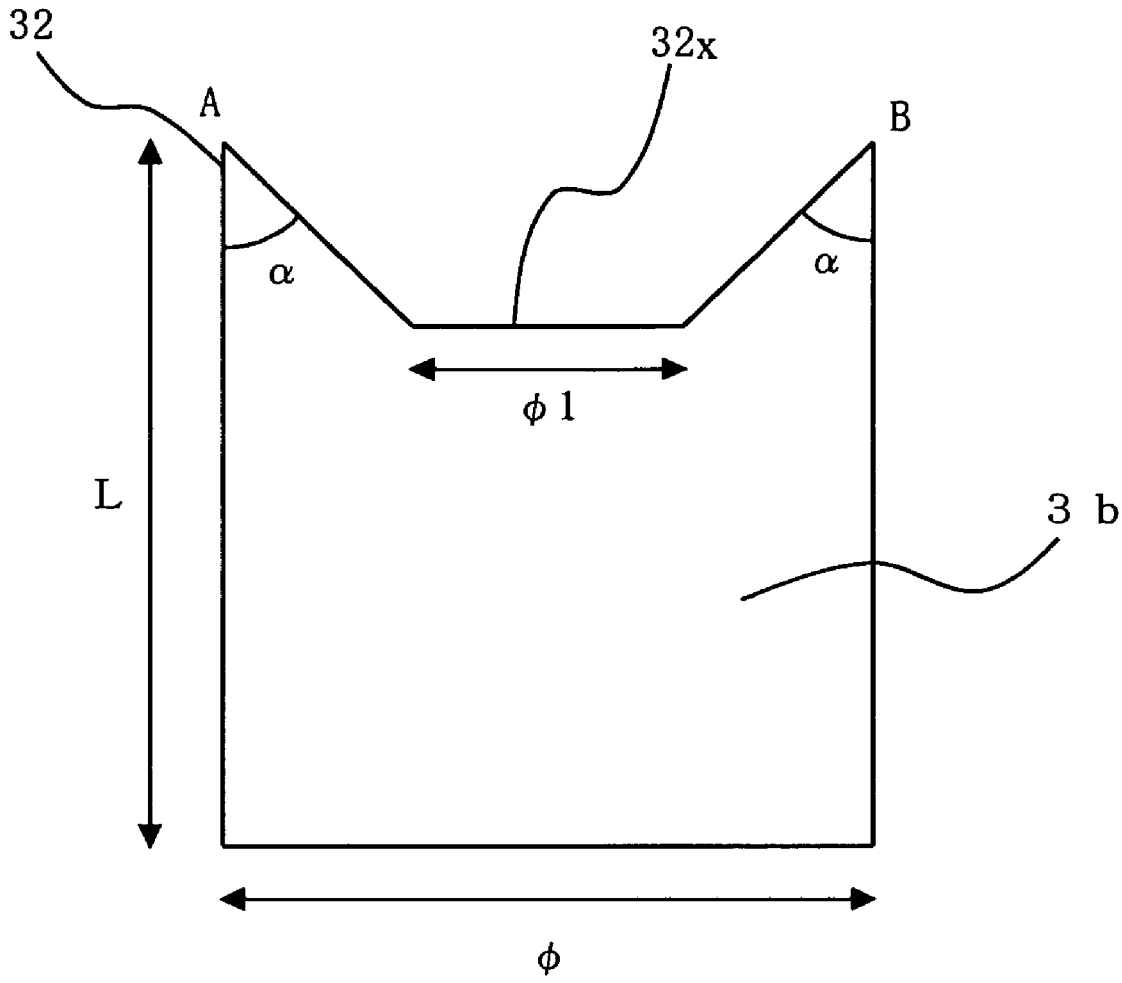
FIG. 10 is a vertical cross-sectional view of the loading dielectric block of FIG. 9 taken along line A-B.

The second embodiment of the present invention differs from the first embodiment only in the shape of the loading dielectric block. Otherwise, the dielectric antenna of the second embodiment is as illustrated in FIG. 1. Therefore, only the shape of the loading dielectric will be discussed below. FIG. 9 is a perspective view illustrating a loading dielectric block used in the dielectric antenna according to the second embodiment of the present invention. FIG. 10 is a vertical cross-sectional view of the loading dielectric block of FIG. 9 taken along line A-B.

Referring to FIG. 9 and FIG. 10, a depressed portion 32 is formed in an upper portion of a loading dielectric block 3*b*. The depressed portion 32 is formed by cutting off an upper portion of a cylindrical dielectric with an edged tool, or the like. The depressed portion 32 is formed by cutting the cylindrical dielectric from two opposite points along the circumference of the upper surface of the cylindrical dielectric in an inclined downward direction at an angle of α. Unlike in the first embodiment, the cylindrical dielectric is cut at an angle of α only to a point where the opposing slopes, being formed by the cutting, do not yet meet each other. The cylindrical dielectric is cut at an angle of α to a certain point and is then cut horizontally so as to leave a flat bottom surface portion in the depressed portion 32. Thus, the depressed portion 32 includes, at the bottom thereof, a flat surface portion 32*x* parallel to the bottom surface of the loading dielectric block 3*b*. The cross section of the depressed portion 32, taken along a plane perpendicular to the upper conductor plate 2, is a partially-cut-out rectangular shape with the cut-out portion being in a trapezoidal shape whose upper side is longer than the lower side, as illustrated in FIG. 10. Note that the depressed portion 32 may be formed by pouring a dielectric into a mold, or by any other suitable method as long as a depressed portion with a flat (horizontal) surface portion is formed in an upper portion of a cylindrical dielectric.

Thus, in the second embodiment, the loading dielectric block 3*b* includes the depressed portion 32 having a flat surface portion, whereby the distribution of the primary beam directivity can be made less pointed than in the first embodiment, and it is possible to provide an antenna with a sector directivity (see FIG. 29 to be described later).

Note that referring to FIG. 10, the primary beam width and the directivity pattern can be controlled by adjusting the inclination angle α and the width ϕ1 of the flat portion of the upper surface.

Note that while the inclination angle α for the left side is the same as that for the right side in the embodiment above, the depressed portion may have an asymmetric shape with different inclination angles for the left side and the right side. In other words, effects of the present embodiment can be obtained as long as the vertical cross section of the depressed portion in an upper portion of the loading dielectric block has such a shape that the height of the block gradually increases toward the side surface thereof and includes a flat surface portion.

Figure 11:
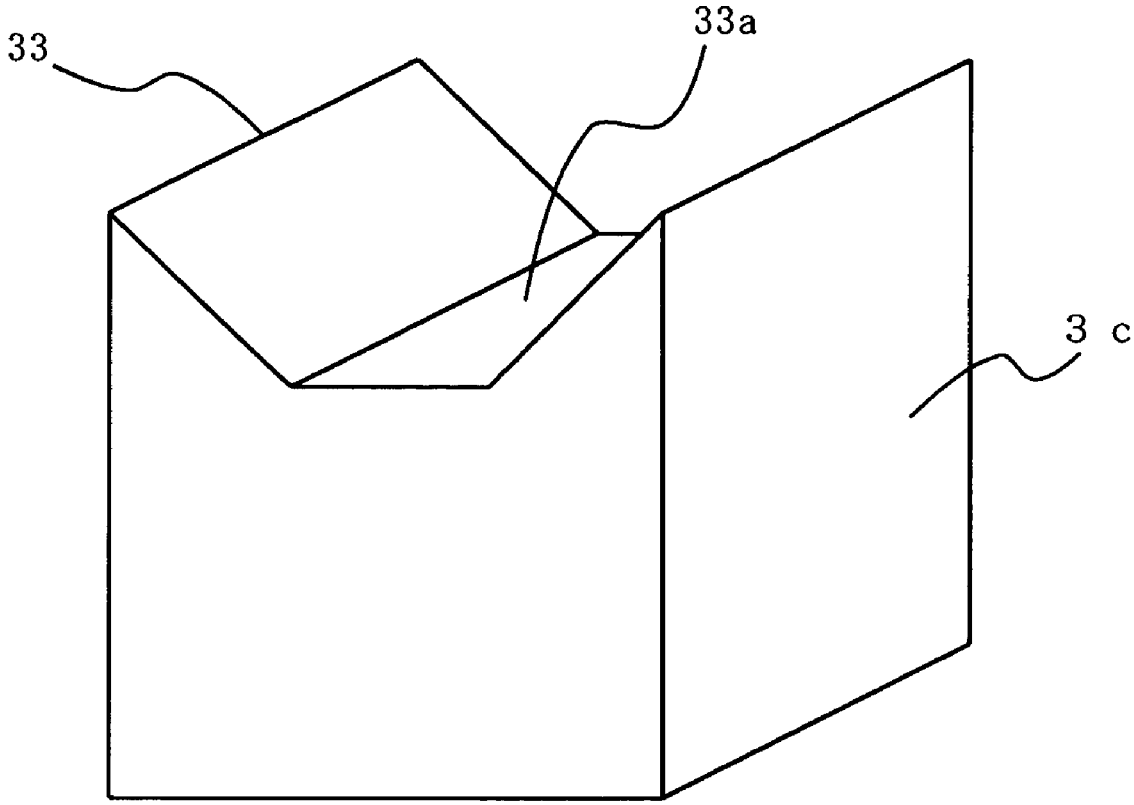
FIG. 11 is a perspective view illustrating a loading dielectric block 3*c* formed by cutting off an upper portion of a dielectric block having a quadratic prism shape.

Note that while the embodiment above uses a loading dielectric block formed by cutting off an upper portion of a cylindrical block, the dielectric block whose upper portion is cut off is not limited to a cylindrical block. For example, an upper portion of a dielectric block having a polygonal prism shape (e.g., a quadratic prism shape), an elliptic cylinder shape, etc., may be cut off so as to form a depressed portion with a flat (horizontal) bottom portion. FIG. 11 is a perspective view illustrating a loading dielectric block 3*c* formed by cutting off an upper portion of a dielectric block having a quadratic prism shape. Referring to FIG. 11, a depressed portion 33 is formed by cutting off an upper portion of the loading dielectric block 3*c* with the cut-off portion being in a trapezoidal prism shape. Thus, the depressed portion 33 includes a flat (horizontal) surface portion 33*a*, whereby the primary beam width can be increased.

Third Embodiment

Figure 12:
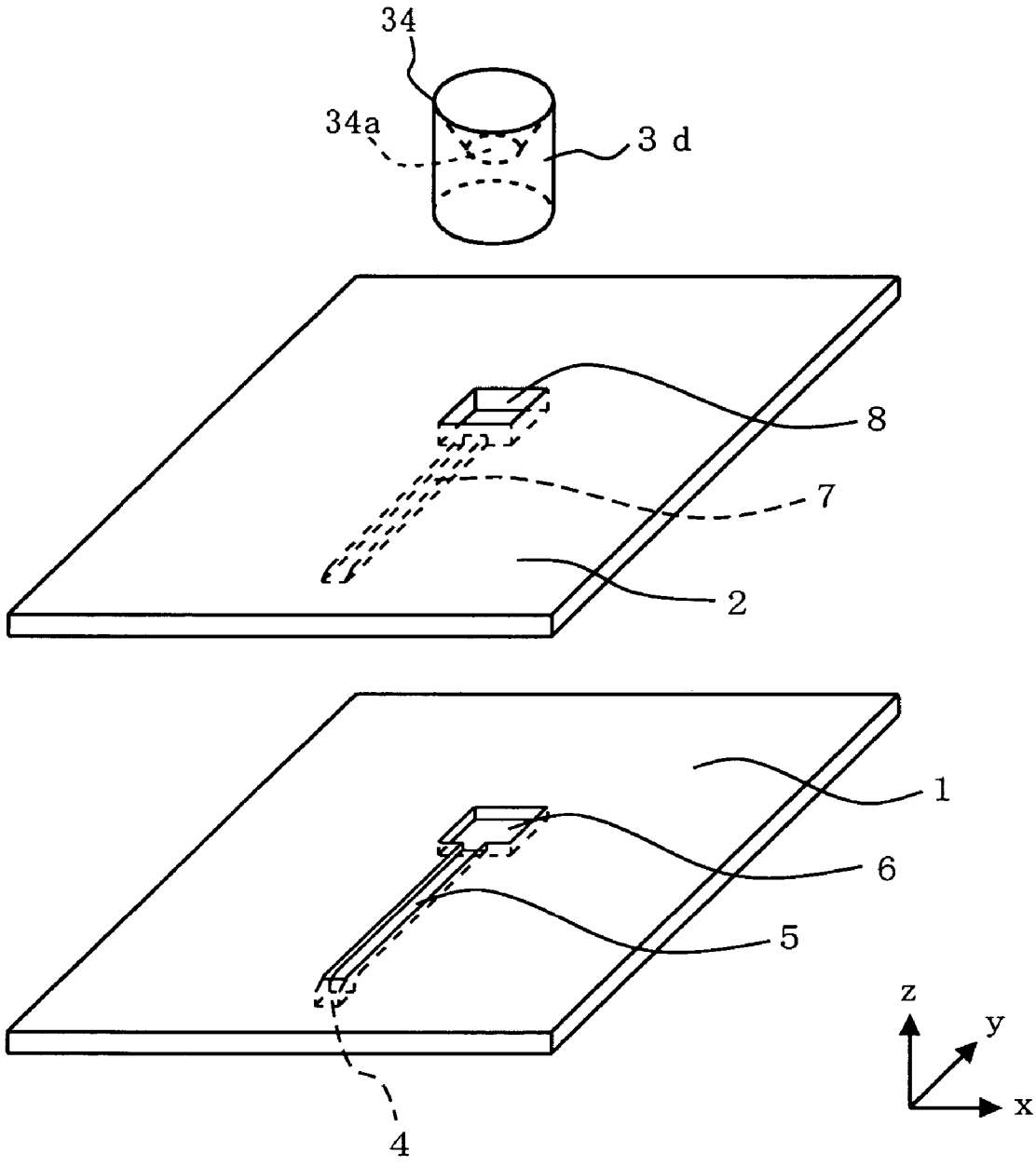
FIG. 12 is an exploded perspective view illustrating a dielectric antenna according to a third embodiment of the present invention.
Figure 13:
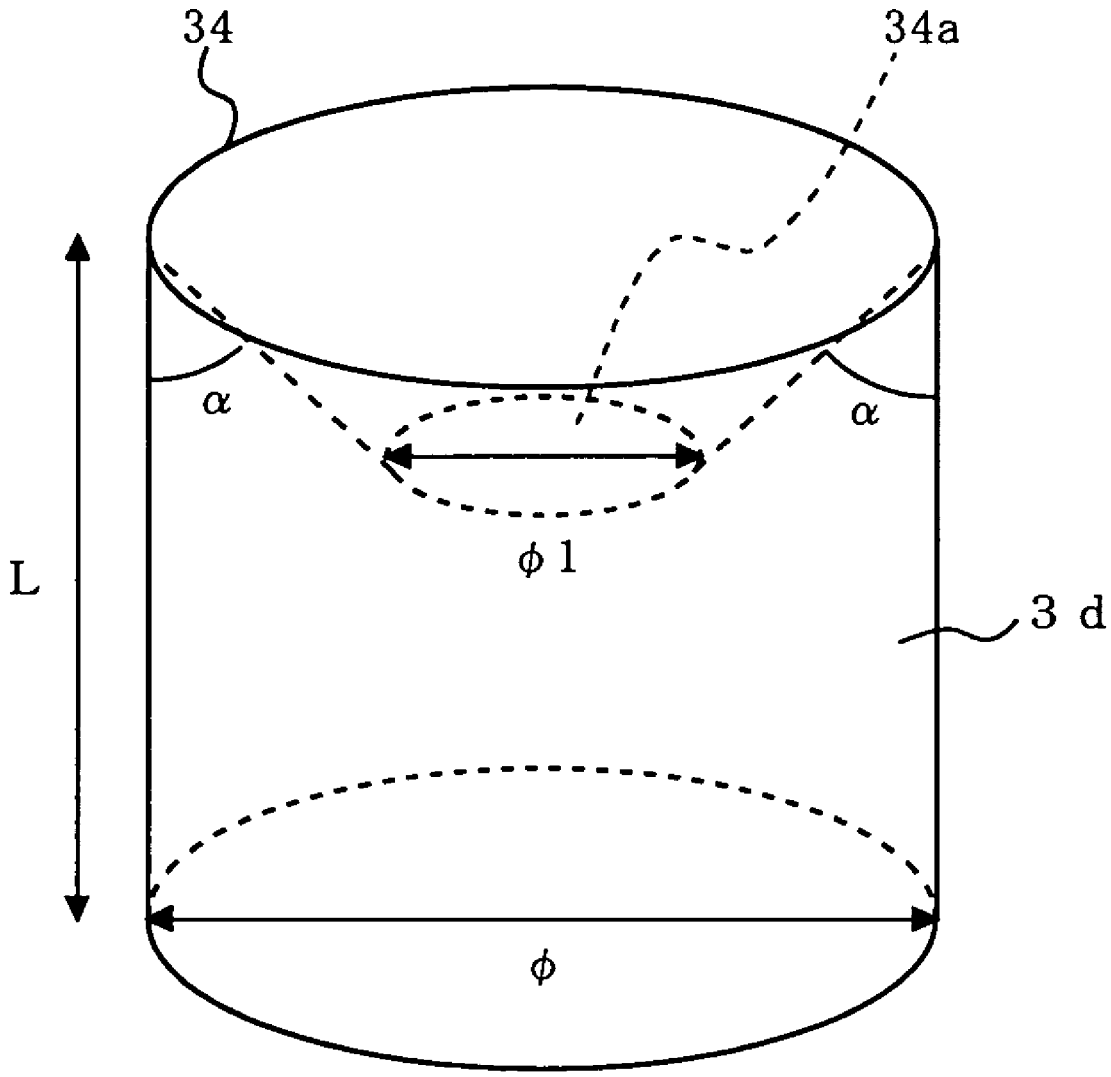
FIG. 13 is an enlarged perspective view illustrating a loading dielectric block 3*d;*

FIG. 12 is an exploded perspective view illustrating a dielectric antenna according to the third embodiment of the present invention. In FIG. 12, elements that are functionally the same as those of the first embodiment will be denoted by the same reference numerals and will not be further described below. The third embodiment uses, as the loading dielectric, a loading dielectric block 3*d* having a depressed portion 34 whose upper portion has a truncated cone shape. The loading dielectric block 3*d* has the depressed portion 34, whereby the upper portion thereof is in a bowl shape, and the depressed portion 34 includes, at the bottom thereof, a flat (horizontal) surface portion 34*a* parallel to the bottom surface of the loading dielectric block 3*d*. FIG. 13 is an enlarged perspective view of the loading dielectric block 3*d*.

Thus, with the loading dielectric block 3*d* with the bowl-shaped upper portion, an omni directional slope is formed toward the periphery with a flat bottom portion at the center, whereby the distribution of the primary beam directivity can be made less pointed, and the primary beam width is increased for all of the radiating surfaces.

Figure 14:
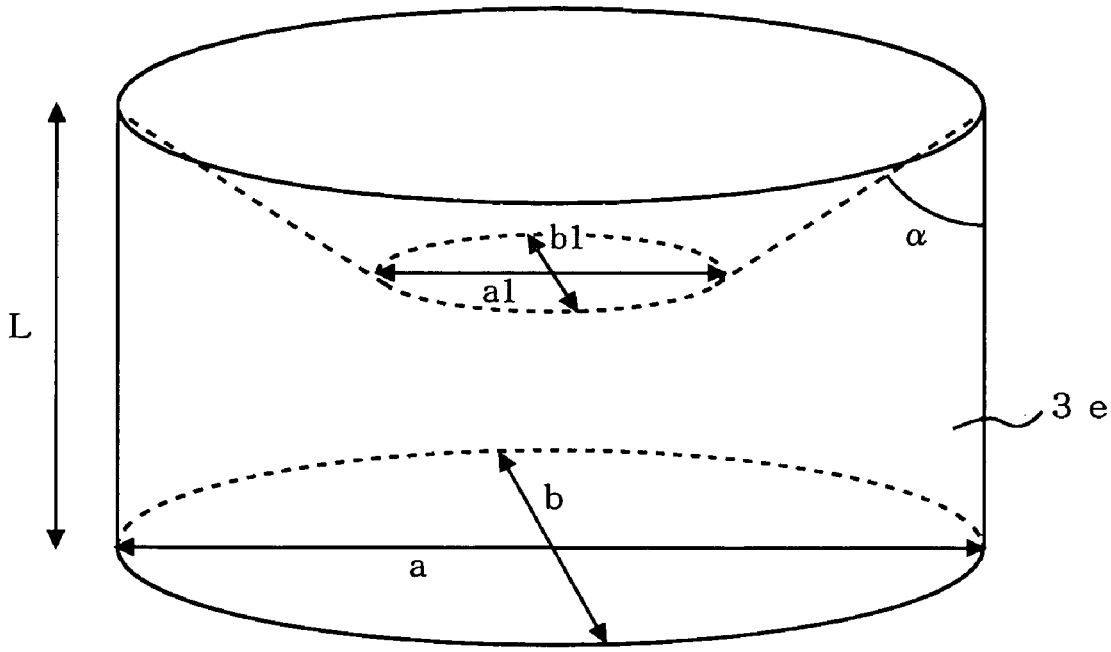
FIG. 14 is a perspective view illustrating an elliptic cylinder-shaped loading dielectric block 3*e* having a bowl-shaped upper portion.

Note that ripples occur in the electric field plane (see FIG. 30 and FIG. 31 to be described later) when using a bowl-shaped loading dielectric block, as will be described below. Ripples may be problematic depending on the characteristics required by the system connected to the dielectric antenna. In such a case, it may be effective for suppressing ripples to use a loading dielectric block having an elliptic cylinder shape with a bowl-shaped upper portion. FIG. 14 is a perspective view illustrating an elliptic cylinder-shaped loading dielectric block 3*e* having a bowl-shaped upper portion. Referring to FIG. 14, the ellipse major axes a and a1 and minor axes b and b1 are each adjusted to a length such that it is possible to suppress ripples in the electric field plane and in the magnetic field plane. The lengths can be obtained experimentally. Thus, in the electric field plane and in the magnetic field plane, the beam can be widened while suppressing ripples. Therefore, it is possible to provide an antenna capable of radiating an electromagnetic wave with uniform power over a wide angular range. Note however that where the aperture has a square shape, the ellipse axis length is smaller in the electric field plane than in the magnetic field plane.

Note that also with a square prism shape, ripples can similarly be suppressed by adjusting the lengths of the major and minor axes.

Fourth Embodiment

Figure 15:
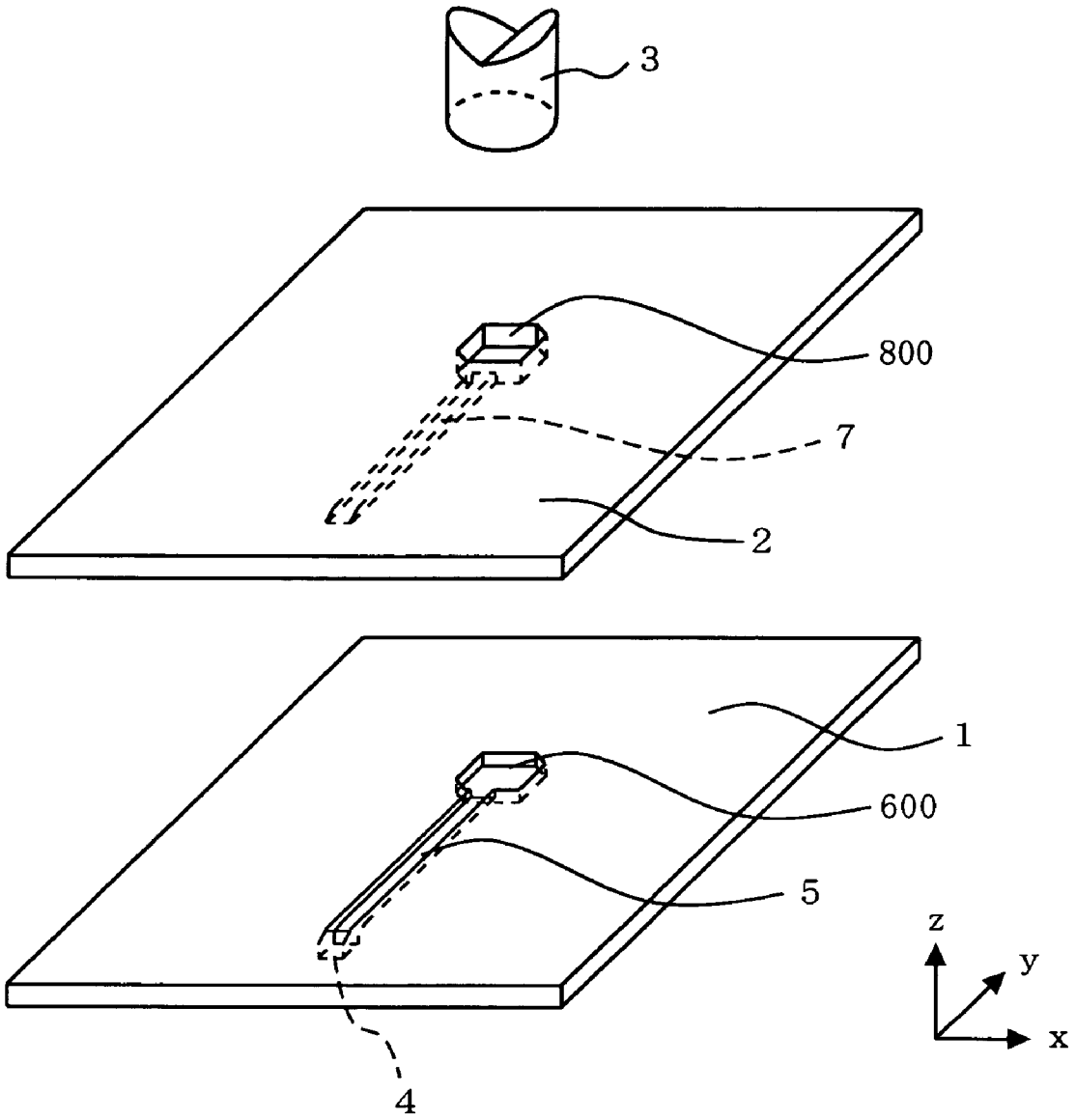
FIG. 15 is an exploded perspective view illustrating a dielectric antenna according to a fourth embodiment of the present invention.

FIG. 15 is an exploded perspective view illustrating a dielectric antenna according to the fourth embodiment of the present invention. In FIG. 15, elements that are functionally the same as those of the first embodiment will be denoted by the same reference numerals and will not be further described below. The fourth embodiment uses a hexagonal aperture 800 for feeding an electromagnetic wave to the loading dielectric block 3. The hexagonal aperture 800 is provided in the central portion of the upper conductor plate 2. A hexagonal depressed portion 600 is formed in the central portion of the lower conductor plate 1. The aperture 800 and the depressed portion 600 are in the same hexagonal shape of the same size.

Figure 16:
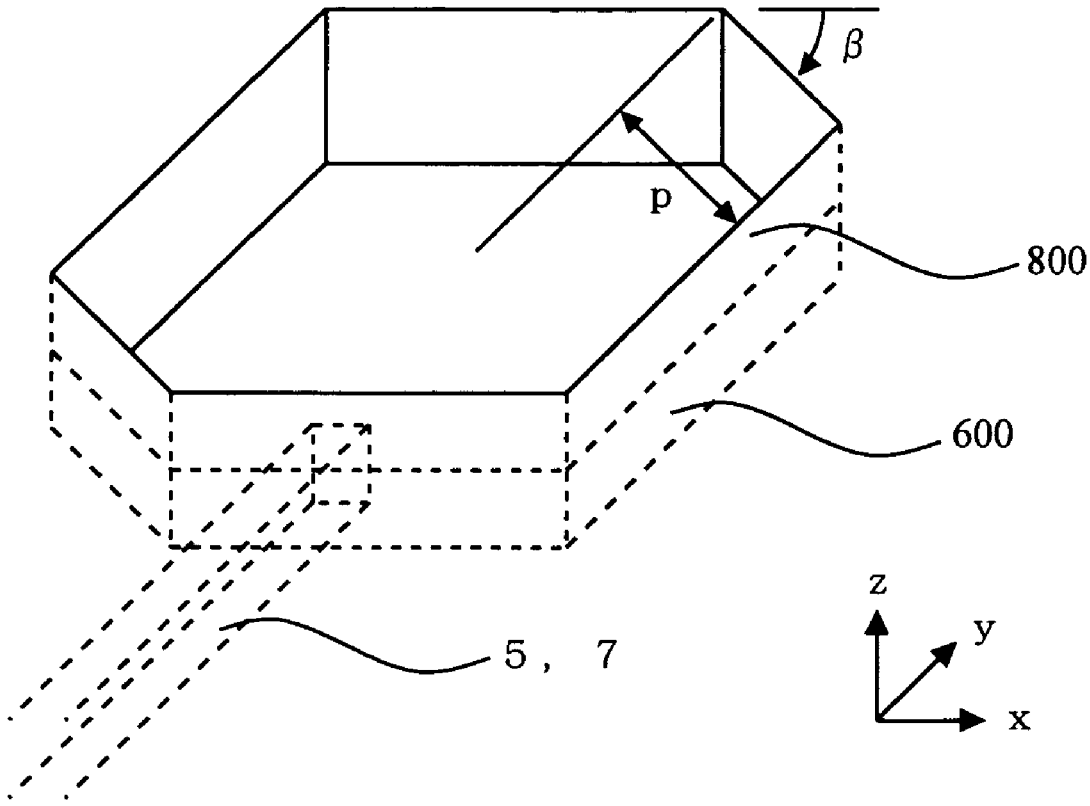
FIG. 16 is an enlarged perspective view illustrating an opening that is formed when an upper conductor plate 2 and a lower conductor plate 1 are attached together.

FIG. 16 is an enlarged perspective view illustrating an opening that is formed when the upper conductor plate 2 and the lower conductor plate 1 are attached together. The opening has a shape obtained by cutting off corners of a square shape at an angle of β, as illustrated in FIG. 16, whereby elliptically-polarized waves can be fed to the loading dielectric block 3. Based on which ones of the four corners of the square shape are to be cut off, the rotation direction of the electric field vector can be changed, whereby it is possible to determine the direction (whether right-handed or left-handed) of the polarized wave. Moreover, the axial ratio of the polarized wave can be controlled by adjusting the cutting position p. The wave is a circularly-polarized wave if the axial ratio is 1:1, and an elliptically-polarized wave otherwise.

Thus, by loading a hexagonal aperture with a dielectric block, it is possible to provide a dielectric antenna radiating an elliptically- or circularly-polarized electromagnetic wave.

Note that the present invention is not limited to the structures described above as long as the dielectric antenna can be operated with elliptically- or circularly-polarized waves.

Note that if a dielectric block having an upper depressed portion with a flat surface portion (see, for example, FIG. 9 to FIG. 11) or a dielectric block having a bowl-shaped upper depressed portion (see, for example, FIG. 12 to FIG. 14) as described above in the second embodiment is employed as the dielectric block to be placed over the hexagonal aperture, it is possible to provide a dielectric antenna capable of radiating elliptically- or circularly-polarized waves with a large beam width. In addition, any of other various shapes described herein can be employed for the dielectric block.

Figure 17A:
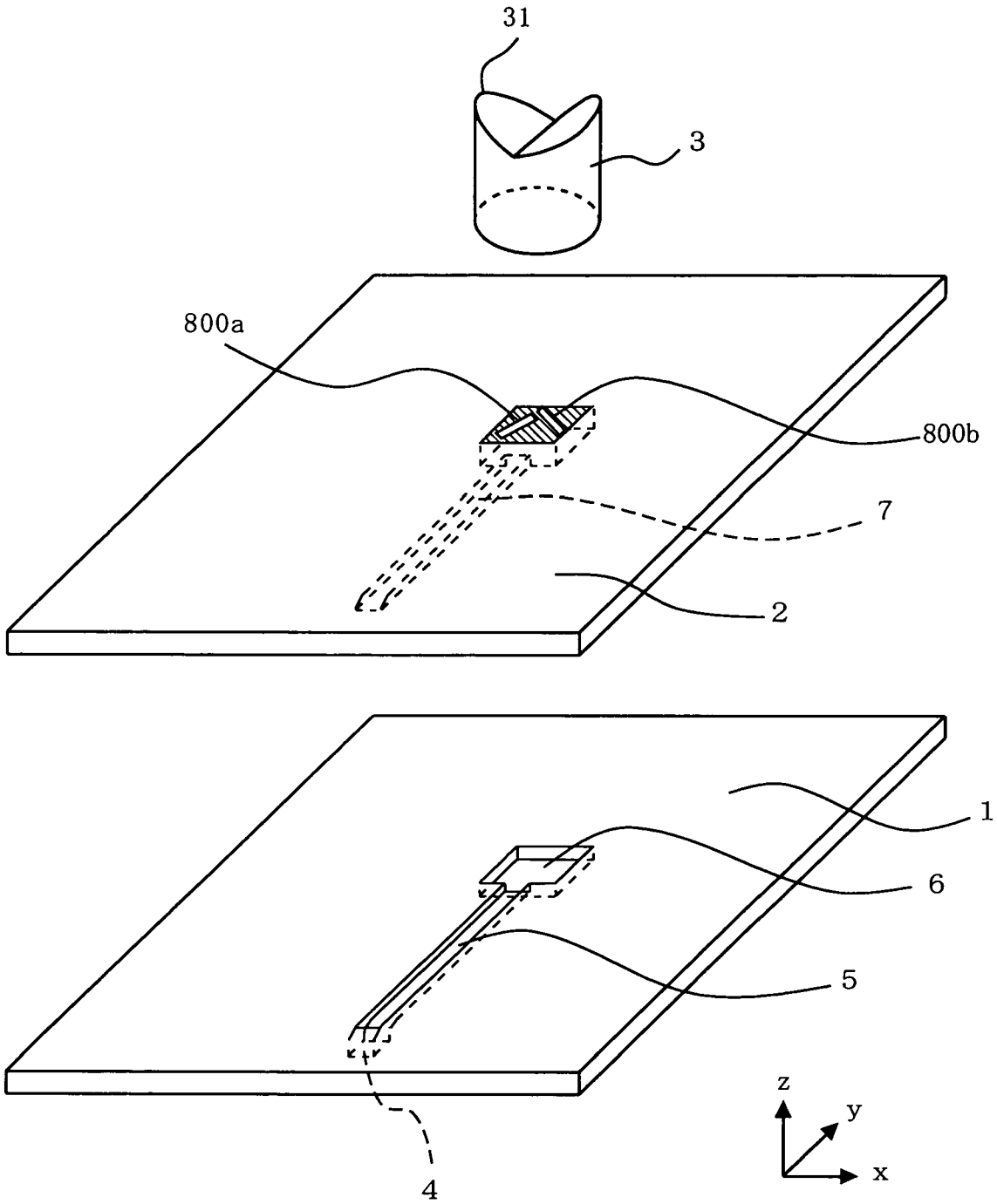
FIG. 17A is an exploded perspective view illustrating a dielectric antenna in which an aperture 8 includes two rectangular apertures 800*a* and 800*b* that are not parallel to each other.

FIG. 17A is an exploded perspective view illustrating a dielectric antenna in which the aperture 8 includes two rectangular apertures 800*a* and 800*b* that are not parallel to each other. Where the aperture 8 includes the two rectangular apertures 800*a* and 800*b* that are not parallel to each other as illustrated in FIG. 17A, the driving electromagnetic field in one aperture is oriented differently from that in the other aperture since the aperture 800*a* and the aperture 800*b* are not parallel to each other. Thus, two differently-oriented electromagnetic fields that are not in phase with each other will be fed into the loading dielectric block 3. Therefore, the electromagnetic field radiated from the loading dielectric block 3 will be an elliptically-polarized wave.

Figure 17B:
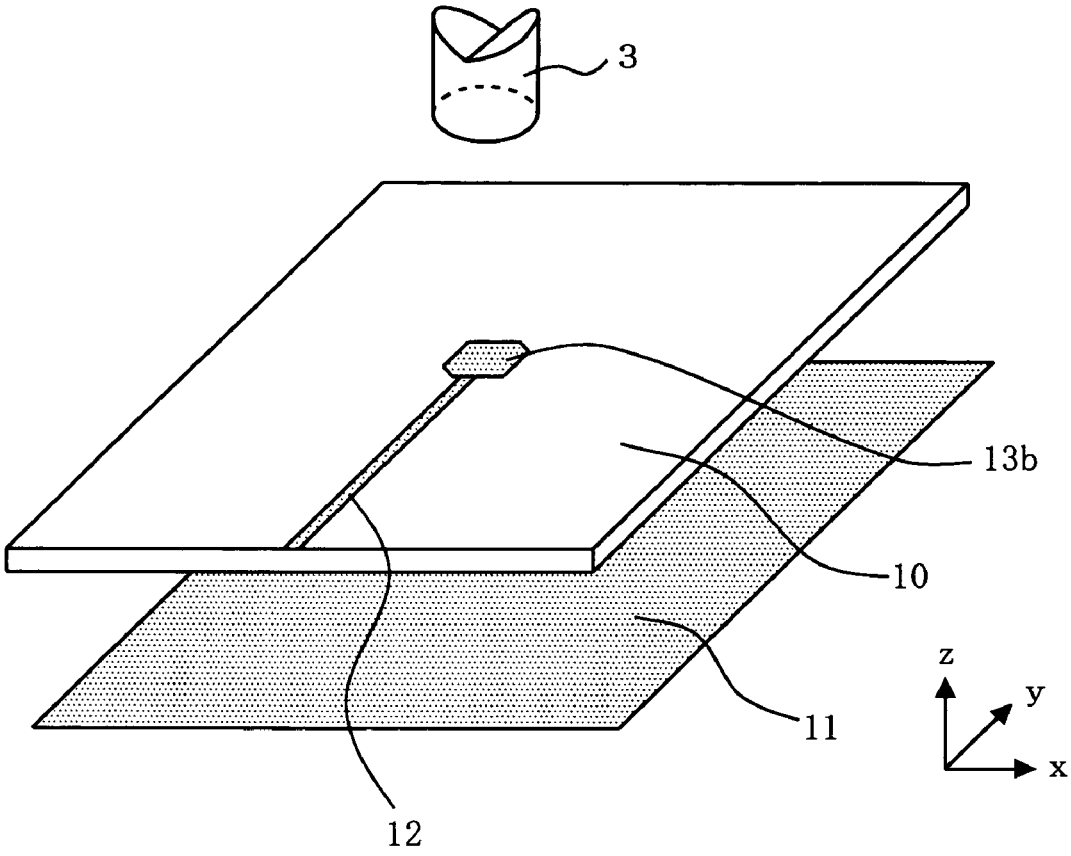
FIG. 17B is an exploded perspective view illustrating a dielectric antenna in which an electromagnetic wave is fed by a microstrip line.

Note that while a hollow waveguide is used for feeding an electromagnetic wave in the embodiment above, an electromagnetic wave may alternatively be fed by using a microstrip line. FIG. 17B is an exploded perspective view illustrating a dielectric antenna in which an electromagnetic wave is fed by a microstrip line. In FIG. 17B, elements that are functionally the same as those of the dielectric antenna illustrated in FIG. 6 will be denoted by the same reference numerals and will not be further described below. By forming a driven patch 13*b* in a hexagonal shape as illustrated in FIG. 17B, it is possible to feed elliptically- or circularly-polarized waves.

Fifth Embodiment

Figure 18:
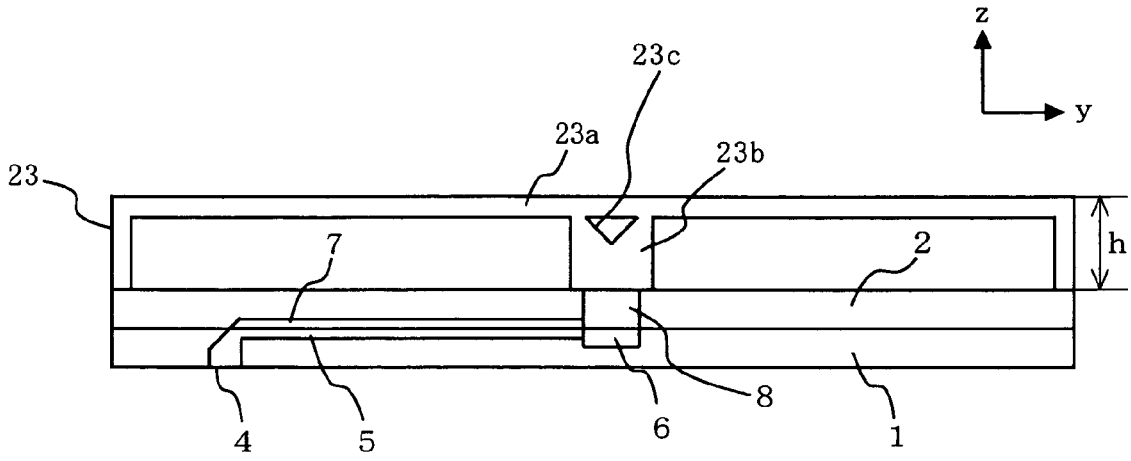
FIG. 18 is a cross-sectional view of a dielectric antenna according to a fifth embodiment of the present invention taken along the yz plane.

FIG. 18 is a cross-sectional view of a dielectric antenna according to the fifth embodiment of the present invention taken along the yz plane. In FIG. 18, elements that are functionally the same as those of the first embodiment will be denoted by the same reference numerals and will not be further described below. In the fifth embodiment, a loading dielectric-integrated radome 23 is placed on the upper surface of the upper conductor plate 2.

The loading dielectric-integrated radome 23 includes a box-shaped section 23*a*, and a loading dielectric section 23*b* similar in shape to one of the loading dielectrics described in the first to fourth embodiments above. The box-shaped section 23*a* and the loading dielectric section 23*b* are formed as an integral member.

First, the manufacturer shaves a rectangular-parallelepiped dielectric block into a box shape so as to leave a cylindrical protrusion having the same diameter as the loading dielectric section 23*b*. This may alternatively be produced by molding. Then, the manufacturer cuts out a V-shaped portion from the cylindrical protrusion so as to form a notch 23*c*.

Assume that the thickness h of the loading dielectric-integrated radome 23 is as shown in the following expression so that reflected waves can be suppressed.

$$h = \text{about } \frac{\lambda}{2\sqrt{\varepsilon r}}$$

multiplied by odd number where λ is the wavelength in free space, and ∈r is the relative dielectric constant of the resin used.

The loading dielectric-integrated radome 23 has such a size that it completely covers the upper surface of the upper conductor plate 2. In the loading dielectric-integrated radome illustrated in FIG. 18, the side surfaces of the box-shaped section 23*a* are aligned with those of the upper conductor plate 2. The loading dielectric section 23*b* is located in a central portion of the box-shaped section 23*a* so that the loading dielectric section 23*b* will be placed over the aperture 8. The manufacturer attaches the loading dielectric-integrated radome 23 and the upper conductor plate 2 to each other so that the side surfaces of the loading dielectric-integrated radome 23 are aligned with those of the upper conductor plate 2.

In the fifth embodiment, the loading dielectric and the radome are formed as an integral member, as described above, thereby facilitating the positioning of the dielectric to be placed over the aperture. With the dielectric antennas of the first to fourth embodiments, the adjustment of the positions of the loading dielectric and the aperture may be difficult. Particularly, for a high frequency range such as a millimeter-wave range, the loading dielectric and the aperture are smaller, further increasing the difficulty of the positional adjustment thereof. A positional shift lowers the gain and results in variations in the primary beam direction. Moreover, a layer of adhesive, or the like, is formed at the junction between the loading dielectric and the aperture, whereby desirable characteristics may not be realized. These factors may result in product variations. Forming the loading dielectric and the radome as an integral member as in the fifth embodiment eliminates the difficulty of properly positioning a separate loading dielectric.

Moreover, there will be no adhesive layer between the bottom surface of the loading dielectric and the aperture for bonding the loading dielectric-integrated radome with the upper conductor plate, whereby desirable characteristics can easily be realized.

Note that while the loading dielectric-integrated radome has a rectangular parallelepiped shape in the embodiment above, it is not limited to a rectangular parallelepiped as long as it coincides with the upper conductor plate.

Similarly, with an array antenna including a large number of loading dielectrics, all the loading dielectrics may be formed as an integral member with the radome.

While the embodiment above is directed to a dielectric antenna in which an electromagnetic wave is fed by a waveguide, the loading dielectric and the radome may similarly be formed as an integral member with a dielectric antenna in which an electromagnetic wave is fed by a strip line.

Note that while a V-shaped notch is provided in the embodiment above, a depressed portion with a flat surface portion may alternatively be formed as illustrated in FIG. 9 or FIG. 11. In addition, any of other various shapes described herein can be employed for the depressed portion.

Sixth Embodiment

Figure 19:
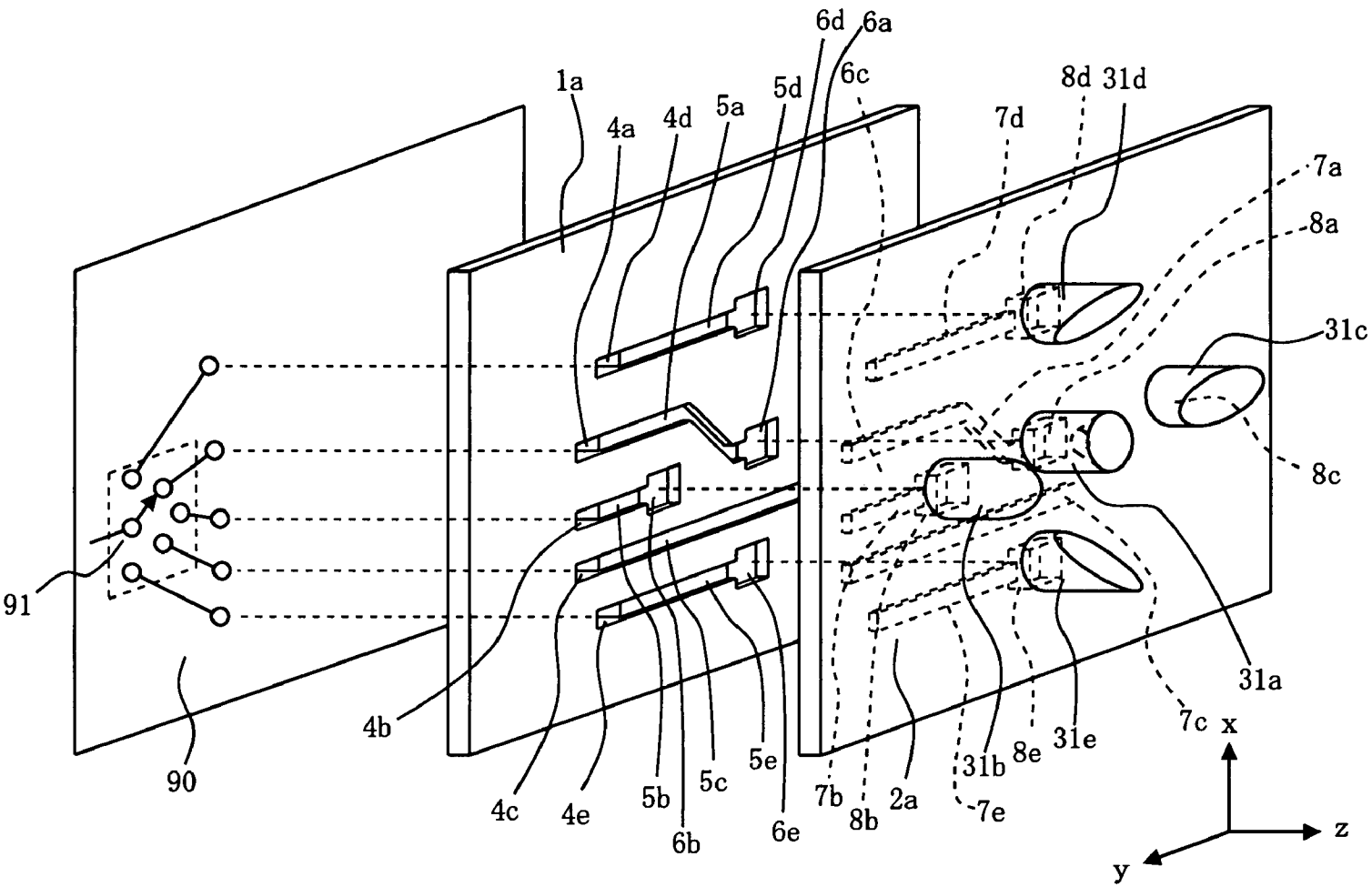
FIG. 19 is an exploded perspective view illustrating a structure of a dielectric antenna array with a selector switch according to a sixth embodiment of the present invention.

FIG. 19 is an exploded perspective view illustrating a structure of a dielectric antenna array with a selector switch according to the sixth embodiment of the present invention. Referring to FIG. 19, the dielectric antenna array includes a lower conductor plate 1*a*, an upper conductor plate 2*a*, loading dielectric blocks 31*a* to 31*e*, and a circuit board 90 to be attached to the bottom surface of the lower conductor plate 1*a*. The circuit board 90 includes a selector switch circuit 91. The lower conductor plate 1*a* includes feed ports 4*a* to 4*e*, waveguide grooves 5*a* to 5*e* and depressed portions 6*a* to 6*e*. The upper conductor plate 2*a* includes waveguide grooves 7*a* to 7*e* and apertures 8*a* to 8*e*.

The selector switch circuit 91 includes one input terminal and five output terminals, and the input terminal can be selectively connected to one of the output terminals. The switching between the output terminals is done according to an instruction from a control circuit (not shown). The five output terminals of the selector switch circuit 91 are each connected to a corresponding one of the feed ports 4*a* to 4*e* via a converter for converting a coaxial line or a strip line to a waveguide, a probe for feeding a waveguide, or the like.

The feed ports 4*a* to 4*e* are provided so as to respectively correspond to the output terminals of the selector switch circuit 91. The waveguide grooves 5*a* to 5*e* are formed on the upper surface of the lower conductor plate 1*a* so as to be connected to the feed ports 4*a* to 4*e* at one end thereof. The depressed portions 6*a* to 6*e* are formed at the other end of the waveguide grooves 5*a* to 5*e*, respectively.

The waveguide grooves 7*a* to 7*e* are formed on the lower surface of the upper conductor plate 2*a* so as to form five waveguides together with the waveguide grooves 5*a* to 5*e* when the lower conductor plate 1*a* and the upper conductor plate 2*a* are attached to each other. The apertures 8*a* to 8*e* are formed at one end of the waveguide grooves 7*a* to 7*e*, respectively.

The loading dielectric blocks 31*a* to 31*e* are placed over the apertures 8*a* to 8*e*, respectively. The loading dielectric block 31*a* is a bowl-shaped dielectric block as illustrated in the third embodiment (see FIG. 13). The loading dielectric blocks 31*b* to 31*e* are each in a shape obtained by cutting off an upper portion of a cylinder at an inclined angle, and are arranged in the x axis direction and the y axis direction in the figure so as to surround the loading dielectric block 31*a* at the center of the arrangement. The slopes of the loading dielectric blocks 31*b* to 31*e* are all facing toward the loading dielectric block 31*a*. The loading dielectric block 31*a* is aligned with the center of the aperture 8*a*. The loading dielectric blocks 31*b* to 31*e* are aligned with the centers of the apertures 8*b* to 8*e*, respectively.

Thus, in the sixth embodiment, the loading dielectric blocks 31*b* to 31*e* are arranged around the bowl-shaped loading dielectric block 31*a* at the center of the arrangement with the slopes of the loading dielectric blocks 31*b* to 31*e* all facing toward the center of the arrangement. With such an arrangement, the loading dielectric block 31*a* at the center has a forward radiation directivity. The other four loading dielectric blocks 31*b* to 31*e* each have a radiation directivity in a different direction that is inclined from the forward direction. While the antenna of the present embodiment is a five-element array antenna, one of the loading dielectrics to which an electromagnetic wave is inputted can be selected by using a selector switch. Therefore, by operating the switch according to the position of the other party, it is possible to always communicate with the other party with a high gain irrespective of the direction in which the other party is located. Thus, with such an array antenna in which a plurality of loading dielectrics have radiation directivities in different directions, and one of the loading dielectrics is selected by a selector switch, it is possible to provide a dielectric antenna with a high gain and a wide coverage.

While the loading dielectric block 31*a* whose central portion is depressed is located at the center of the arrangement in the embodiment above, the loading dielectric block 31*a* may be located in other positions. Moreover, while the peripheral loading dielectrics have slopes facing toward the center of the arrangement in the embodiment above, the arrangement is not limited to this as long as the slope of each peripheral loading dielectric is facing the direction in which an electromagnetic wave is intended to be radiated. The direction in which an electromagnetic wave is radiated can be set to any of various directions by accordingly setting the direction of the slope of a peripheral loading dielectric.

Note that radio waves may be radiated from all loading dielectrics at the same time by not using the selector switch.

Figure 20:
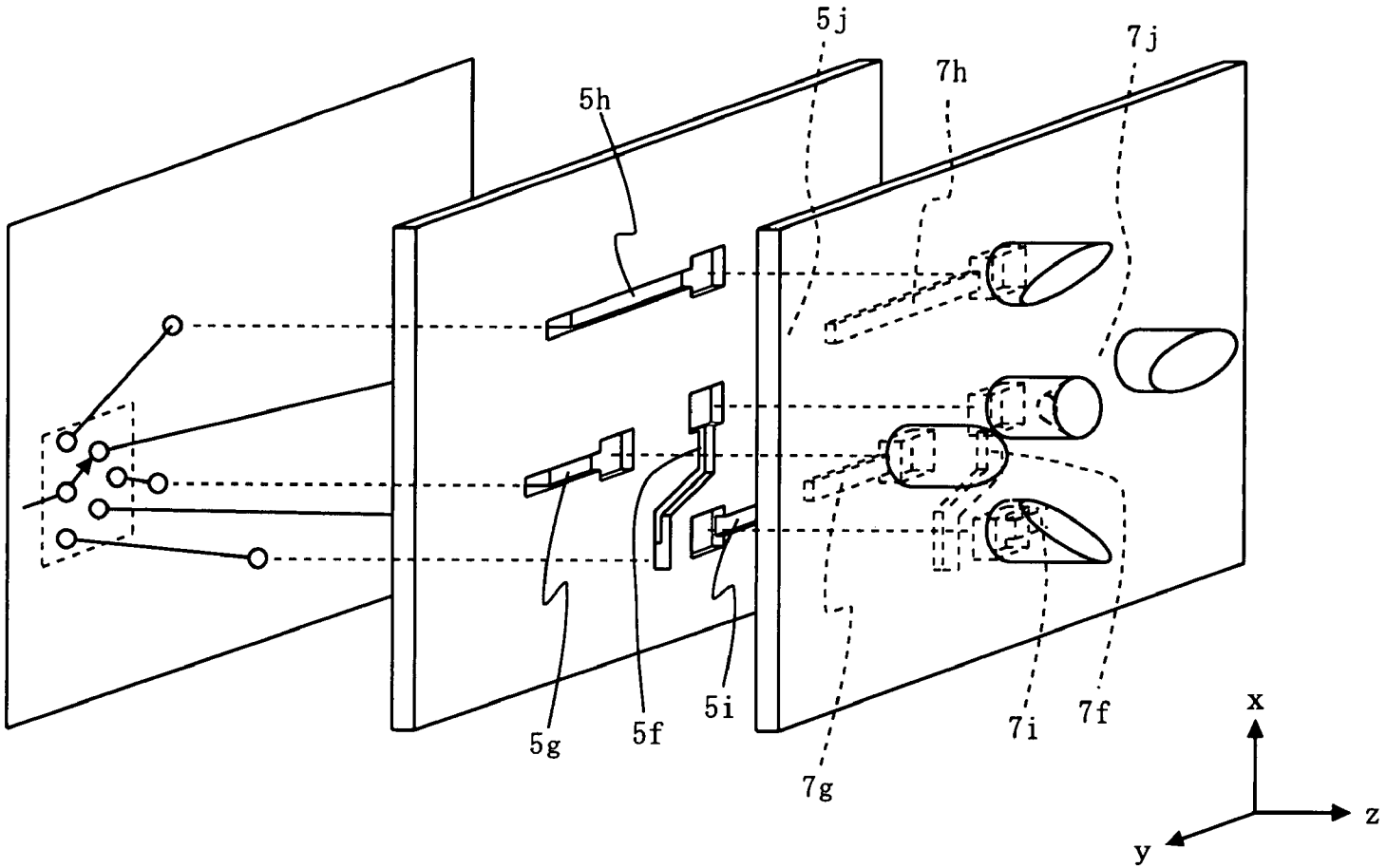
FIG. 20 is an exploded perspective view illustrating a general structure of a multi-element dielectric antenna where adjacent elements are responsible for perpendicularly-polarized electromagnetic waves, in which a central waveguide is arranged perpendicular to peripheral waveguides.
Figure 21:
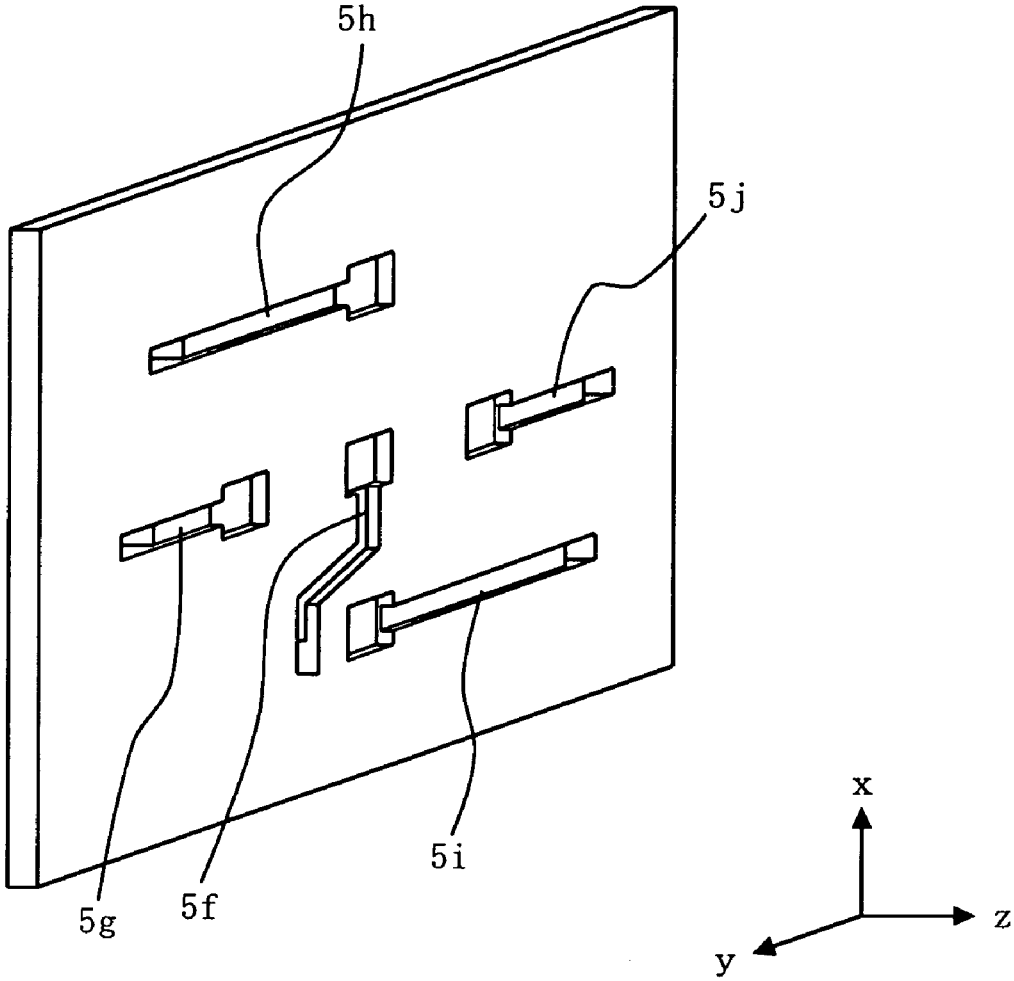
FIG. 21 is a perspective view illustrating the lower conductor plate shown in FIG. 20.

Note that while the waveguide for feeding the central loading dielectric block 31*a* (hereinafter referred to as the "central waveguide") extends parallel to the waveguides for feeding the peripheral loading dielectric blocks 31*b* to 31*e* (hereinafter referred to as the "peripheral waveguides") in the embodiment above, the arrangement of the waveguides is not limited to this. For example, the central waveguide may extend perpendicular to the peripheral waveguides. FIG. 20 is an exploded perspective view illustrating a general structure of a multi-element dielectric antenna where adjacent elements are responsible for perpendicularly-polarized electromagnetic waves, in which the central waveguide is arranged perpendicular to the peripheral waveguides. FIG. 21 is a perspective view illustrating the lower conductor plate shown in FIG. 20.

Referring to FIG. 20 and FIG. 21, central waveguide grooves 5*f* and 7*f* are perpendicular to peripheral waveguide grooves 5*g* to 5*j* and 7*g* to 7*j* (grooves 7*i* and 7*j* are not shown in the figures). With such an arrangement, the electric field direction for the central waveguide is the Y direction, and that for the peripheral waveguides is the X direction. Thus, polarized waves will be perpendicular to each other, thereby improving the isolation between the central loading dielectric block and the peripheral loading dielectric blocks.

Note that while the central waveguide and the peripheral waveguides are perpendicular to each other in the illustrated example, the arrangement is not limited to that shown in FIG. 20 as long as waveguides, between which an improved isolation is desired, are perpendicular to each other.

Note that there are five loading dielectric blocks in the embodiment above, the number of loading dielectric blocks may be four or less or six or more. Note however that in the present invention, the vertical cross section of at least one loading dielectric block has such a shape that the height of the block gradually increases toward the side surface thereof.

Note that the peripheral loading dielectric blocks are arranged so as to surround the central loading dielectric block in a circular pattern in the embodiment above, the loading dielectric blocks may be arranged in various directions according to the intended directivity.

Note that an electromagnetic wave is fed by using a waveguide in the embodiment above, an electromagnetic wave may alternatively be fed by using a strip line.

Note that the plurality of loading dielectric blocks may be formed as an integral member with a radome.

Seventh Embodiment

Figure 22:
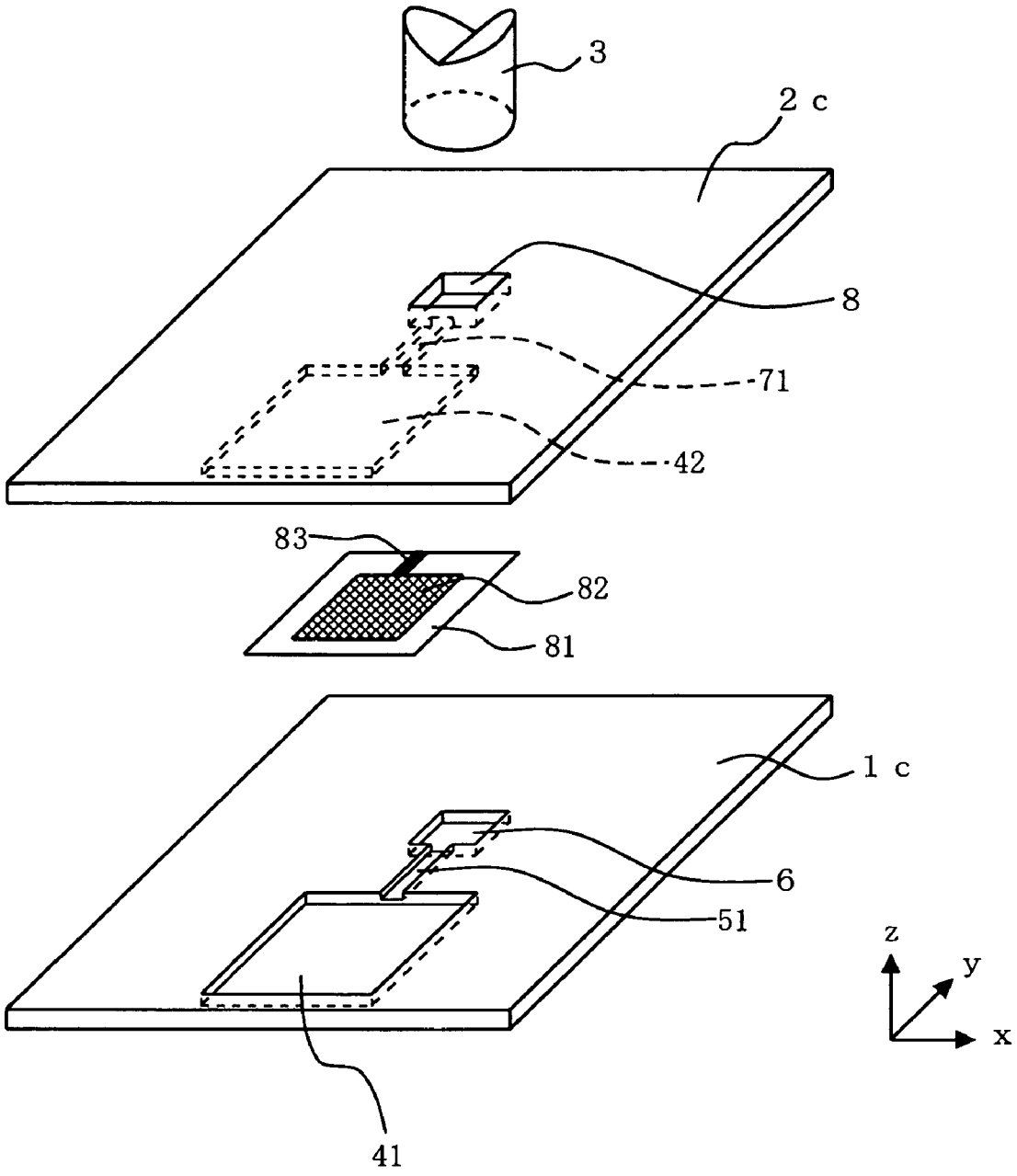
FIG. 22 is an exploded perspective view illustrating a circuit-embedded radio device according to a seventh embodiment of the present invention.

FIG. 22 is an exploded perspective view illustrating a circuit-embedded radio device according to the seventh embodiment of the present invention. In FIG. 22, elements that are functionally the same as those of the first embodiment will be denoted by the same reference numerals and will not be further described below. Referring to FIG. 22, the radio device includes a lower conductor plate 1*c*, a circuit board 81, an upper conductor plate 2*c* and the loading dielectric block 3. The lower conductor plate 1*c* includes a first depressed portion 41 for accommodating the circuit board 81, a first waveguide groove 51 and the depressed portion 6. The upper conductor plate 2*c* includes a second depressed portion 42 for accommodating the circuit board 81, a second waveguide groove 71 and the aperture 8. The circuit board 81 includes a communications circuit 82 and a microstrip line 83. The circuit board 81 is accommodated in a cavity that is formed by the first and second depressed portions 41 and 42 when the upper conductor plate 2*c* and the lower conductor plate 1*c* are attached to each other.

An electromagnetic wave propagating through the air is inputted to the communications circuit 82 via the loading dielectric block 3, the waveguide and the microstrip line 83. In the communications circuit 82, the inputted electromagnetic wave is subjected to various operations such as filtering, amplification, mixing, modulation/demodulation, etc. Thus, the radio device illustrated in FIG. 22 functions as a receiver.

When transmitting a electromagnetic wave, an electromagnetic wave outputted from an oscillator (not shown), a modulation circuit (not shown), etc., in the communications circuit 82 is passed to the aperture 8 via the microstrip line 83 and the waveguide, and then fed to the loading dielectric block 3 and radiated therefrom.

Thus, in the seventh embodiment, a communications circuit is integrally connected to a small dielectric antenna, whereby it is possible to provide a small radio device. Moreover, for a high frequency range such as a millimeter-wave range, the circuit can be made very small, whereby the size of the radio device as a whole can also be very small.

Note that the shape of the loading dielectric block 3 may be any of various shapes illustrated in the first to third embodiments.

Note that the communications circuit 82 and the microstrip line 83 are regarded as separate members in the embodiment above, they maybe together regarded as a communications circuit. Moreover, while a microstrip line is used for feeding an electromagnetic wave to the waveguide in the embodiment above, an electromagnetic wave may alternatively be fed to the waveguide by using other high frequency lines such as a coplanar line, a grounded coplanar line, etc. In other words, a high frequency line such as a microstrip line, a coplanar line, a grounded coplanar line, etc., for feeding an electromagnetic wave to the waveguide may be formed in the communications circuit.

Note that in addition to a microstrip line, a coplanar line and a grounded coplanar line, the high frequency line used in the embodiment above may include a coaxial line, a strip line, a slot line, a triplate line, a parallel plate, an NRD, etc.

Note that while an electromagnetic wave is fed directly to the waveguide from a high frequency line such as a microstrip line in the embodiment above, an electromagnetic wave may alternatively be fed by using a ridge waveguide converter or a probe converter.

Figure 23:
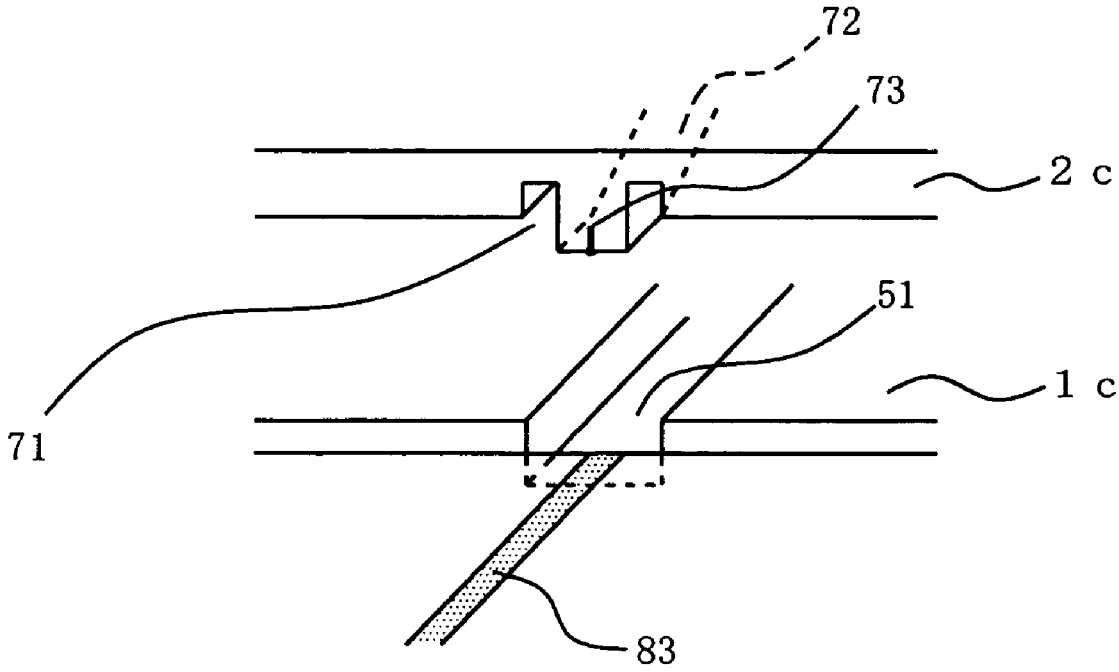
FIG. 23 is an exploded perspective view illustrating a structure in which an electromagnetic wave is fed by using a ridge waveguide converter.
Figure 24:
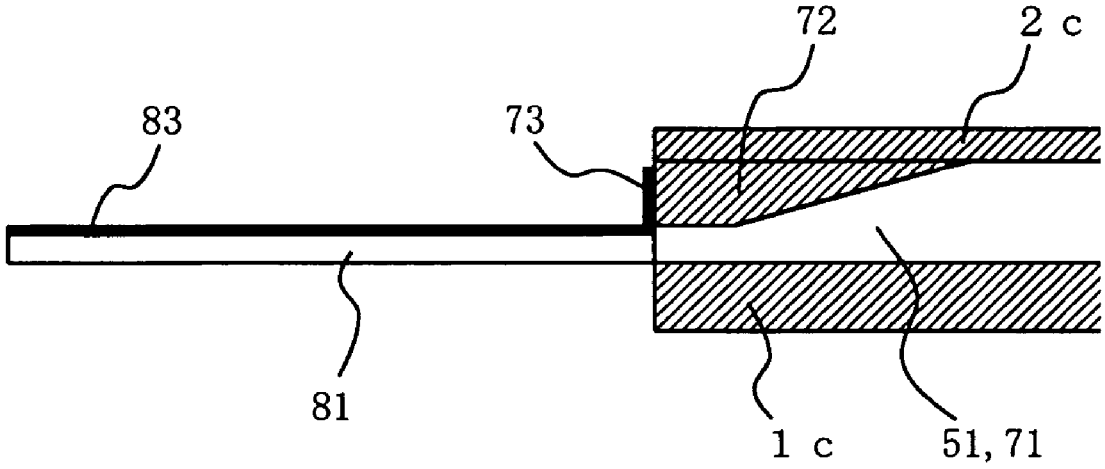
FIG. 24 is a cross-sectional view illustrating a structure in which an electromagnetic wave is fed by using a ridge waveguide converter.

FIG. 23 is an exploded perspective view illustrating a structure in which an electromagnetic wave is fed by using a ridge waveguide converter. FIG. 24 is a cross-sectional view illustrating a structure in which an electromagnetic wave is fed by using a ridge waveguide converter. In FIG. 23 and FIG. 24, elements that are functionally the same as those of the radio device illustrated in FIG. 22 will be denoted by the same reference numerals and will not be further described below.

Referring to FIG. 23 and FIG. 24, a ridge waveguide converter includes a tapered portion 72 provided at the end of the second waveguide groove 71, and a probe 73 formed on the circuit-side end surface of the tapered portion 72. The tapered portion 72 and the probe 73 are formed as an integral member with the upper conductor plate 2*c*. The probe 73 is connected to the microstrip line 83. Thus, by feeding an electromagnetic wave via a probe and a tapered portion, an electromagnetic wave propagating through the inside of the waveguide as a TE wave can be converted to a TEM wave, whereby it is possible to reduce the reflection loss of the electromagnetic wave and thus to feed an electromagnetic wave with reduced power loss.

Figure 25:
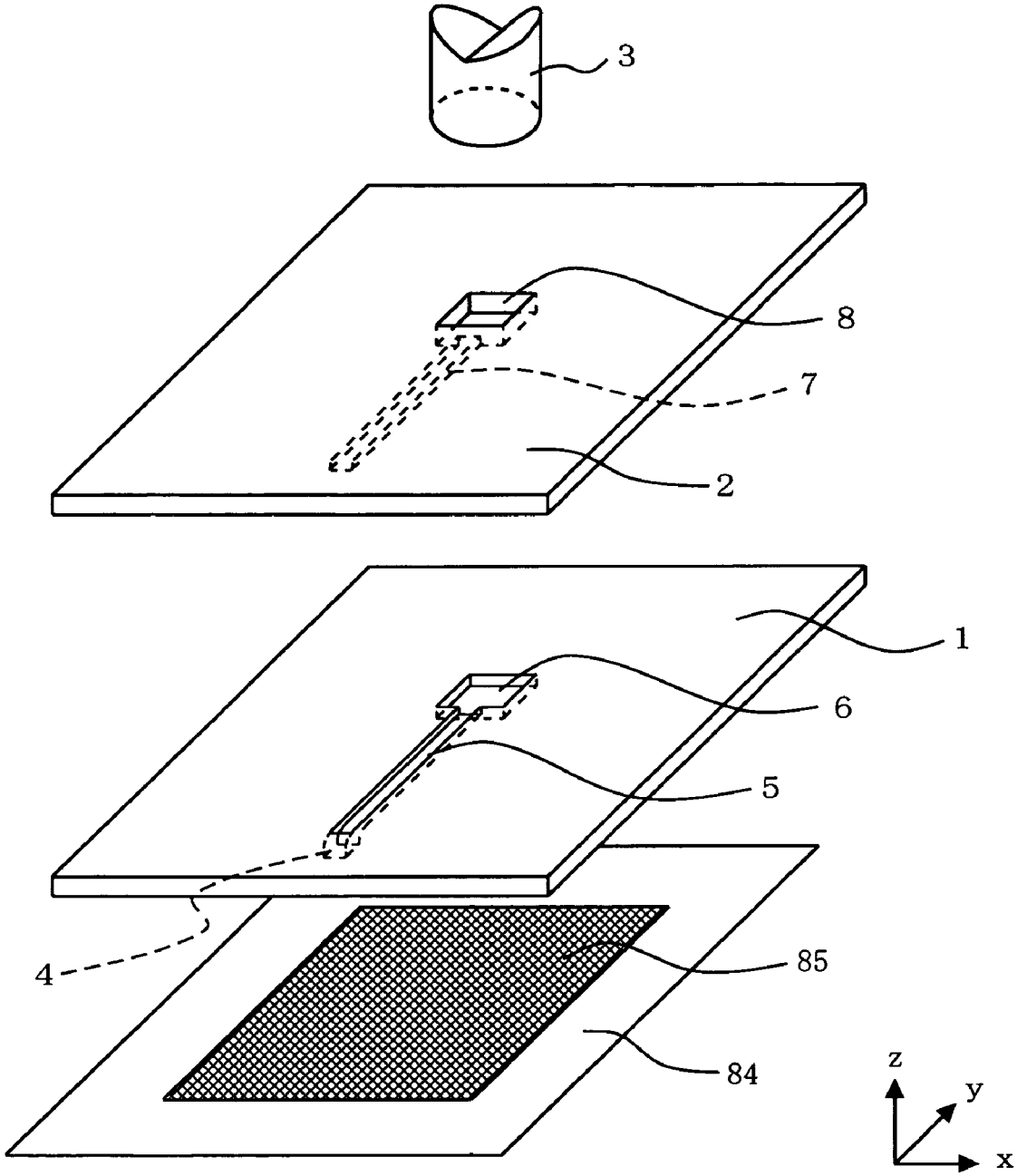
FIG. 25 is an exploded perspective view illustrating a radio device in which a circuit board is placed on the lower surface of the lower conductor plate.

Note that the circuit board is inserted between the upper conductor plate and the lower conductor plate in the embodiment above, the position of the circuit board is not limited to this. For example, the circuit board may be formed on the lower surface of the lower conductor plate. FIG. 25 is an exploded perspective view illustrating a radio device in which the circuit board is placed on the lower surface of the lower conductor plate. In FIG. 25, elements that are functionally the same as those of the first embodiment will be denoted by the same reference numerals and will not be further described below. Similar effects can be obtained when a circuit board 84, on which a communications circuit 85 is formed, is provided on the lower surface of the lower conductor plate 1 as illustrated in FIG. 25. Note that in such a case, a ridge waveguide converter or a probe converter may be used for feeding an electromagnetic wave to the feed port 4.

Figure 26:
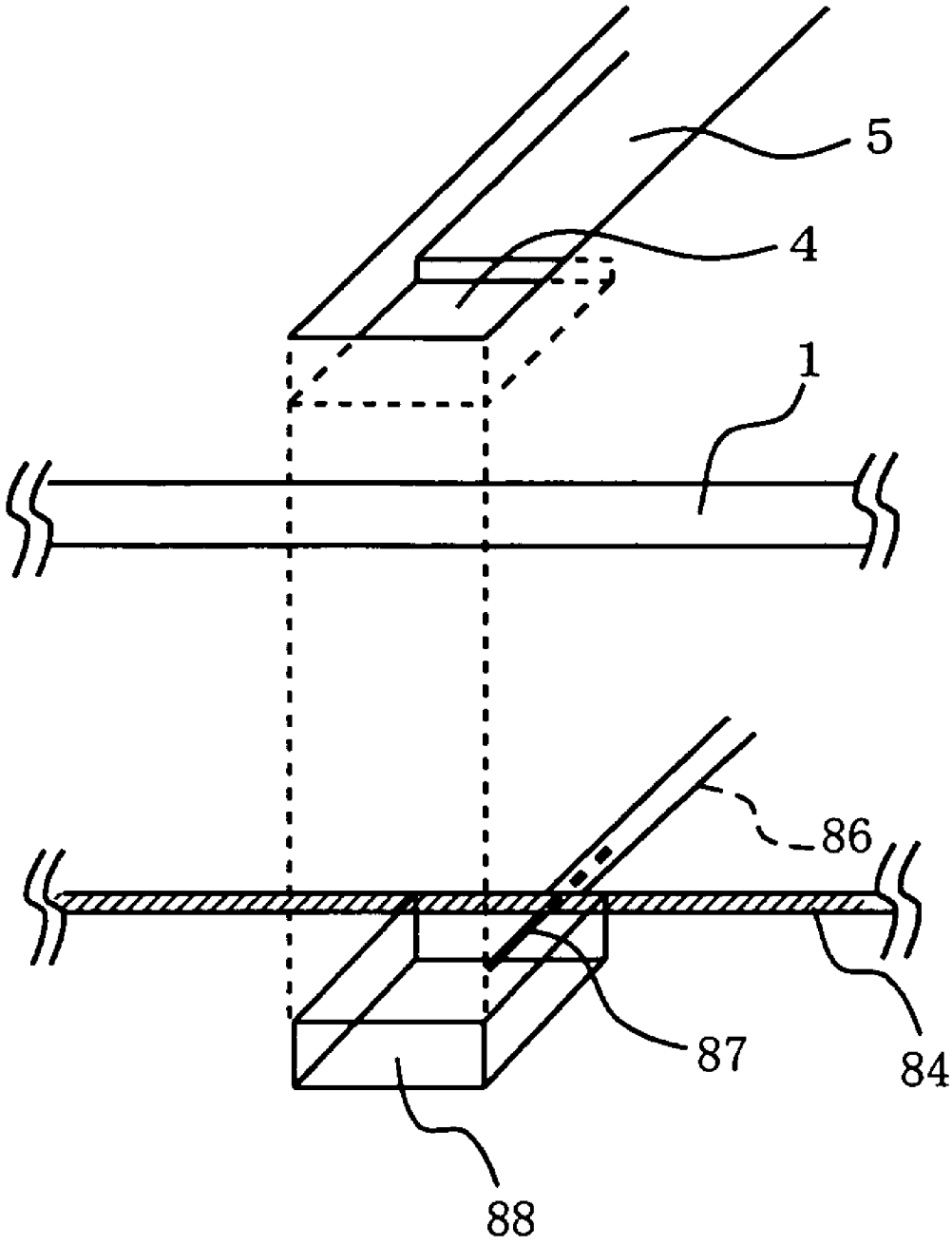
FIG. 26 is an exploded perspective view illustrating a feed section in a case where a probe converter is used in the radio device illustrated in FIG. 25.

FIG. 26 is an exploded perspective view illustrating a feed section in a case where a probe converter is used in the radio device illustrated in FIG. 25. In FIG. 26, elements that are functionally the same as those of the radio device illustrated in FIG. 25 will be denoted by the same reference numerals and will not be further described below. Referring to FIG. 26, a probe 87 is provided at one end of a microstrip line 86 extending from the communications circuit 85 (not shown in FIG. 26). A shield wall 88 is attached to the probe 87. By using the probe 87 as a monopole antenna, a TE-mode electromagnetic wave can be propagated through the waveguide. The impedance can be adjusted based on the probe length or the distance between the shield wall and the feed port. Note that while the shield wall 88 extends beyond the circuit board 84 in FIG. 26, the shield wall 88 may be accommodated within the circuit board 84.

Figure 27:
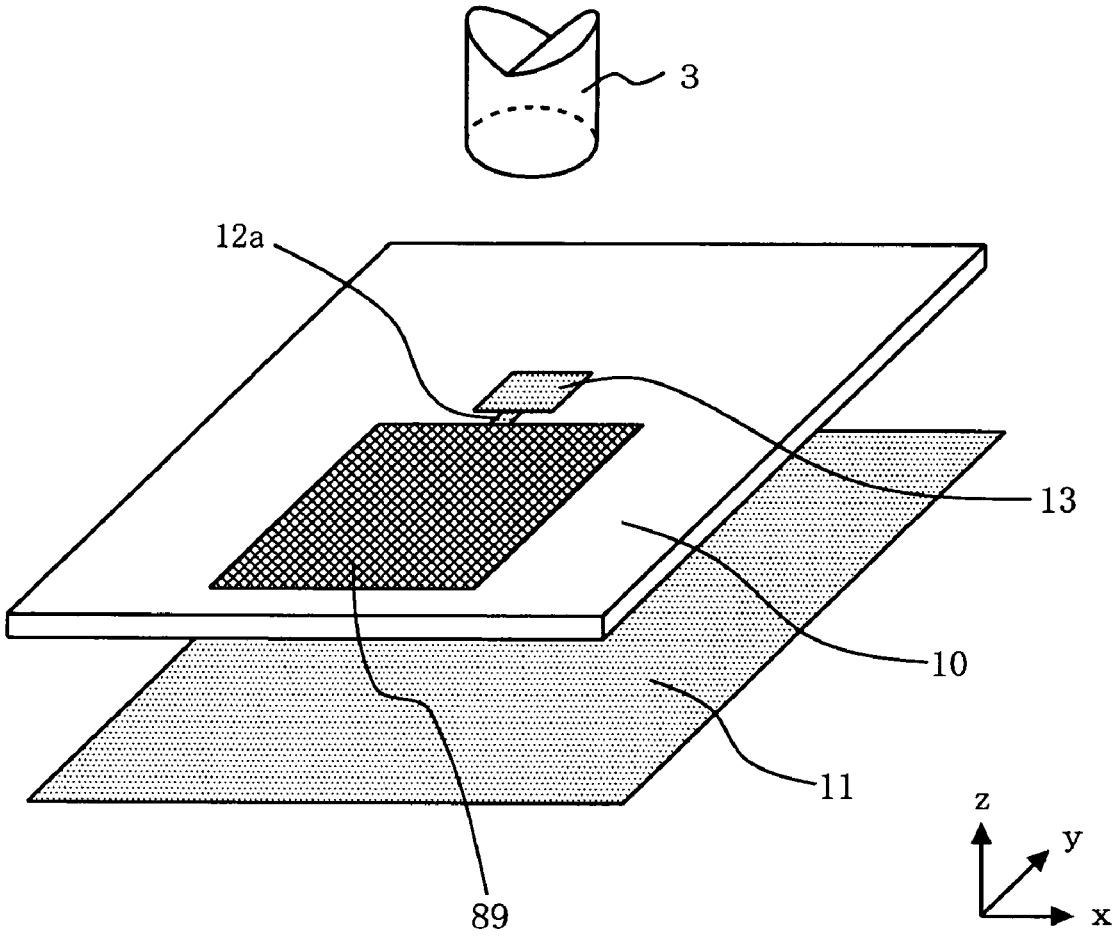
FIG. 27 is an exploded perspective view illustrating a radio device in which an electromagnetic wave is fed by using a strip line.

Note that while an electromagnetic wave is fed by using a waveguide in the embodiment above, a strip line may alternatively be used. FIG. 27 is an exploded perspective view illustrating a radio device in which an electromagnetic wave is fed by using a strip line. In FIG. 27, elements that are functionally the same as those of the dielectric antenna illustrated in FIG. 6 will be denoted by the same reference numerals and will not be further described below. Referring to FIG. 27, an electromagnetic wave from a communications circuit 89 is fed to, and radiated from the loading dielectric block 3, via a strip line 12*a* and the driven patch 13.

Note that while the embodiment above is directed to an antenna with one loading dielectric, the communications circuit can be integrally connected to the antenna also with an array antenna including a plurality of loading dielectrics.

Moreover, while a ridge converter or a probe converter is used for the connection between the circuit and the waveguide, the present invention is not limited thereto.

EXAMPLE 1

Referring to FIG. 1, an example of the first embodiment will now be described. In this example, the lower conductor plate 1 is made of aluminum, and has a size of 100 mm×100 mm and a thickness of 3 mm. The upper conductor plate 2 is made of aluminum, and has a size of 100 mm×100 mm and a thickness of 2.5 mm. The size of the waveguide 9 when the lower conductor plate 1 and the upper conductor plate 2 are attached together is 3.76 mm×1.88 mm. The size of the aperture 8 is 2.8 mm×2.8 mm. The loading dielectric block 3 is made of polypropylene (relative dielectric constant: 2.26), the diameter $\phi$ thereof is 6.1 mm along its horizontal cross section, the height L1 thereof is 6.9 mm, and the inclination angle $\alpha$ thereof is 45°. The loading dielectric block 3 is placed so that the slopes are formed in the direction of the electromagnetic field plane as illustrated in FIG. 1 and FIG. 2.

Figure 28:
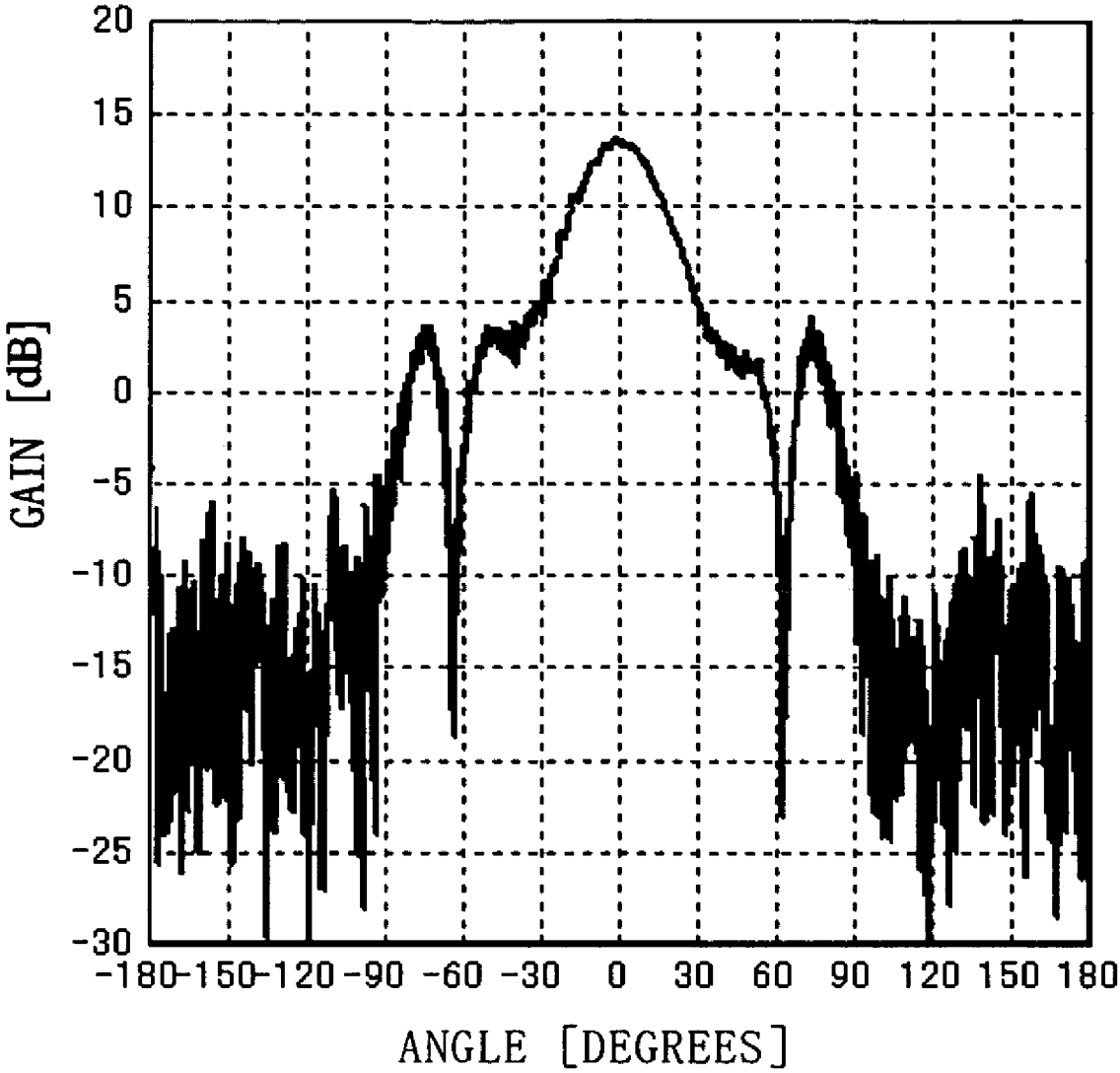
FIG. 28 is a graph showing the radiation pattern along the xz plane for a dielectric antenna of Example 1.

FIG. 28 is a graph showing the radiation pattern along the xz plane for the dielectric antenna of Example 1. Thus, if the upper surface of the loading dielectric block is depressed at the center thereof so that its height gradually increases toward the side surface thereof, it is possible to realize a high gain over a wide range of about ±60 degrees. Therefore, the dielectric antenna of the first embodiment has a high gain and a large primary beam width.

EXAMPLE 2

Referring to FIG. 9 and FIG. 10, an example of the second embodiment will now be described. In this example, the material and the shape of the lower conductor plate, the upper conductor plate, the waveguide and the aperture are similar to those of Example 1. The loading dielectric block 3*b* is made of polypropylene (relative dielectric constant: 2.26), the diameter $\phi$ thereof is 8.1 mm along its horizontal cross section, the width $\phi$1 of the flat portion of the upper surface is 2.0 mm, the height L thereof is 6.9 mm, and the inclination angle $\alpha$ thereof is 45°. The loading dielectric block is placed over the aperture 8 so as to be aligned with the center of the aperture 8 and so that the vertical cross section thereof illustrated in FIG. 10 is along the xz plane.

Figure 29:
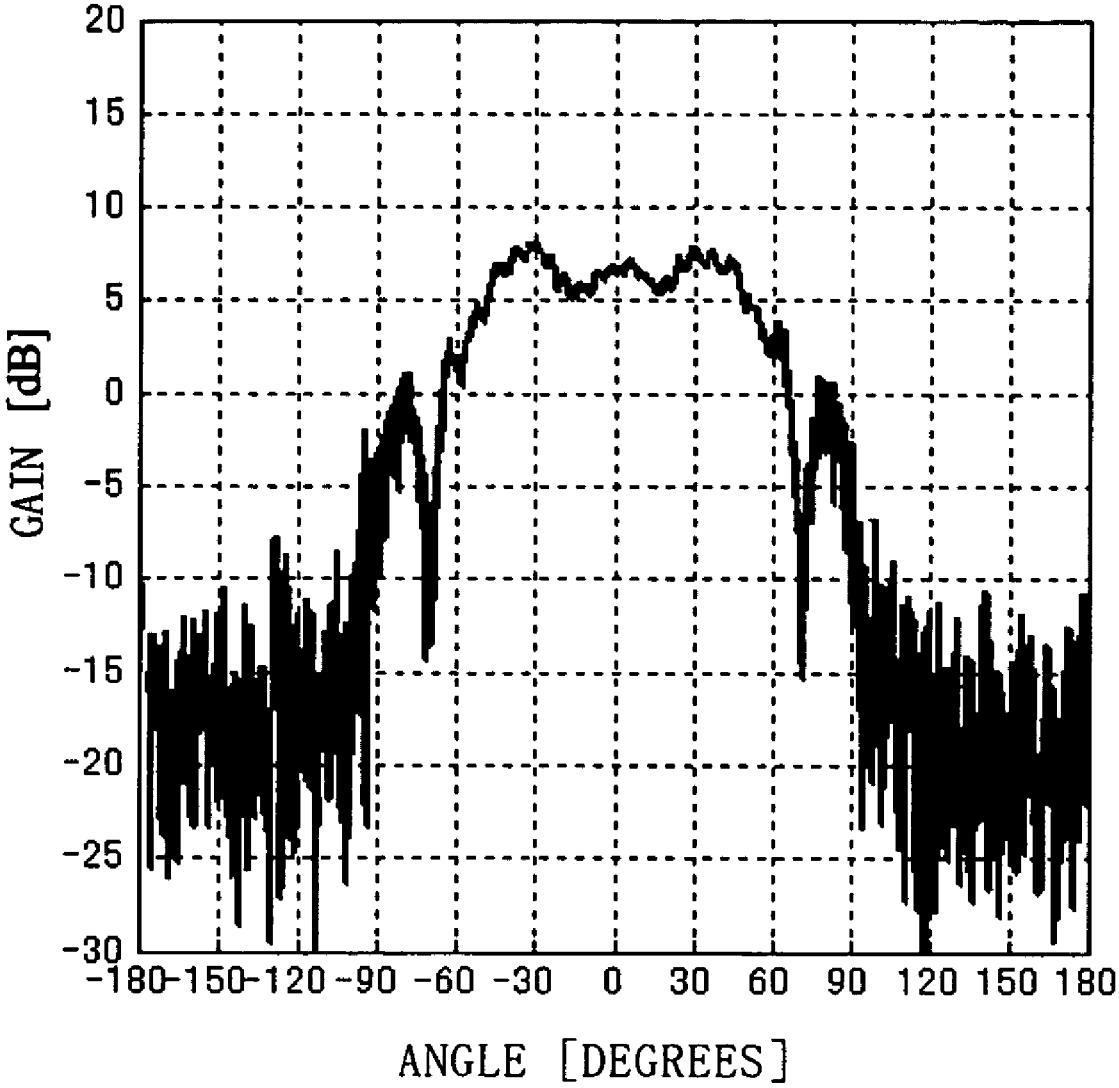
FIG. 29 is a graph showing the radiation pattern along the xz plane for a dielectric antenna of Example 2.

FIG. 29 is a graph showing the radiation pattern along the xz plane for the dielectric antenna of Example 2. Thus, if the upper surface of the loading dielectric is depressed to form a flat portion parallel to the bottom surface thereof and slopes where the height of the block gradually increases toward the side surface thereof, it is possible to realize a high gain over a wide range of about ±60 degrees. Therefore, the dielectric antenna of the second embodiment has a high gain and a large primary beam width. Moreover, as can be seen from the comparison between FIG. 28 showing the radiation pattern of Example 1 and FIG. 29 showing that of Example 2, the dielectric antenna of the second embodiment has an improved sector directivity.

EXAMPLE 3

Referring to FIG. 12 and FIG. 13, an example of the third embodiment will now be described. In this example, the material and the shape of the lower conductor plate, the upper conductor plate, the waveguide and the aperture are similar to those of Example 1. The loading dielectric block 3*d* is made of polypropylene (relative dielectric constant: 2.26), the diameter $\phi$ thereof is 8.6 mm along its horizontal cross section, the width $\phi$1 of the flat portion of the upper surface is 2.5 mm, the height L thereof is 6.9 mm, and the inclination angle $\alpha$ thereof is 45°.

Figure 30:
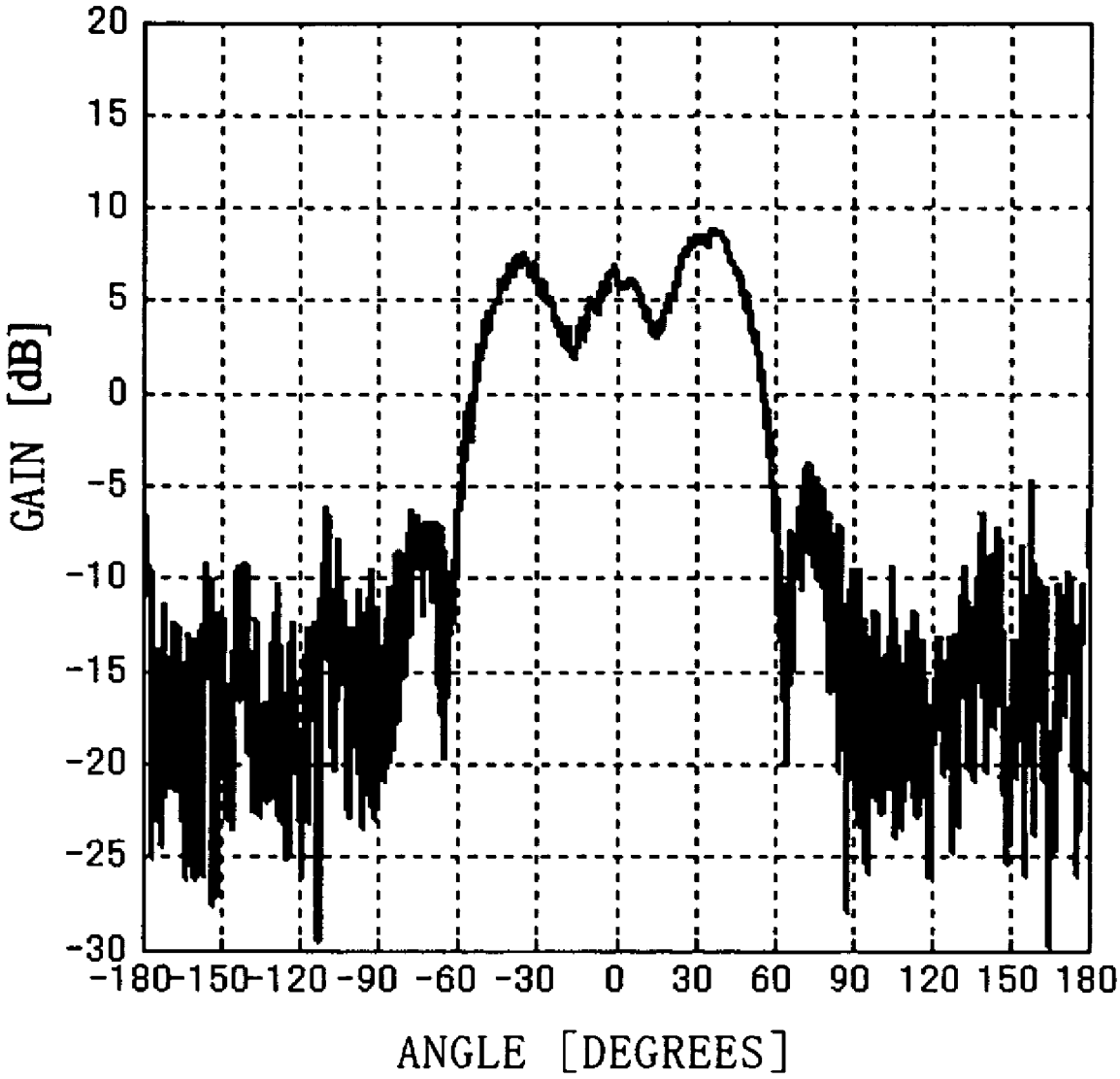
FIG. 30 is a graph showing the radiation pattern along the yz plane (magnetic field plane) for a dielectric antenna of Example 3.
Figure 31:
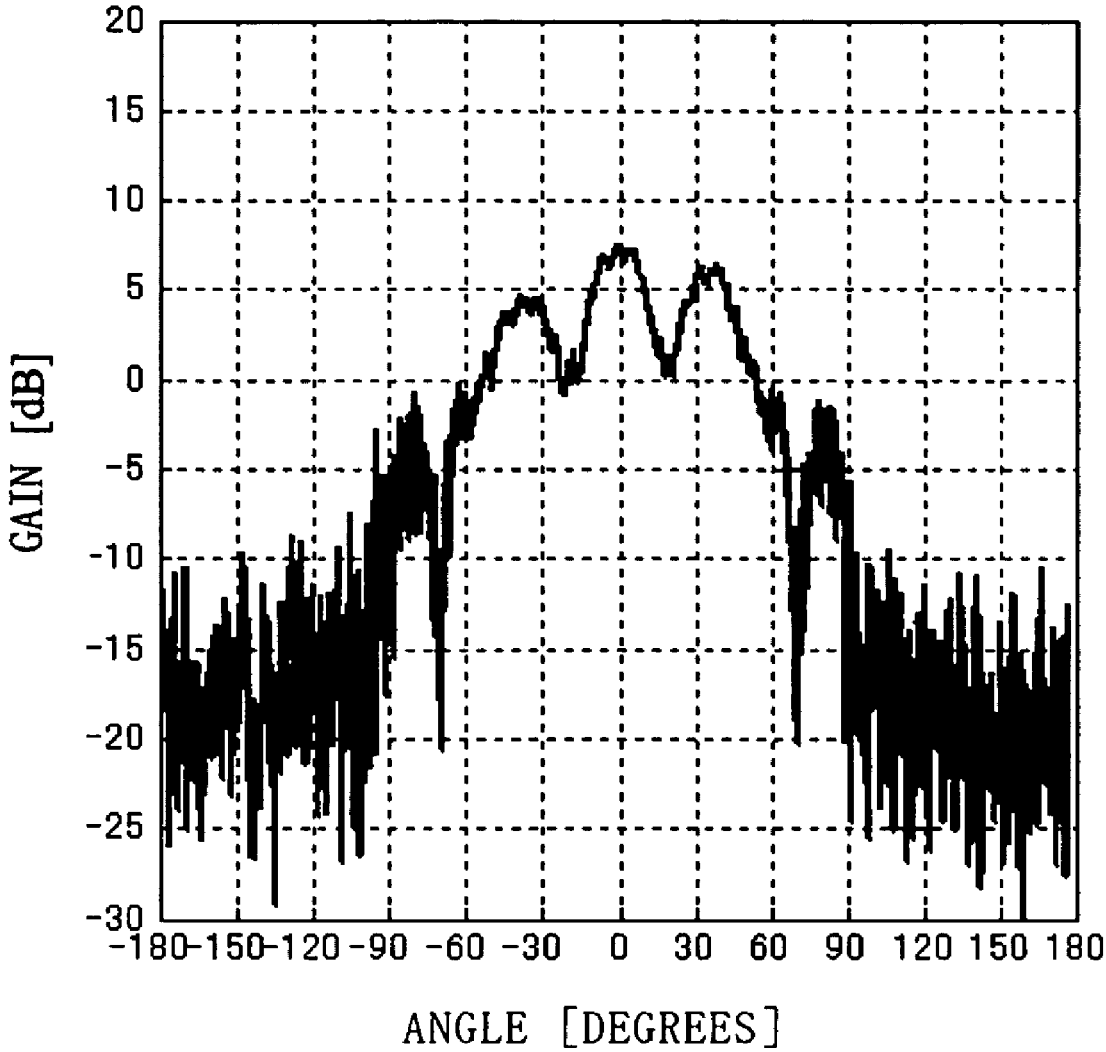
FIG. 31 is a graph showing the radiation pattern along the xz plane (electric field plane) for the dielectric antenna of Example 3.

FIG. 30 is a graph showing the radiation pattern along the yz plane (magnetic field plane) for the dielectric antenna of Example 3. FIG. 31 is a graph showing the radiation pattern along the xz plane (electric field plane) for the dielectric antenna of Example 3. Referring to FIG. 30 and FIG. 31, if the loading dielectric has a bowl-shaped upper portion, it is possible to realize a high gain over a wide range of about ±60 degrees both in the electric field plane and in the magnetic field plane. Therefore, the dielectric antenna of the third embodiment has a high gain and a large beam width.

Note however that ripples, occur in the electric field plane as mentioned in the third embodiment. The ripples can be eliminated by using an elliptic cylinder-shaped loading dielectric as illustrated in FIG. 14.

Eighth Embodiment

Figure 32:
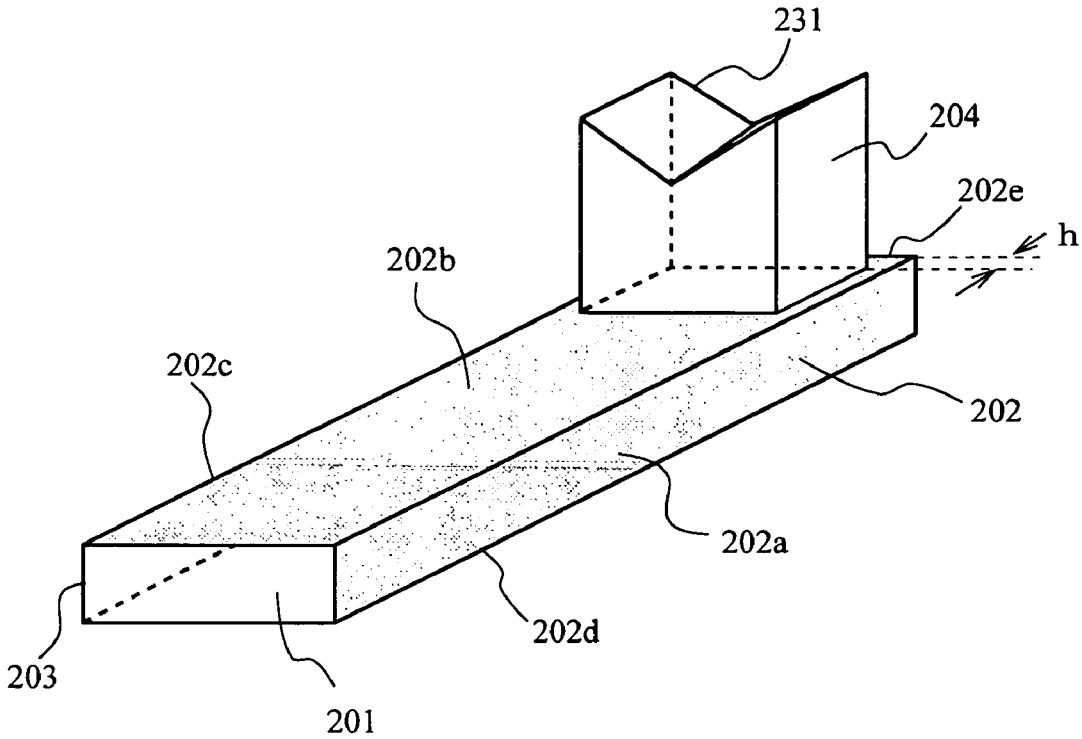
FIG. 32 is a perspective view illustrating a dielectric antenna according to an eighth embodiment of the present invention.
Figure 33:
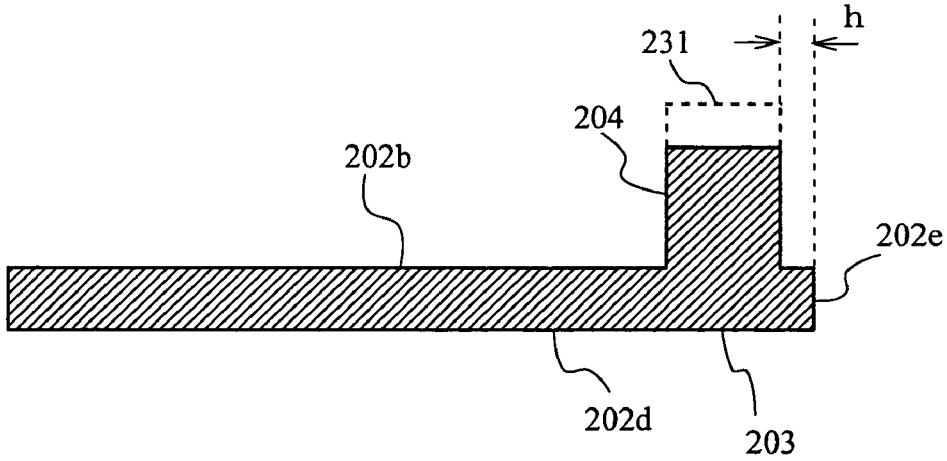
FIG. 33 is a cross-sectional view illustrating the dielectric antenna of the eighth embodiment.

FIG. 32 is a perspective view illustrating a dielectric antenna according to the eighth embodiment of the present invention. FIG. 33 is a cross-sectional view illustrating the dielectric antenna of the eighth embodiment. Referring to FIG. 32 and FIG. 33, the dielectric antenna includes a dielectric block 203, and a conductor-plated section 202 obtained by plating a predetermined surface portion of the dielectric block 203 with a conductor. The dielectric block 203 includes a feed port 201 and a dielectric protrusion 204. The feed port 201 is a front surface portion of the dielectric block 203 that is not plated with a conductor. The dielectric protrusion 204 is a rectangular parallelepiped portion protruding upward from the upper surface of the dielectric block 203, and the surface thereof is not conductor-plated.

The dielectric protrusion 204 is formed as an integral member with the dielectric block 203. Therefore, as illustrated in the cross-sectional view of FIG. 33, the bottom surface of the dielectric protrusion 204 is not conductor-plated. A notch 231 is formed in an upper portion of the dielectric protrusion 204. The vertical cross section of the notch 231 is V-shaped. The notch 231 is similar to the notch 31 of the first embodiment except that it is in a quadratic prism shape.

A method for manufacturing the dielectric antenna of the present embodiment will now be described. First, the manufacturer pours a dielectric into a mold for forming the dielectric block 203 with the dielectric protrusion 204, thus obtaining the dielectric block 203. Alternatively, the manufacturer may cut a block of dielectric into the dielectric block 203 with the dielectric protrusion 204.

Then, the manufacturer plates the entire dielectric antenna except for the feed port 201 and the dielectric protrusion 204 (i.e., a right side surface 202*a*, an upper surface 202*b*, a left side surface 202*c*, a bottom surface 202*d* and a rear surface 202*e*) with a conductor. Thus, the conductor-plated section 202 is formed. The dielectric antenna of the present embodiment is manufactured as described above.

In the dielectric antenna, the dielectric surrounded by the conductor-plated section 202 forms a dielectric waveguide. Moreover, since the dielectric protrusion 204 is not conductor-plated, the dielectric protrusion 204 serves as the radiating section of the antenna. The feed port 201 is a port through which a signal electromagnetic wave is fed to the waveguide.

In the dielectric antenna as described above, a signal electromagnetic wave inputted to the feed port 201 is guided through the inside of the dielectric waveguide formed by the conductor-plated section 202 and the dielectric block 203, and is radiated from the dielectric protrusion 204.

Since the dielectric block 203, excluding the dielectric protrusion 204, functions as a feed waveguide, the width and the height of the dielectric block 203 are equal to those of the waveguide. Therefore, it is possible to control the blocking frequency of the waveguide by adjusting the width and/or height of the dielectric block 203. An electromagnetic wave whose frequency is higher than the blocking frequency is transmitted through the waveguide without being attenuated so as to be radiated from the dielectric protrusion 204.

The dielectric protrusion 204 is provided at a distance of h from the rear surface 202*e* of the dielectric block 203. The impedance matching between the dielectric waveguide section and the radiating protrusion can be achieved by adjusting the distance h. Thus, it is possible to eliminate the influence of the electromagnetic wave reflection. Note that the distance h can be obtained experimentally. The distance h is about ¼ the wavelength of the signal electromagnetic wave.

Thus, the dielectric antenna of the eighth embodiment includes a waveguide formed by plating a dielectric block with a conductor, a radiating protrusion for radiating a radio wave formed by a non-plated portion, and a feed port formed by a non-plated portion. Since the waveguide is made of a dielectric, the dielectric antenna of the present embodiment is smaller than a conventional dielectric antenna. Moreover, since the waveguide is formed by plating a dielectric block with a conductor, the dielectric antenna of the present embodiment can be manufactured more easily and at a lower cost than a conventional dielectric antenna. In addition, the notch 231 is provided in an upper portion of the dielectric protrusion 204 as in the first embodiment, whereby the dielectric antenna of the present embodiment has a high gain and a large primary beam width.

Note that the gain of the dielectric antenna can be adjusted based on the base area and the height of the dielectric protrusion 204. The size of the waveguide section is substantially uniquely dictated by the wavelength of the electromagnetic wave to be guided therethrough. Therefore, if the dielectric protrusion 204 is shaped so as to realize a high gain, the dielectric protrusion may become larger than the waveguide section. Therefore, the dielectric antenna of the present embodiment is not limited to a dielectric antenna in which the dielectric protrusion 204 is smaller than the waveguide section as illustrated in FIG. 32.

Note that the dielectric antenna can be made smaller by increasing the relative dielectric constant of the dielectric block.

Note that a method other than plating may be used as long as the dielectric block is covered with a conductor.

Figure 34:
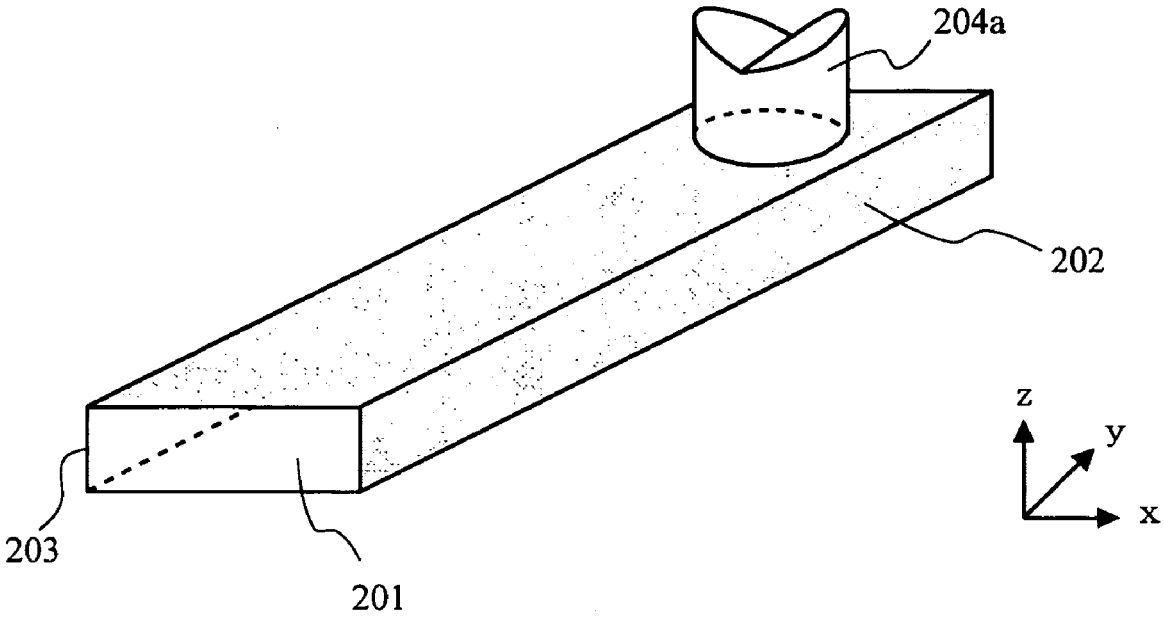
FIG. 34 is a perspective view illustrating a cylindrical protrusion type dielectric antenna.

Note that an example where the dielectric protrusion 204 has a rectangular parallelepiped shape is illustrated in the embodiment above, the shape of the dielectric protrusion is not limited thereto, but may be any other suitable shape similar to the shape of the loading dielectric of the first embodiment, e.g., a cylindrical shape, an elliptic cylinder shape, a polygonal prism shape, etc. FIG. 34 is a perspective view illustrating a cylindrical protrusion type dielectric antenna. A cylindrical dielectric section 204*a* may be used as the dielectric protrusion as illustrated in FIG. 34. Alternatively, the dielectric protrusion may have an elliptic cylinder shape. In other words, the shape of the horizontal cross section of the dielectric protrusion may be a polygonal shape such as a rectangular shape, a circular shape or an elliptical shape. The directivity and the gain vary depending on the shape of the dielectric protrusion. The directivity is improved if a dielectric protrusion has a large cross-sectional area. The gain is improved if the area of the junction between the dielectric protrusion and the waveguide section is large. The directivity is improved if the dielectric protrusion is cylindrical. The directivity in the major axis direction is improved if the dielectric protrusion has an elliptic cylinder shape. The gain is improved if the dielectric protrusion has a rectangular parallelepiped shape.

Figure 35:
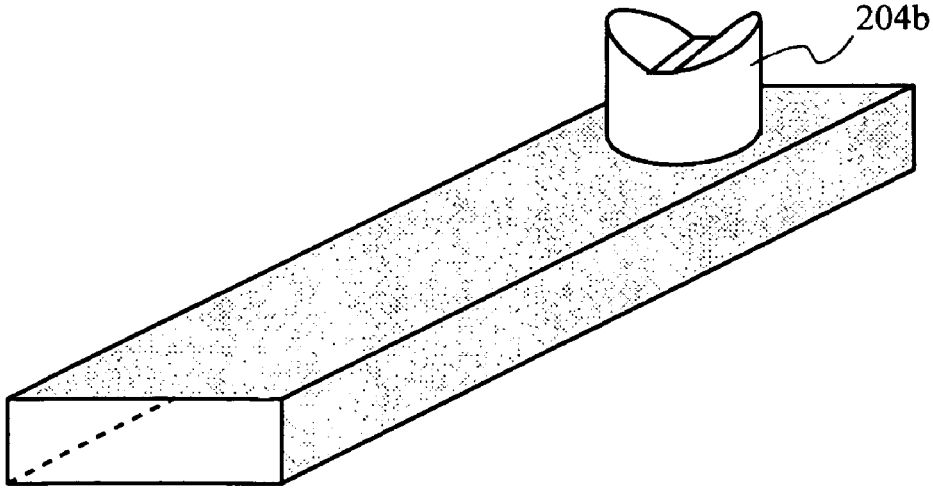
FIG. 35 is a perspective view illustrating a dielectric antenna using a cylindrical dielectric protrusion 204*b* whose upper portion is a depressed portion with a flat surface portion.
Figure 36:
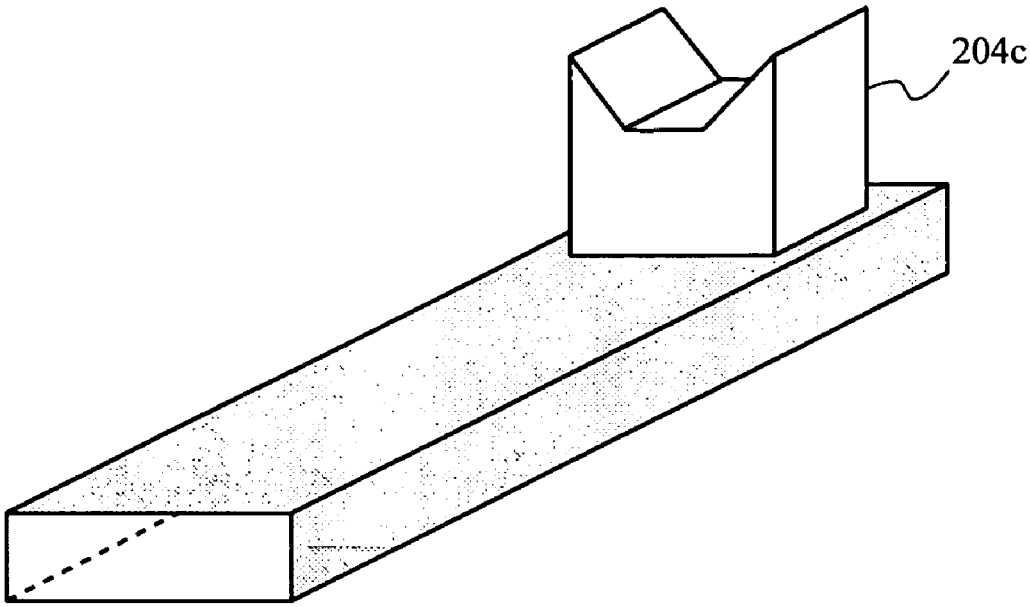
FIG. 36 is a perspective view illustrating a dielectric antenna using a dielectric protrusion 204*c* having a quadratic prism shape whose upper portion is a depressed portion with a flat surface portion.
Figure 37:
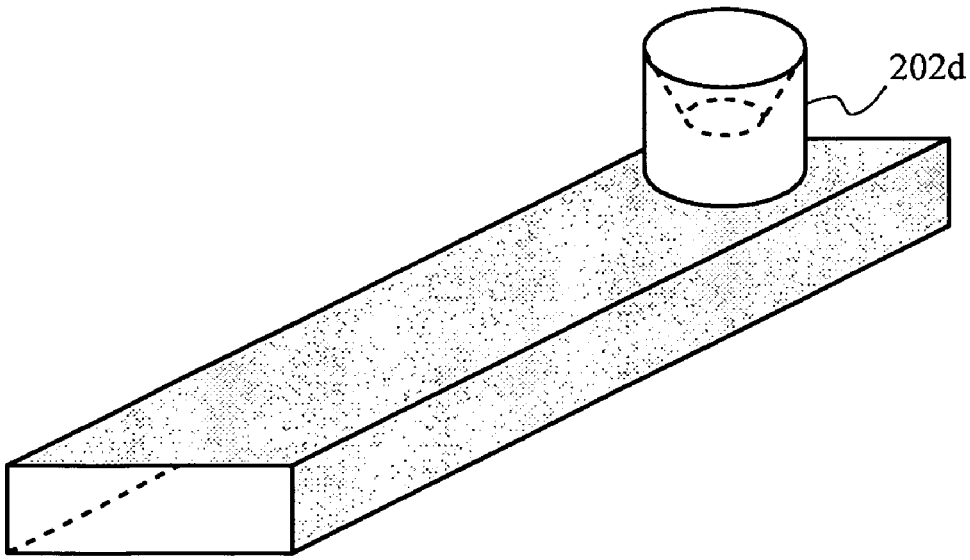
FIG. 37 is a perspective view illustrating a dielectric antenna using a cylindrical dielectric protrusion 204*d* whose upper portion is a bowl-shaped depressed portion.
Figure 38:
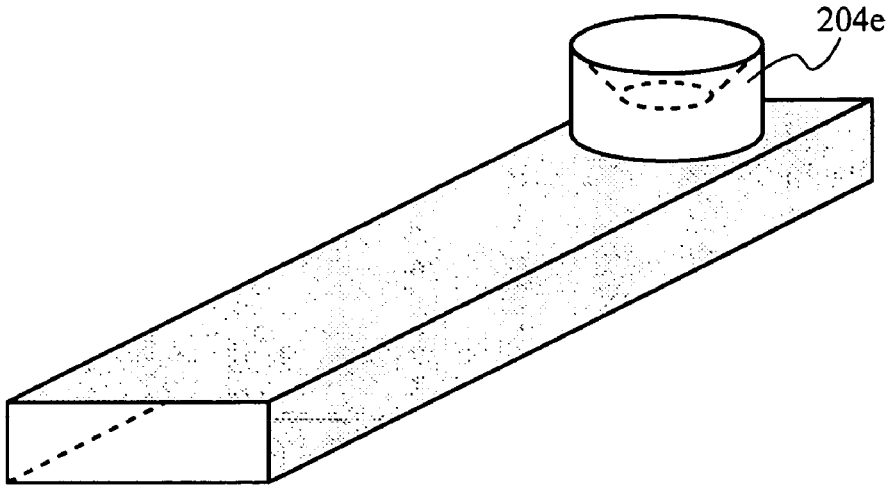
FIG. 38 is a perspective view illustrating a dielectric antenna using an elliptic cylinder-shaped dielectric protrusion 204*e* whose upper portion is a bowl-shaped depressed portion.

Alternatively, the dielectric protrusion may have a shape similar to the loading dielectric shapes shown in the second and third embodiments. Thus, effects similar to those of the second and third embodiments can be obtained. FIG. 35 is a perspective view illustrating a dielectric antenna using a cylindrical dielectric protrusion 204*b* whose upper portion is a depressed portion with a flat surface portion. FIG. 36 is a perspective view illustrating a dielectric antenna using a dielectric protrusion 204*c* having a quadratic prism shape whose upper portion is a depressed portion with a flat surface portion. FIG. 37 is a perspective view illustrating a dielectric antenna using a cylindrical dielectric protrusion 204*d* whose upper portion is a bowl-shaped depressed portion. FIG. 38 is a perspective view illustrating a dielectric antenna using an elliptic cylinder-shaped dielectric protrusion 204*e* whose upper portion is a bowl-shaped depressed portion.

Note that while the dielectric block 203, excluding the dielectric protrusion 204, has a rectangular parallelepiped shape in the embodiment above, it may alternatively have a cylindrical shape, an elliptic cylinder shape or a polygonal prism shape.

Note that while the feed port has a rectangular shape in the embodiment above, it may have any other suitable shape.

Figure 39:
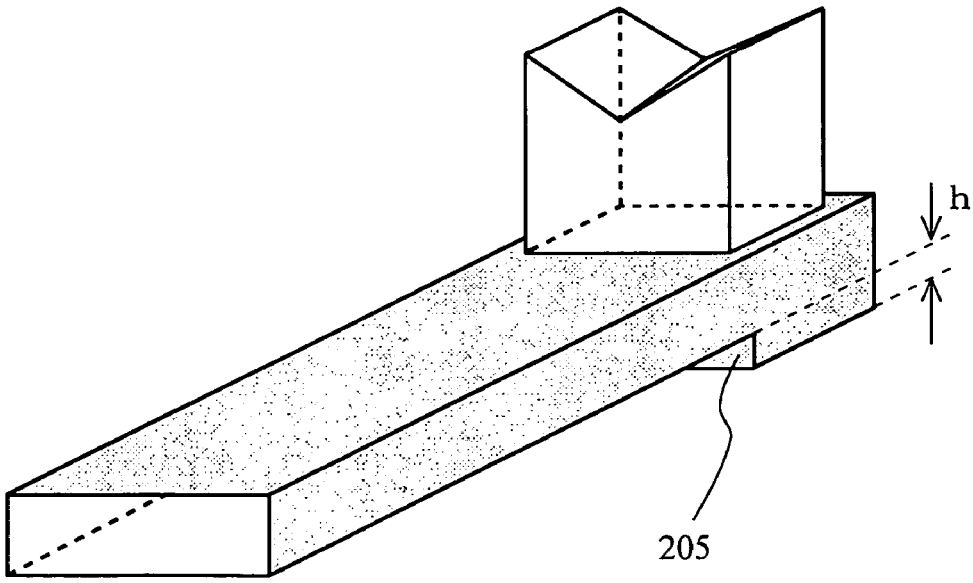
FIG. 39 is a perspective view illustrating a dielectric antenna having a back short.

Note that while the dielectric protrusion is provided at a predetermined distance inward from the rear surface of the dielectric block so that impedance matching is achieved in the embodiment above, the position of the dielectric protrusion is not limited thereto. For example, the rear surface of the dielectric protrusion and that of the dielectric block may be flush with each other, with a back short provided under the dielectric protrusion. FIG. 39 is a perspective view illustrating a dielectric antenna having a back short. Referring to FIG. 39, an impedance-matching protrusion 205 may be provided on the bottom surface of the dielectric block so as to protrude downward by the distance h, while plating the impedance-matching protrusion 205 with a conductor, thus forming a back short, whereby impedance matching is achieved. Thus, it is possible to eliminate the influence of the electromagnetic wave reflection. Note that a portion protruding backward by the distance h from the rear surface of the dielectric protrusion 204 as illustrated in FIG. 32 and FIG. 33 can also be considered as an impedance-matching protrusion.

Figure 40:
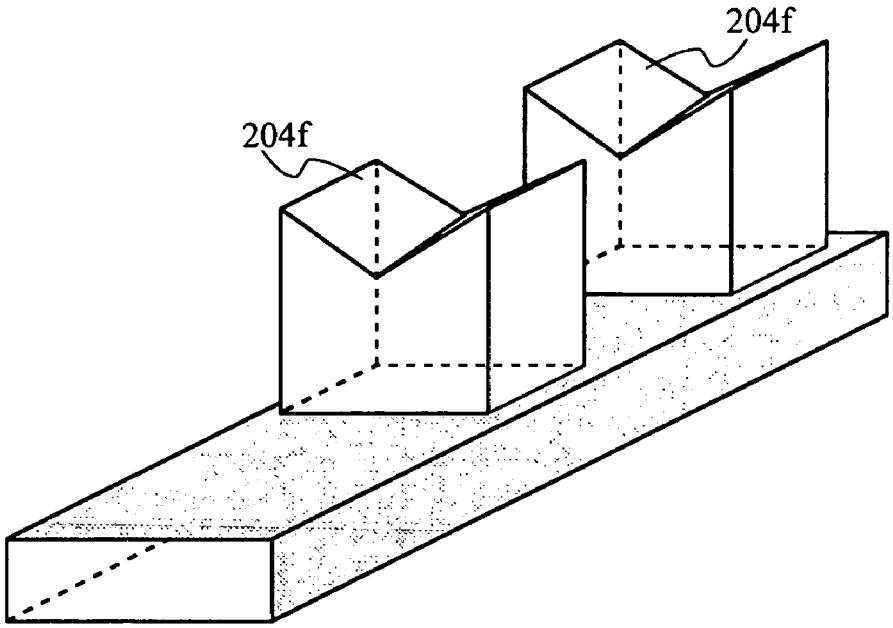
FIG. 40 is a perspective view illustrating a dielectric antenna having a plurality of dielectric protrusions 204*f;*

Note that while only one dielectric protrusion is provided in the embodiment above, a plurality of dielectric protrusions may be provided to form an array antenna. FIG. 40 is a perspective view illustrating a dielectric antenna having a plurality of dielectric protrusions 204*f*. It is possible to provide a dielectric array antenna having an even higher gain by providing a plurality of dielectric protrusions 204*f* as illustrated in FIG. 40 and appropriately adjusting the position and the size of the dielectric protrusions 204*f*. Note that while FIG. 40 shows an example with two rectangular dielectric protrusions, the number and shape of the dielectric protrusions are not limited thereto. Moreover, it is only required in the present invention that at least one of the dielectric protrusions 204*f* has a depressed portion in an upper portion thereof.

Ninth Embodiment

Figure 41:
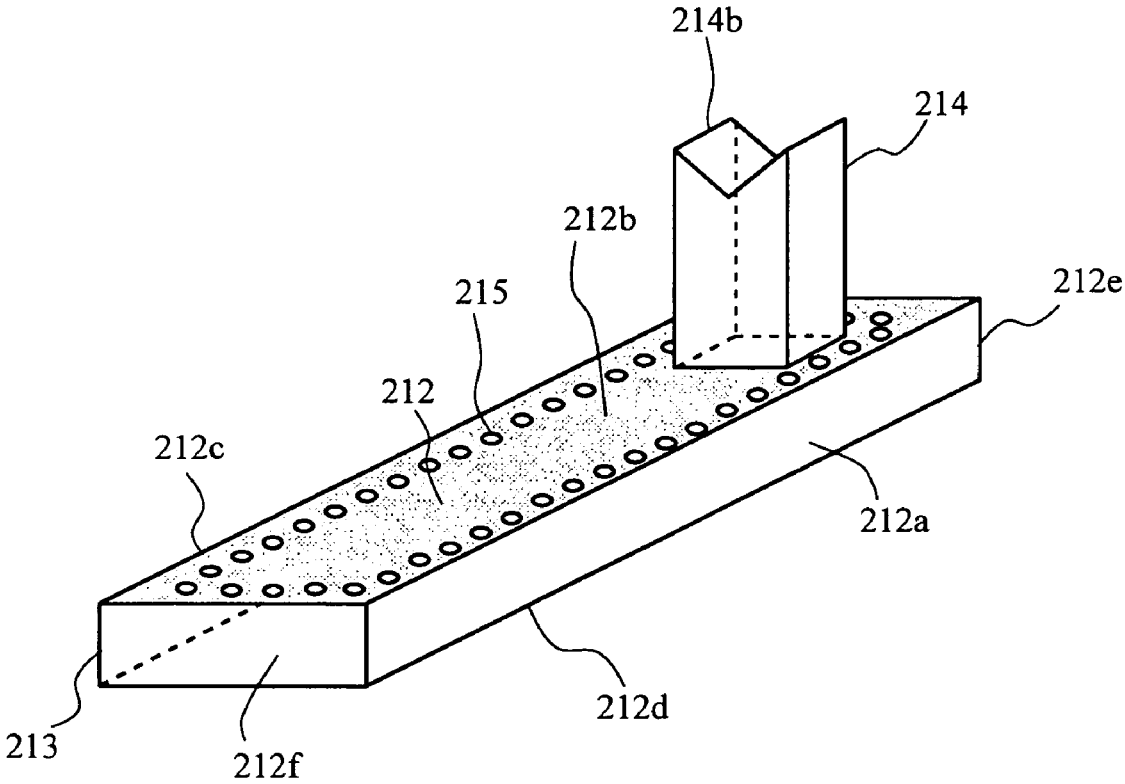
FIG. 41 is a perspective view illustrating a dielectric antenna according to a ninth embodiment of the present invention.
Figure 42:
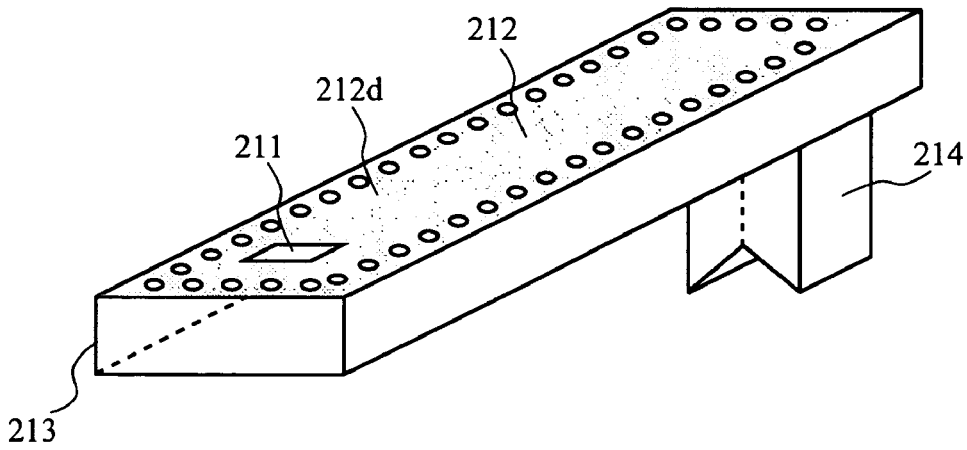
FIG. 42 is a perspective view illustrating the dielectric antenna of FIG. 41 as viewed from the bottom surface thereof.

FIG. 41 is a perspective view illustrating a dielectric antenna according to the ninth embodiment of the present invention. FIG. 42 is a perspective view illustrating the dielectric antenna of FIG. 41 as viewed from the bottom surface thereof. Referring to FIG. 41 and FIG. 42, the dielectric antenna includes a dielectric block 213, and a conductor-plated section 212 obtained by plating a predetermined surface portion of the dielectric block 213 with a conductor. The dielectric block 213 includes a feed port 211, a dielectric protrusion 214 and a plurality of through holes (also called "via holes") 215. The feed port 211 is a portion of a bottom surface 212*d* of the dielectric block 213 that is not plated with a conductor. The dielectric protrusion 214 is a rectangular parallelepiped portion protruding from the upper surface of the dielectric block 213, and the surface thereof is not plated with a conductor. A notch 214*b* is formed in an upper portion of the dielectric protrusion 214. As in the eighth embodiment, the shape of the dielectric protrusion 214 is not limited to that shown in FIG. 41 and FIG. 42, but may be any of various shapes illustrated in the first to third embodiments. The inner wall of each through hole 215 is plated with a conductor. Since the dielectric protrusion 214 is a portion of the dielectric block 213, the bottom surface of the dielectric protrusion 214 is not plated with a conductor as in the first embodiment.

A method for manufacturing the dielectric antenna of the present embodiment will now be described. First, the manufacturer forms the dielectric block 213 having the dielectric protrusion 214 as in the first embodiment.

Then, the manufacturer makes the through holes 215 passing from an upper surface 212*b* of the dielectric block 213, on which the dielectric protrusion 214 is formed, to the bottom surface 212*d* opposing the upper surface 212*b*, by using a drill, or the like. Note that the dielectric block 213 with the through holes 215 formed therein can be obtained by pouring a dielectric into a mold such that the through holes 215 are formed.

Then, the manufacturer plates the dielectric block 213 with a conductor so that it is covered with the conductor except for the feed port 211, the dielectric protrusion 214, a right side surface 212*a*, a left side surface 212*c*, a rear surface 212*e* and a front surface 212*f*. Thus, the conductor-plated section 212 is formed. This process is performed by the manufacturer so that the inner wall of each through hole 215 is plated with a conductor. The dielectric antenna of the present embodiment is manufactured as described above.

The through holes 215 are periodically and evenly arranged in an array with an interval that is less than or equal to ⅕ the wavelength of the electromagnetic wave to be transmitted. Each line of through holes 215 functions as an electric wall. Referring to FIG. 41, two longitudinal through hole lines extend in the direction from the feed port 211 toward the dielectric protrusion 214 so that the dielectric protrusion 214 is interposed therebetween, and two transversal through hole lines extend in the direction from the right side surface 212*a* toward the left side surface 212*c* so that the dielectric protrusion 214 is interposed therebetween, whereby the dielectric protrusion 214 is surrounded by a plurality of through holes. Thus, a portion surrounded by the conductor plating on the upper surface 212*b*, the conductor plating on the bottom surface 212*d* and the four through hole lines functions as a waveguide. The transmission mode and the wavelength of the waveguide are dictated by the width between the two longitudinal through hole lines, the width between the two transversal through hole lines, the diameter of the through holes 215, the pitch of the through holes 215 and the relative dielectric constant of the dielectric. Therefore, a waveguide capable of stable operation is provided by forming two straight through hole lines by periodically arranging a plurality of through holes of the same diameter. Of course, such through hole lines can be designed easily.

The interval between the through hole lines substantially corresponds to the width of the metal waveguide. Therefore, as with a metal wall waveguide, the transmittable wavelength decreases as the interval between the through hole lines is increased. Thus, if the interval between the through hole lines is increased past a certain interval, higher order modes occur. Where the interval between through hole lines is equal to the width of a metal wall waveguide, the metal wall waveguide typically has a greater transmittable wavelength. Therefore, the use of through hole lines is advantageous in that electromagnetic waves of higher frequencies can be transmitted with a smaller device size.

Figure 44:
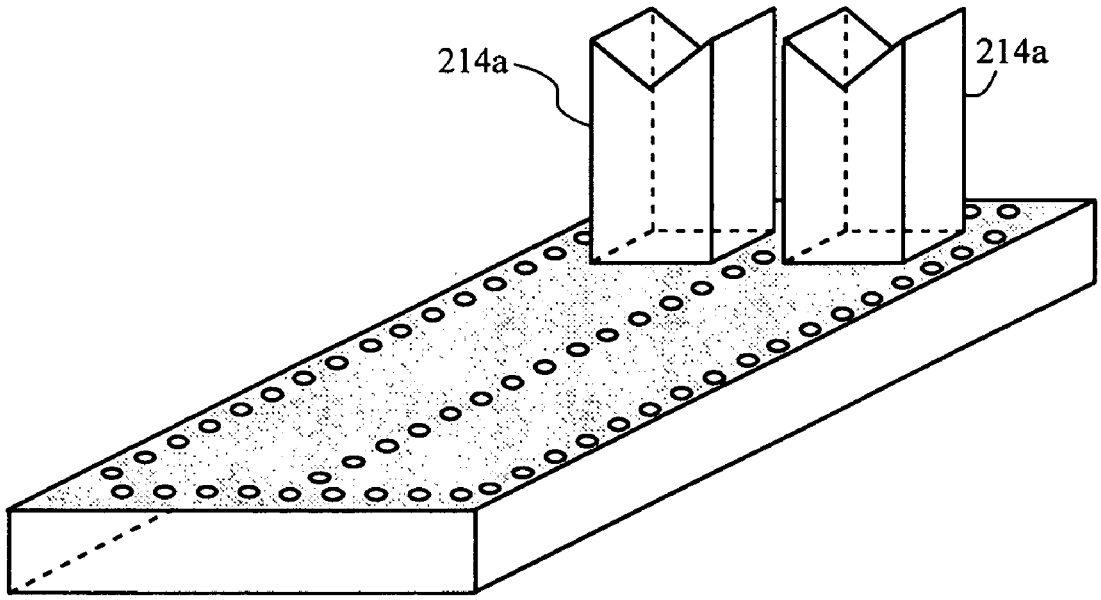
FIG. 44 is a perspective view illustrating a dielectric array antenna having a plurality of dielectric protrusions 214*a;*

Moreover, the wavelength inside the waveguide can be increased by increasing the diameter of the through holes. Furthermore, the wavelength inside the waveguide can be decreased by decreasing the pitch of the through holes. Thus, with such a structure where through holes are periodically arranged, it is possible to improve the design freedom for the wavelength inside the waveguide. Moreover, by using through holes to form waveguides as illustrated in FIG. 44 to be described later, a plurality of waveguides can be arranged together in an array, thus improving the design freedom of the antenna itself.

A signal electromagnetic wave inputted to the feed port 211 is guided through the dielectric waveguide formed by the through holes 215 and is radiated into the air from the dielectric protrusion 214, which is a radiating section.

Thus, in the ninth embodiment, the waveguide is formed by through holes. Where a waveguide is formed by plating a dielectric with a conductor as in the eighth embodiment, the width of the waveguide, hence the width of the dielectric itself, is substantially uniquely dictated by the wavelength of the electromagnetic wave to be guided therethrough. However, with the dielectric antenna of the ninth embodiment, the waveguide is formed by making through holes passing through a dielectric, whereby the width of the dielectric itself to be used in the antenna is not limited. Therefore, it is possible to provide a dielectric antenna with a high design freedom.

Figure 43:
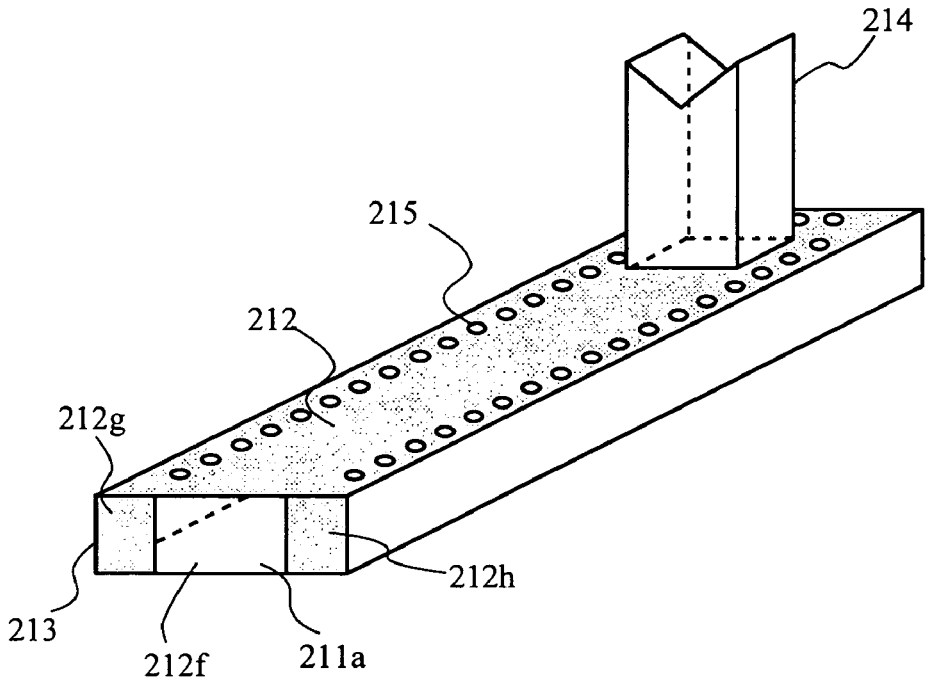
FIG. 43 is a view illustrating an alternative feed port arrangement.

Note that while the feed port for feeding an electromagnetic wave to the waveguide is provided on the bottom surface in the embodiment above, the present invention is not limited thereto. FIG. 43 is a view illustrating an alternative feed port arrangement. In the dielectric antenna of FIG. 43, a transversal through hole line is not formed on the front side of the dielectric block 213. Instead, the front surface 212*f* includes conductor-plated sections 212*g* and 212*h* aligned with the longitudinal through hole lines. Thus, a portion surrounded by the two longitudinal through hole lines, the single transversal through hole line on the rear side and the conductor-plated sections functions as a waveguide. A signal electromagnetic wave inputted to a feed port 211*a* is guided through the waveguide and is radiated into the air from the dielectric protrusion 214, which is a radiating section. Note that the conductor-plated sections 212*g* and 212*h* are provided in order to form an ideal waveguide, and it is possible to form, without the conductor-plated sections 212*g* and 212*h*, a waveguide through which an electromagnetic wave can be fed.

Note that while only one dielectric protrusion is provided in the embodiment above, a plurality of dielectric protrusions may be provided. For example, a plurality of dielectric protrusions may be arranged in a line in the direction of wave propagation, as illustrated in FIG. 40. Alternatively, a plurality of through hole lines may be formed in a dielectric block to obtain an array of dielectric waveguides, each of which is provided with a dielectric protrusion. FIG. 44 is a perspective view illustrating a dielectric array antenna having a plurality of dielectric protrusions 214*a*. Where a waveguide is formed by through holes, it is possible to employ not only an array structure illustrated in FIG. 40 in which dielectric protrusions are arranged in the direction of wave propagation, but also an array structure illustrated in FIG. 44 in which dielectric protrusions are arranged in a direction perpendicular to the direction of wave propagation. Thus, where a waveguide is formed by through holes, it is possible to realize a planar array. While two waveguides are formed by three through hole lines extending in the direction of wave propagation, and two dielectric protrusions are provided in FIG. 44, the number of arrays is not limited to this. Moreover, while at least one dielectric protrusion is provided for each array, the number of dielectric protrusions for each array is not limited to that shown in FIG. 44.

Alternatively, through hole lines may be arranged so as to form branched waveguide.

Tenth Embodiment

Figure 45:
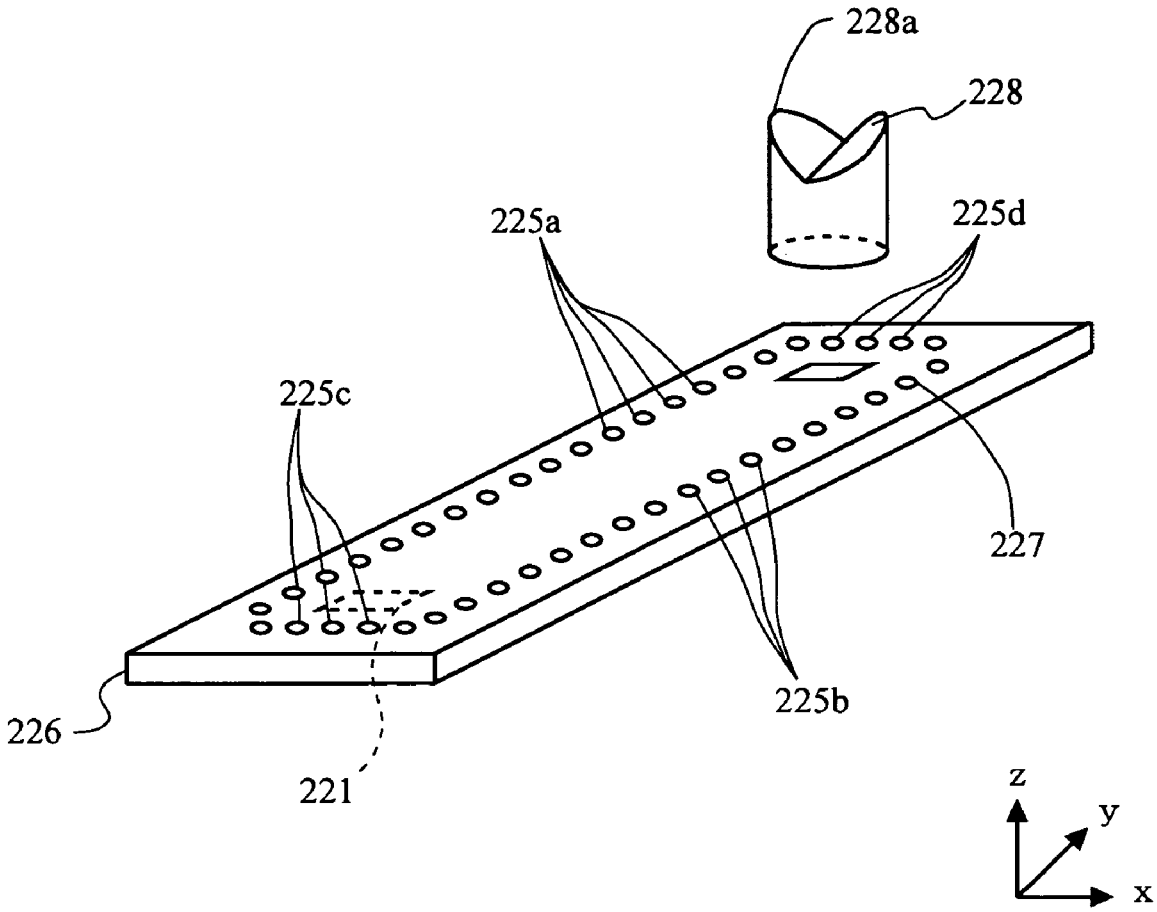
FIG. 45 is an exploded perspective view illustrating a general structure of a dielectric substrate waveguide antenna according to a tenth embodiment of the present invention.
Figure 46:
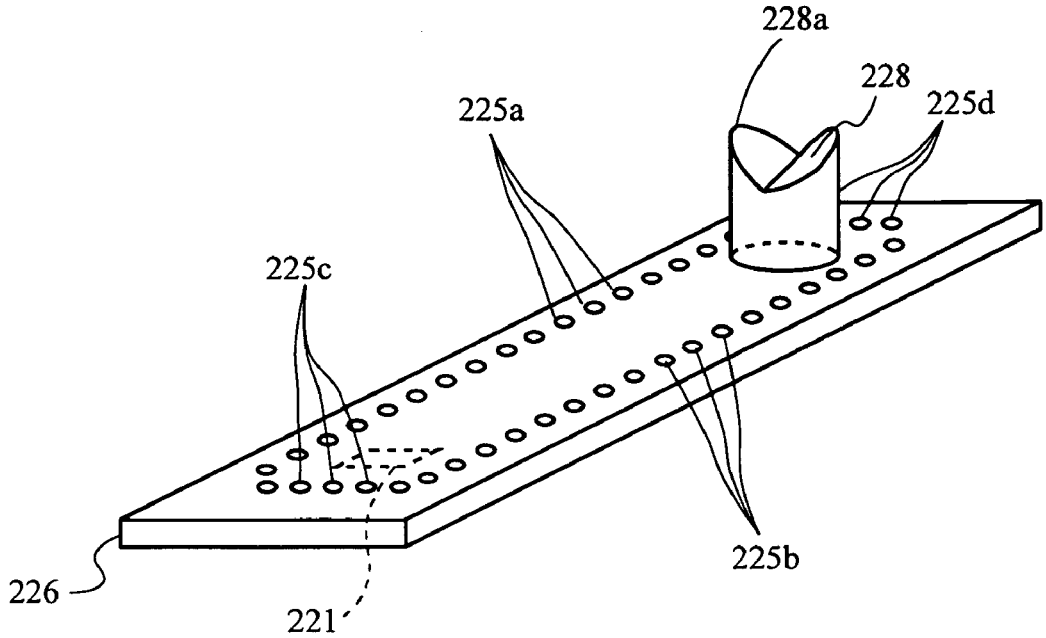
FIG. 46 is a perspective view illustrating a dielectric substrate waveguide antenna loaded with a dielectric block.
Figure 47:
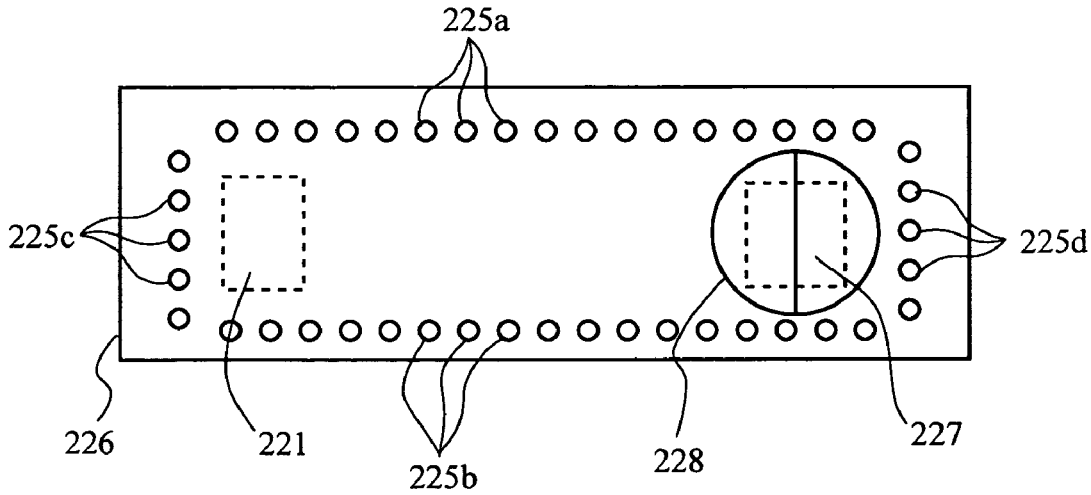
FIG. 47 is a top view illustrating a dielectric substrate waveguide antenna.

FIG. 45 is an exploded perspective view illustrating a general structure of a dielectric substrate waveguide antenna according to the tenth embodiment of the present invention. FIG. 46 is a perspective view illustrating a dielectric substrate waveguide antenna loaded with a dielectric block. FIG. 47 is a top view illustrating a dielectric substrate waveguide antenna. Referring to FIG. 45 to FIG. 47, the dielectric substrate waveguide antenna includes a dielectric substrate 226 both surfaces of which are plated with a conductor, and a loading dielectric block 228. The dielectric substrate 226 includes a feed port 221, a plurality of through holes 225*a* to 225*d* and a slot aperture 227. Note that while not all of the through holes in FIG. 45 to FIG. 47 are provided with reference numerals, each small open circle denotes a through hole in these and subsequent figures. The feed port 221 is a portion of the bottom surface of the dielectric substrate 226 that is not plated with a conductor. The slot aperture 227 is a portion of the upper surface of the dielectric substrate 226 that is not plated with a conductor. The through holes 225*a* to 225*d* are holes each passing through the dielectric substrate 226 and are arranged so as to surround the feed port 221 and the slot aperture 227. The inner wall of each of the through holes 225*a* to 225*d* is plated with a conductor. The loading dielectric block 228 is made of a dielectric and is bonded to the dielectric substrate 226 so as to cover the slot aperture 227. A depressed portion 228*a* is provided in an upper portion of the loading dielectric block 228. As in the eighth embodiment, the shape of the depressed portion 228*a* is not limited to that shown in FIG. 45 and FIG. 46, but may by any of various shapes illustrated in the first to third embodiments.

A method for manufacturing the dielectric substrate waveguide antenna of the present embodiment will now be described. First, the manufacturer makes a plurality of holes passing through a dielectric substrate so that the holes are arranged in a rectangular pattern. Then, the manufacturer plates both surfaces of the substrate having the holes therein with a conductor. Thus, a dielectric substrate with the through holes 225*a* to 225*d* formed therein is obtained. The through holes 225*a* to 225*d* are arranged in lines on the dielectric substrate both surfaces of which are plated with a conductor, thereby forming electric walls. The two lines of electric wall and the conductor-plated upper and lower surfaces together form a dielectric substrate waveguide.

Then, the manufacturer removes a portion of the conductor plating on the bottom surface of the dielectric substrate by etching, or the like, to provide an aperture to be the feed port 221. Similarly, the manufacturer removes a portion of the conductor plating on the upper surface of the dielectric substrate by etching, or the like, to provide an aperture to be the slot aperture 227. In this process, the manufacturer should be careful that the feed port 221 and the slot aperture 227 are formed at some distance from the end portions of the electric wall formed by the through holes 225*a* to 225*d* so that impedance matching is achieved. Thus, the dielectric substrate 226 including the feed port 221, the slot aperture 227 and the through holes 225*a* to 225*d* is manufactured.

Finally, the manufacturer bonds, with an adhesive, or the like, the loading dielectric block 228 onto the dielectric substrate 226 over the slot aperture 227 as illustrated in FIG. 46. Thus, a dielectric substrate waveguide antenna is manufactured.

A signal electromagnetic wave inputted to the feed port 221 is guided through the inside of the waveguide formed by the first through hole lines including the through holes 225*a* and 225*b* and the second through hole lines including the through holes 225*c* and 225*d*, and is excited in the slot aperture 227. By the driving electromagnetic field, the signal electromagnetic wave and the loading dielectric block 228 are electromagnetically coupled with each other. Thus, an electromagnetic field is radiated into the air from the upper surface of the loading dielectric block 228.

In order to realize a high gain with an aperture antenna made by using a substrate, or the like, it is generally necessary to make the drive amplitude and the drive phase as uniform as possible across the aperture surface. With a conventional antenna that does not have a loading dielectric block but only has a slot aperture, the drive amplitude and the drive phase cannot be made uniform across the surface of the slot aperture. Therefore, a conventional antenna only having a slot aperture does not provide a high gain.

In contrast, the dielectric substrate waveguide antenna of the present embodiment is provided with the loading dielectric block 228, whereby the electromagnetic field excited in the slot aperture 227 is guided through the inside of the loading dielectric block 228. Therefore, by appropriately adjusting the surface area and the height of the loading dielectric block 228, the surface wave propagating along the side surface of the loading dielectric block 228 and the electromagnetic wave guided through the inside of the loading dielectric block 228 can be brought in phase with each other at the upper surface of the loading dielectric block 228. Therefore, the phase distribution can be made uniform, whereby it is possible to provide an antenna with a high gain in the forward direction.

Thus, the dielectric substrate waveguide antenna of the present embodiment is small, and has a high gain despite being a single-element antenna. Moreover, since an upper portion of the loading dielectric block 228 includes the depressed portion 228*a* having a vertical cross section which has such a shape that the height of the block gradually increases toward the side surface thereof, it is possible to provide a dielectric waveguide antenna with a large primary beam width as in the first embodiment.

The dielectric substrate of the dielectric substrate waveguide antenna of the present embodiment may be made of a commonly-available material such as Teflon®. Therefore, the dielectric substrate is easy to machine, and the material cost is low.

Figure 48:
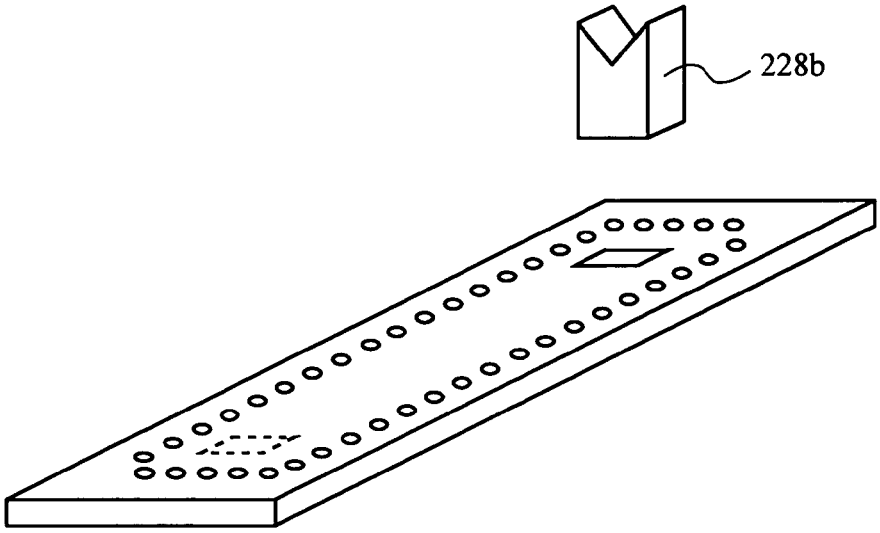
FIG. 48 is a view illustrating a dielectric substrate waveguide antenna using a loading dielectric block 228*b* having a square prism shape.
Figure 49:
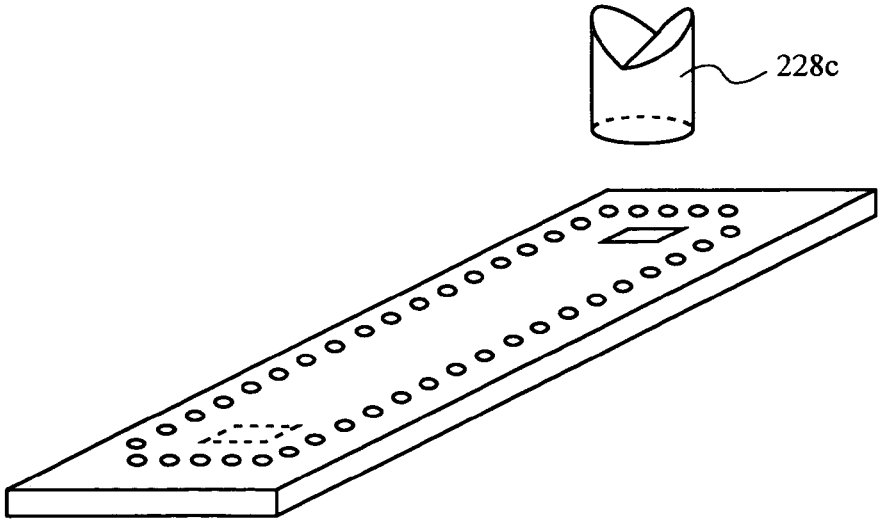
FIG. 49 is a view illustrating a dielectric substrate waveguide antenna using a loading dielectric block 228*c* having an elliptic cylinder shape.

Note that while a cylindrical loading dielectric block is used in the embodiment above, the shape of the loading dielectric block is not limited thereto. FIG. 48 is a view illustrating a dielectric substrate waveguide antenna using a loading dielectric block 228*b* having a square prism shape. FIG. 49 is a view illustrating a dielectric substrate waveguide antenna using a loading dielectric block 228*c* having an elliptic cylinder shape. Thus, the shape of the loading dielectric block is not limited to those illustrated herein as long as the signal electromagnetic wave and the loading dielectric are electromagnetically coupled with each other at the slot aperture.

Figure 50:
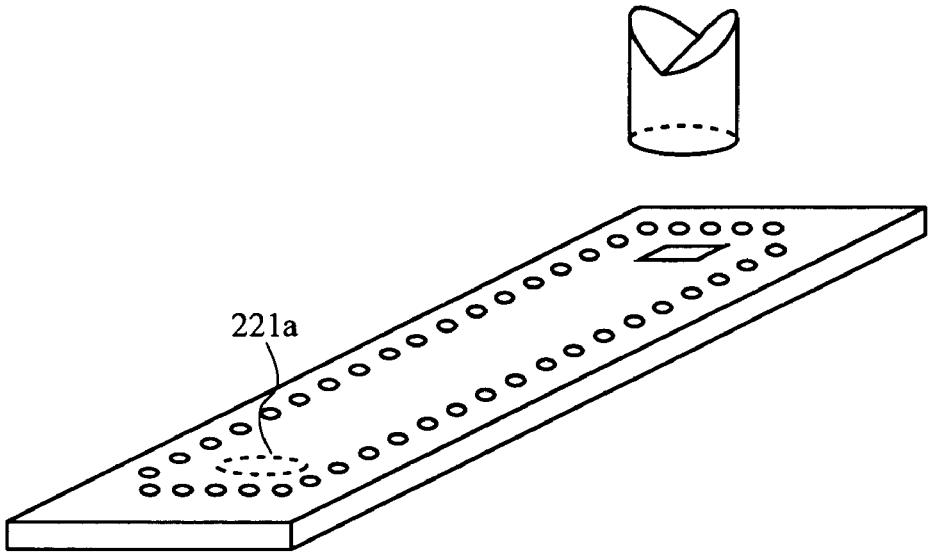
FIG. 50 is a view illustrating a dielectric substrate waveguide antenna using a circular feed port 221*a;*
Figure 51:
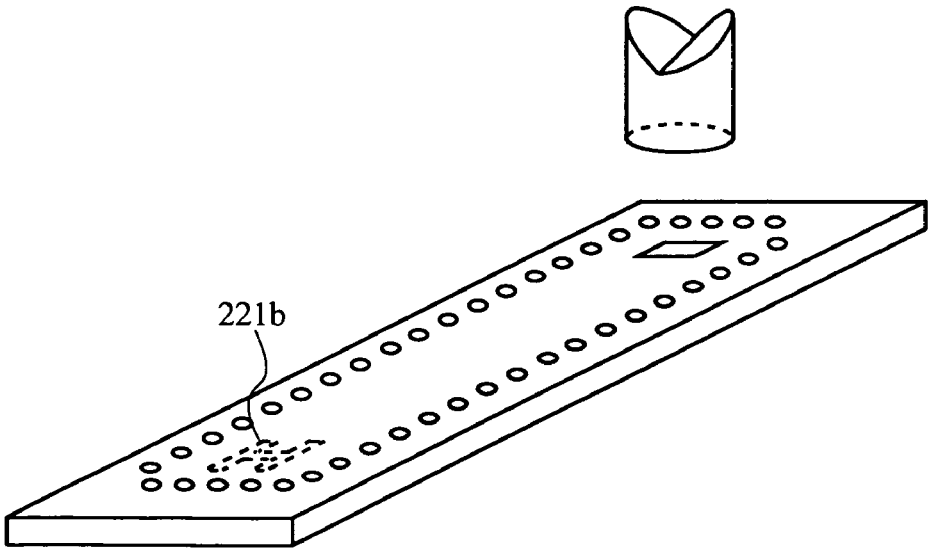
FIG. 51 is a view illustrating a dielectric substrate waveguide antenna using an H-shaped feed port 221*b;*

Note that while the feed port has a rectangular shape in the embodiment above, the shape of the feed port is not limited thereto. FIG. 50 is a view illustrating a dielectric substrate waveguide antenna using a circular feed port 221*a*. FIG. 51 is a view illustrating a dielectric substrate waveguide antenna using an H-shaped feed port 221*b*. Thus, the feed port may have any suitable shape such that the inputted electromagnetic wave is coupled with the waveguide. Particularly with a dielectric substrate waveguide, it may be difficult to provide a feed port of a sufficient size since the interval between electric walls of a dielectric substrate waveguide is small. In such a case, by providing the H-shaped feed port 221*a* as illustrated in FIG. 51, it is possible to obtain a total slot length effectively the same as that of a rectangular feed port, whereby the coupling between the inputted electromagnetic wave and the waveguide can be enhanced. As a result, the antenna can be used in a high frequency range.

Figure 52:
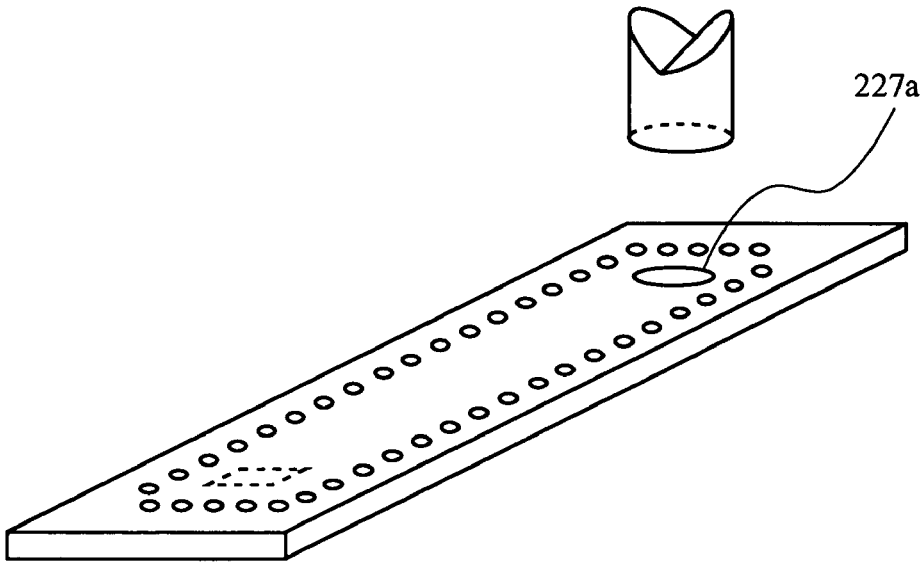
FIG. 52 is a view illustrating a dielectric substrate waveguide antenna using a circular slot aperture 227*a;*
Figure 53:
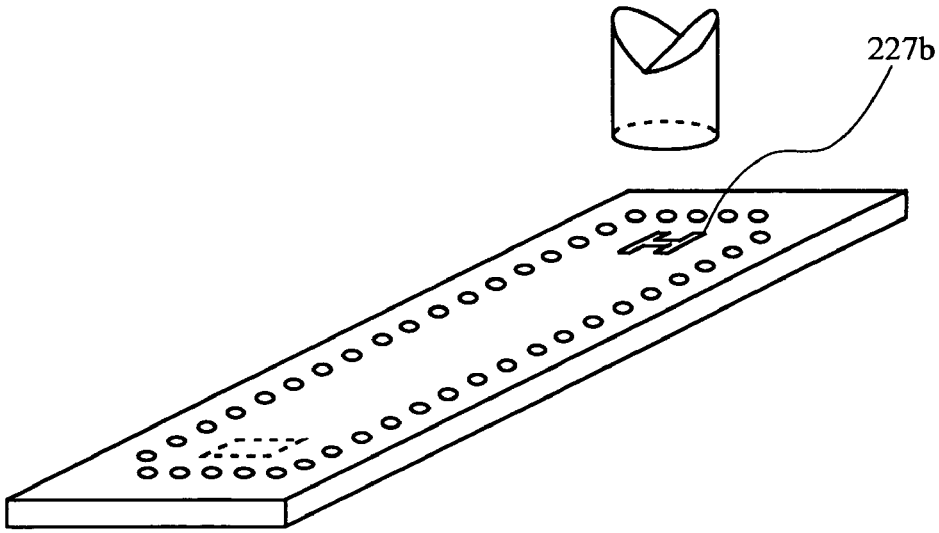
FIG. 53 is a view illustrating a dielectric substrate waveguide antenna using an H-shaped slot aperture 227*b;*

Note that while the slot aperture has a rectangular shape in the embodiment above, the shape of the slot aperture is not limited thereto. FIG. 52 is a view illustrating a dielectric substrate waveguide antenna using a circular slot aperture 227*a*. FIG. 53 is a view illustrating a dielectric substrate waveguide antenna using an H-shaped slot aperture 227*b*. Thus, the shape of the slot aperture is not limited to those illustrated herein as long as the signal electromagnetic wave and the loading dielectric are electromagnetically coupled with each other.

Eleventh Embodiment

Figure 54:
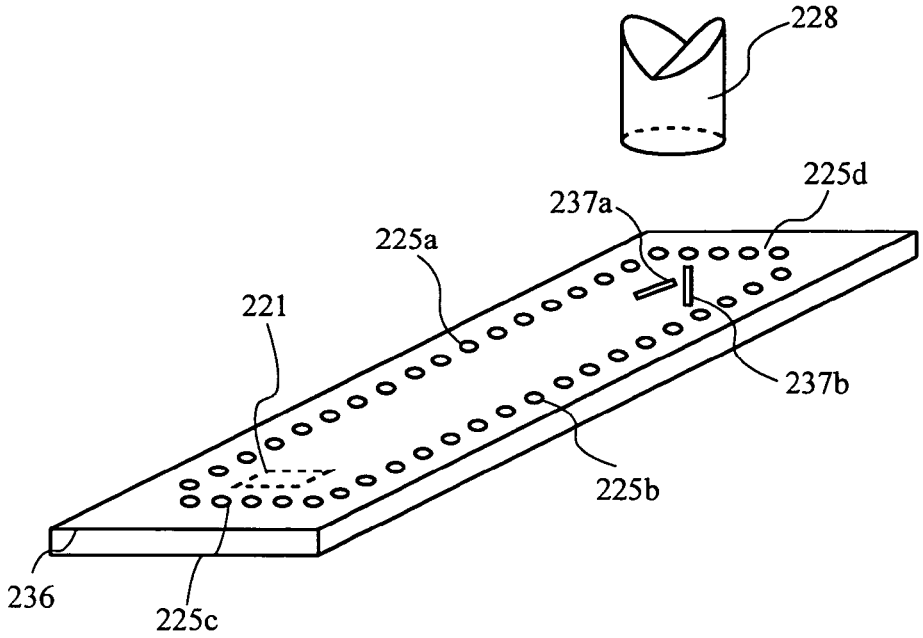
FIG. 54 is a view illustrating a slot pair type dielectric antenna according to an eleventh embodiment of the present invention.

FIG. 54 is a view illustrating a slot pair type dielectric antenna according to the eleventh embodiment of the present invention. In FIG. 54, the same elements as those of the tenth embodiment will be denoted by the same reference numerals and will not be further described below. Referring to FIG. 54, a dielectric substrate 236 includes a first rectangular slot aperture 237*a* and a second rectangular slot aperture 237*b*. The first slot aperture 237*a* and the second slot aperture 237*b* are spaced apart from each other and are not parallel to each other. Since the first slot aperture 237*a* and the second slot aperture 237*b* are not parallel to each other, the direction of the driving electromagnetic field in one slot aperture is different from that in the other slot aperture. Thus, two differently-oriented electromagnetic fields that are not in phase with each other will be fed into the loading dielectric block 228. Therefore, the electromagnetic field to be radiated from the loading dielectric block 228 will be an elliptically-polarized wave.

The dielectric substrate waveguide antenna will be a circularly-polarized antenna having an axial ratio of 1 by adjusting the sizes of the first and second slot apertures 237*a* and 237*b* so that they have the same drive amplitude, while arranging the first and second slot apertures 237*a* and 237*b* at a certain distance from each other and adjusting the angle therebetween so that the directions of the electromagnetic fields created by the first and second slot apertures 237*a* and 237*b* differ from each other by 90 degrees.

Thus, according to the eleventh embodiment, a dielectric substrate waveguide antenna can be a circularly-polarized antenna. With a circularly-polarized antenna, unlike with a linearly-polarized antenna, it is not necessary to align the antenna polarization direction for transmission with that for reception. Therefore, the dielectric substrate waveguide antenna of the eleventh embodiment is particularly useful in communications systems, such as mobile communications systems, where the direction of the antenna is likely to change constantly. Moreover, since an upper portion of the loading dielectric block 228 includes a depressed portion having a vertical cross section which has such a shape that the height of the block gradually increases toward the side surface thereof, it is possible to provide a dielectric waveguide antenna with a large primary beam width as in the first embodiment.

Note that while two slot apertures are spaced apart from each other in the embodiment above, the two slot apertures may alternatively cross each other.

Figure 55:
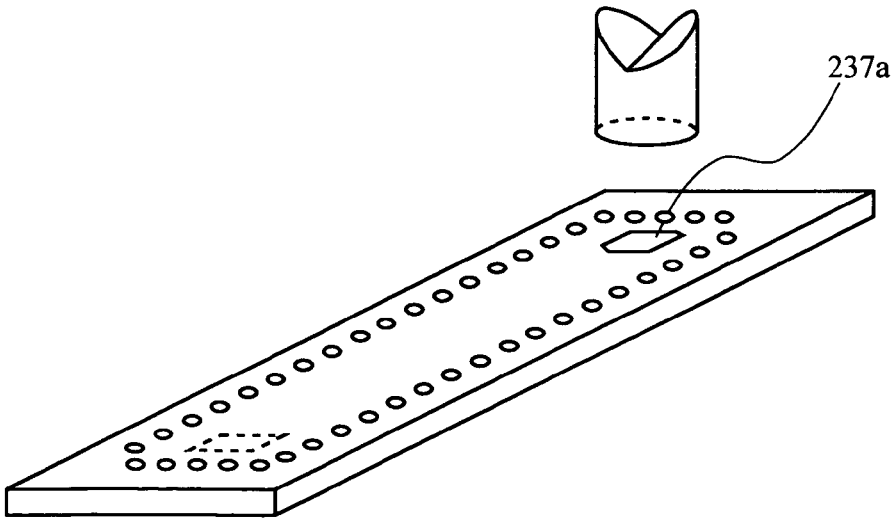
FIG. 55 is a view illustrating a dielectric substrate waveguide antenna using a hexagonal slot aperture 237*c;*

Note that a slot aperture section including two slot apertures is used in the embodiment above, the shape of the slot aperture section is not limited thereto. FIG. 55 is a view illustrating a dielectric substrate waveguide antenna using a hexagonal slot aperture 237*c*. With a hexagonal slot aperture, it is possible to generate an elliptically-polarized wave. This is because it is possible to generate a right-handed or left-handed polarized wave by cutting off some of the four corners of a square-shaped slot aperture. The axial ratio of the polarized wave can be adjusted based on the cutting angle and the positions of the corners to be cut off. Thus, the shape of the slot aperture is not limited to those illustrated herein as long as a circularly-polarized wave is generated.

Twelfth Embodiment

Figure 56:
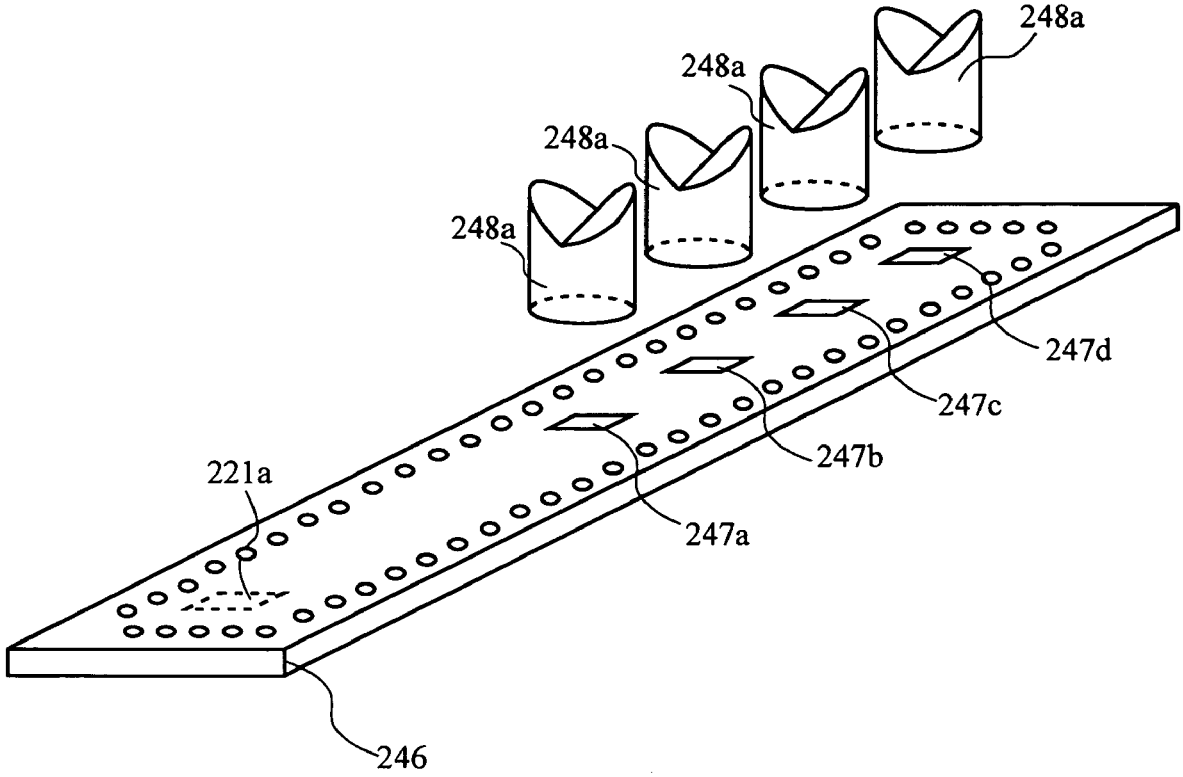
FIG. 56 is a view illustrating a dielectric antenna according to a twelfth embodiment of the present invention.

FIG. 56 is a view illustrating a dielectric antenna according to the twelfth embodiment of the present invention. In FIG. 56, elements that are functionally the same as those of the tenth embodiment will be denoted by the same reference numerals and will not be further described below. Referring to FIG. 56, a dielectric substrate 246 includes four slot apertures 247*a* to 247*d* arranged along the same dielectric substrate waveguide. Four loading dielectric blocks 248*a* to 248*d* are placed over the slot apertures 247*a* to 247*d*, respectively. Thus, an array antenna is formed. Note that while four loading dielectric blocks are used in the illustrated example, the number of loading dielectric blocks is not limited to four as long as a plurality of loading dielectric blocks are used. Note that while all of the four loading dielectric blocks have a depressed portion in the exampled illustrated in FIG. 56, the present invention is not limited to this as long as at least one loading dielectric block has a depressed portion. As in the other embodiments, the shape of a dielectric block having a depressed portion may be any of various shapes illustrated in the first to third embodiments.

A signal electromagnetic wave inputted through the feed port 221 is guided through the inside of the dielectric substrate waveguide while successively driving the loading dielectric blocks 248*a* to 248*d* starting from the block 248*a* closest to the feed port 221. Thus, the dielectric antenna shown in FIG. 56 is a traveling-wave array antenna.

The drive amplitude of each loading dielectric block can be adjusted based on the size of the associated slot aperture and the size of the loading dielectric block. The drive phase of each loading dielectric block can also be adjusted based on the position of the associated slot aperture and the size of the loading dielectric block.

Even with a single loading dielectric block, it is possible to increase the gain to some extent. In order to further increase the gain with a single loading dielectric block, it will be necessary to increase the size of the loading dielectric block (both the surface area and the height thereof), thereby undesirably increasing the size of the antenna as a whole. However, with the dielectric substrate waveguide antenna of the present embodiment, it is possible to further increase the gain without increasing the size of the antenna as a whole, by using a plurality of loading dielectric blocks.

Thus, as compared with a case where a single loading dielectric block is used, the dielectric substrate waveguide antenna array of the twelfth embodiment drives a plurality of loading dielectric blocks with the same amplitude and phase, whereby it is possible to obtain apertures in phase with one another extending over a wide area and to obtain a high gain. Moreover, since an upper portion of at least one of the loading dielectric blocks includes a depressed portion having a vertical cross section which has such a shape that the height of the block gradually increases toward the side surface thereof, it is possible to provide a dielectric waveguide antenna with a large primary beam width as in the first embodiment.

Figure 57:
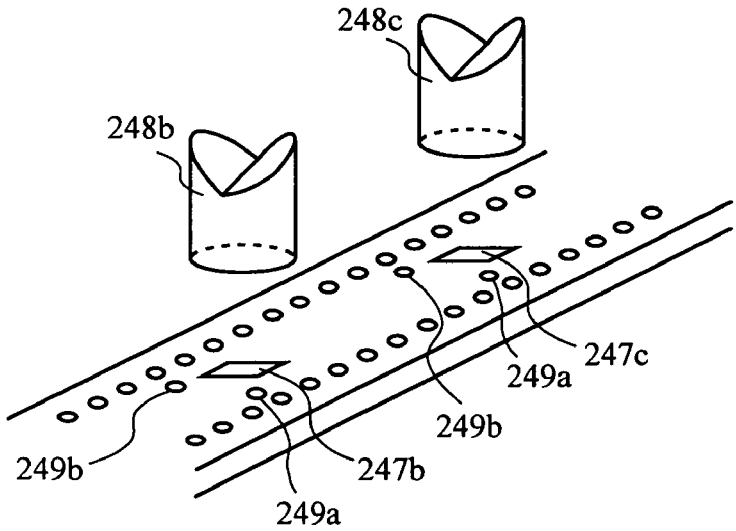
FIG. 57 is a view illustrating a dielectric antenna with matching posts.

Note that with the structure illustrated in FIG. 56, if impedance matching with the loading dielectric blocks cannot be achieved due to the electromagnetic wave reflection, the operation of the entire antenna fails. Where impedance matching with the loading dielectric blocks cannot be achieved, a matching post, which is a through hole for impedance matching, can be provided on one side of each slot aperture that is closer to the feed port 221. FIG. 57 is a view illustrating a dielectric antenna with matching posts. Note that while FIG. 57 only shows matching posts for some of the slot apertures, matching posts are provided similarly for the other slot apertures. Matching posts 249*a* and 249*b* are positioned so that the reflected wave occurring in each slot aperture is in antiphase with the reflected wave occurring in the matching posts. Impedance matching is achieved for each loading dielectric, whereby the antenna can operate normally. Note that the positions of the matching posts are not limited to those illustrated in FIG. 57 as long as the matching posts are positioned so that impedance matching can be achieved.

Figure 58:
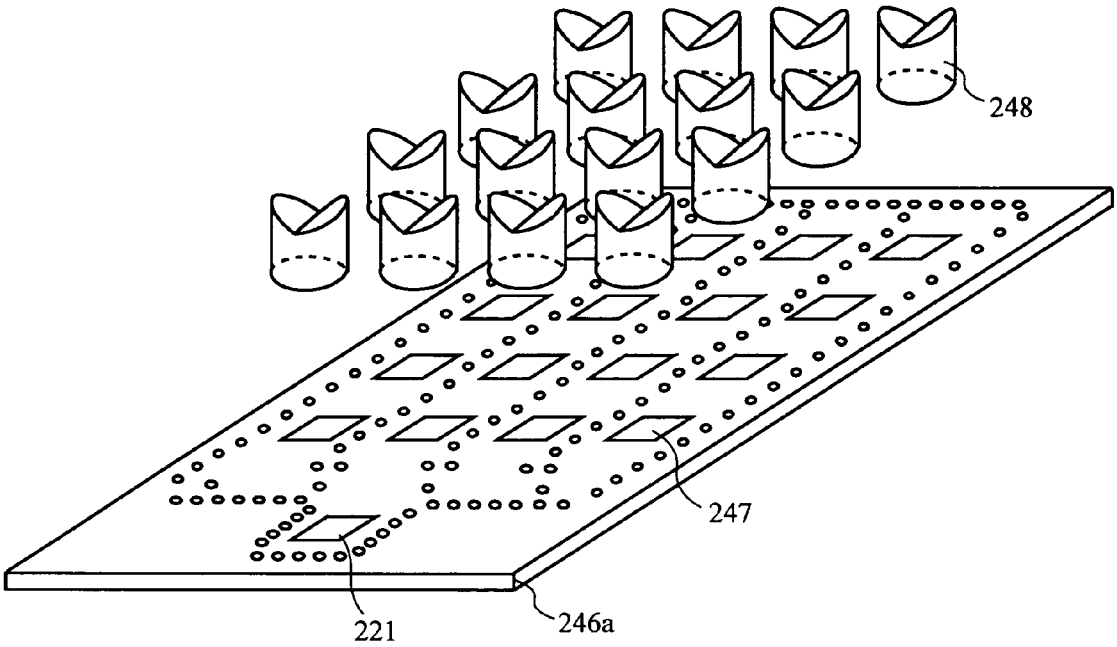
FIG. 58 is a view illustrating a dielectric substrate waveguide antenna planar array including array antennas arranged in parallel to one another.

Note that while a single dielectric substrate waveguide is formed by through holes with a plurality of slot apertures along the dielectric substrate waveguide and with a loading dielectric block placed over each slot aperture in the embodiment above, a plurality of dielectric substrate waveguides may be formed with a plurality of loading dielectric blocks placed along each dielectric substrate waveguide. FIG. 58 is a view illustrating a dielectric substrate waveguide antenna planar array including array antennas arranged in parallel to one another. With the planar array illustrated in FIG. 58, it is possible to further increase the gain by driving loading dielectric blocks 248, which are placed on a dielectric substrate 246*a*, with the same amplitude and phase. The size and position of slot apertures 247 and the size of the loading dielectric blocks 248 are determined so that the loading dielectric blocks 248 of each waveguide are driven with the same amplitude and phase. Note that the number of loading dielectric blocks and the number of dielectric substrate waveguides are not limited to those of the example illustrated in FIG. 58. Note that while all of the four loading dielectric blocks of each waveguide have a depressed portion in the exampled illustrated in FIG. 58, the present invention is not limited to this as long as at least one loading dielectric block in one antenna has a depressed portion. As in the other embodiments, the shape of a dielectric block having a depressed portion may be any of various shapes illustrated in the first to third embodiments.

Figure 59:
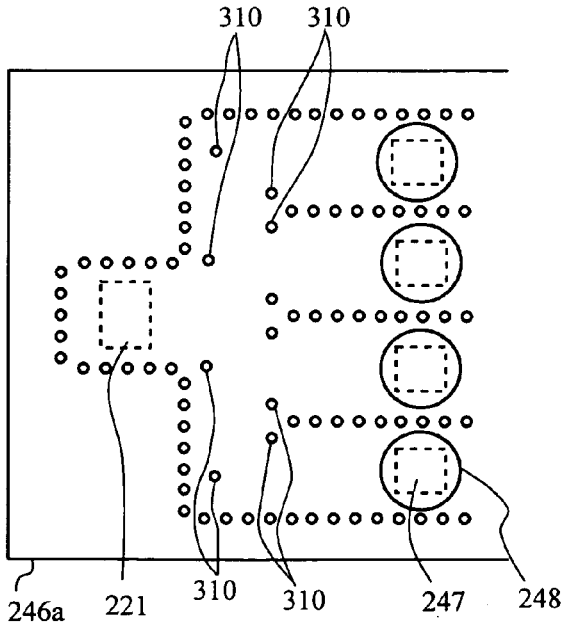
FIG. 59 is a view illustrating a structure for feeding the planar array illustrated in FIG. 58.

FIG. 59 is a view illustrating a structure for feeding the planar array illustrated in FIG. 58. By appropriately positioning matching posts 310, which are through holes for impedance matching, in the branching section where the stem portion branches into dielectric substrate waveguides, as illustrated in FIG. 59, the electromagnetic waves to be fed into the dielectric substrate waveguides will be of the same power and phase, whereby the electromagnetic wave fed through the feed port 221 can be appropriately distributed among the loading dielectric blocks. Thus, all of the through holes are arranged so that the electromagnetic wave fed through the feed port is appropriately distributed among the loading dielectric blocks.

Note that also for a planar array as illustrated in FIG. 58, it is important to achieve impedance matching for each loading dielectric block. Therefore, matching posts as illustrated in FIG. 57 should be provided on the front side of each slot aperture as necessary.

Note that the through hole arrangement of the twelfth embodiment can be applied to the dielectric antenna of the ninth embodiment in which a planar array is formed by dielectric blocks as illustrated in FIG. 44.

Thirteenth Embodiment

Figure 60:
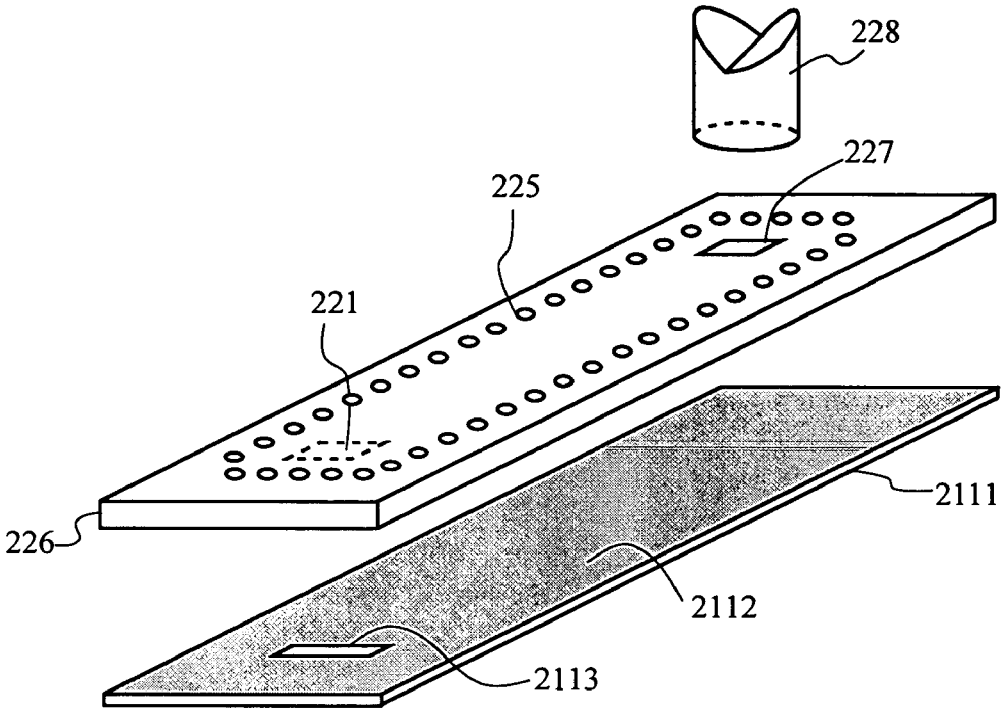
FIG. 60 is a view illustrating a radio device according to a thirteenth embodiment of the present invention.

FIG. 60 is a view illustrating a radio device according to the thirteenth embodiment of the present invention. Referring to FIG. 60, the radio device includes the dielectric substrate waveguide antenna of the tenth embodiment including the dielectric substrate 226 and the loading dielectric block 228, and a radio communications circuit board 2111. The radio device of the thirteenth embodiment is formed by the dielectric substrate waveguide antenna and the circuit board 2111 placed on each other.

Figure 61:
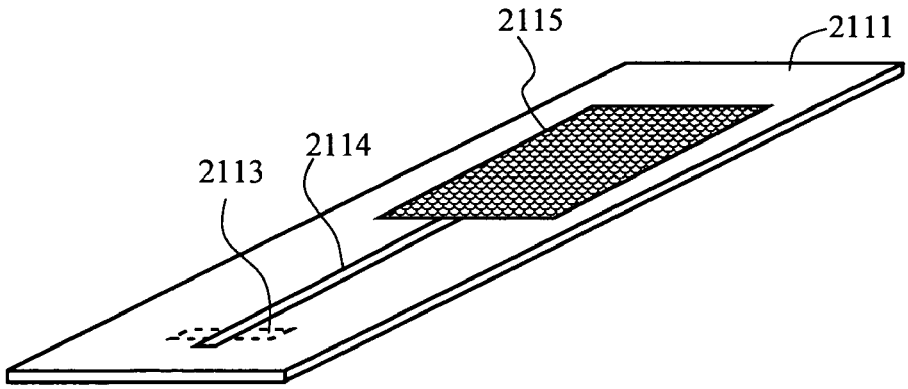
FIG. 61 is a view illustrating the reverse surface of a circuit board 2111.
Figure 62:
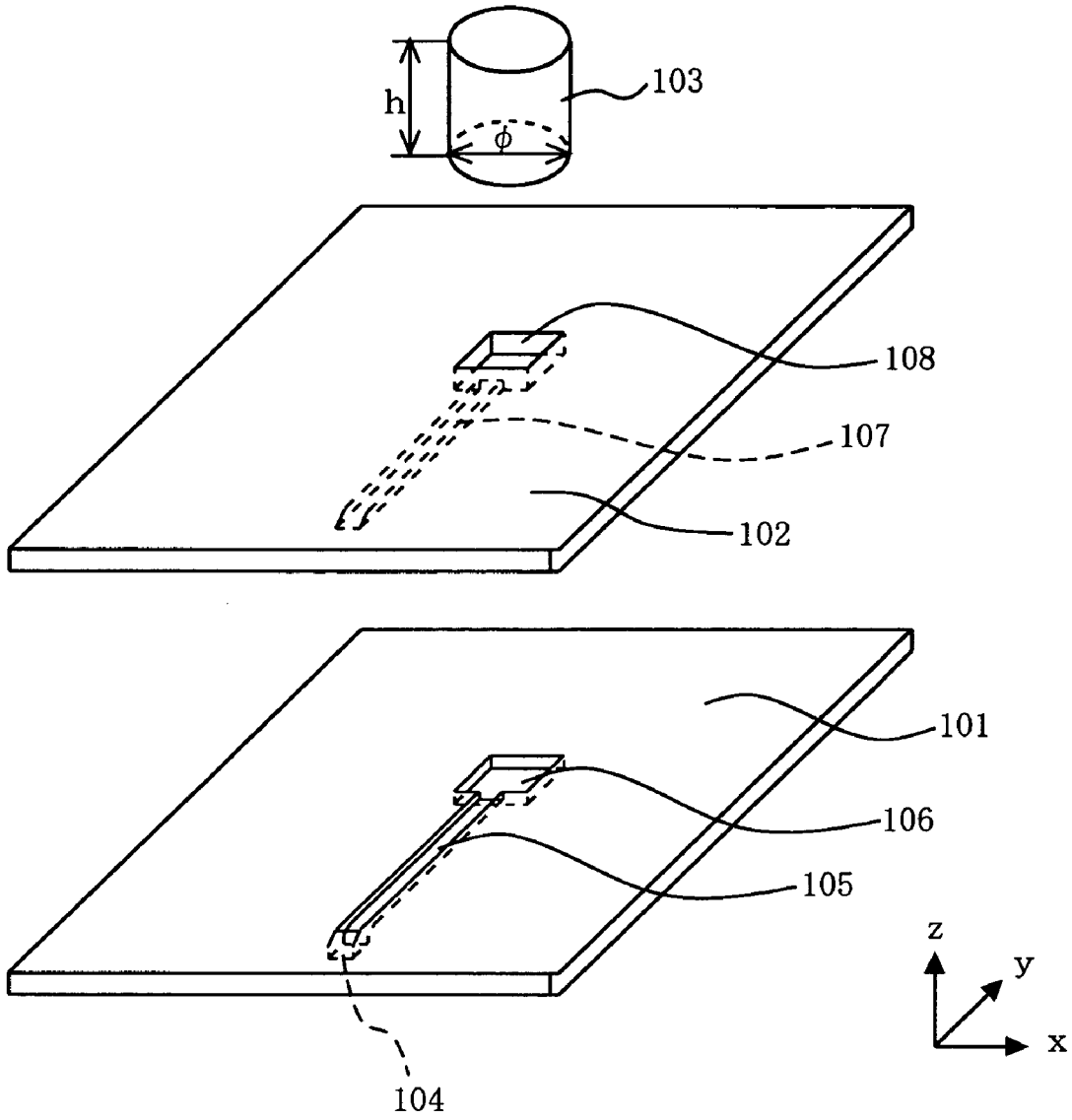
FIG. 62 PRIOR ART
FIG. 62 is an exploded perspective view illustrating a conventional waveguide-fed dielectric antenna.
Figure 63:
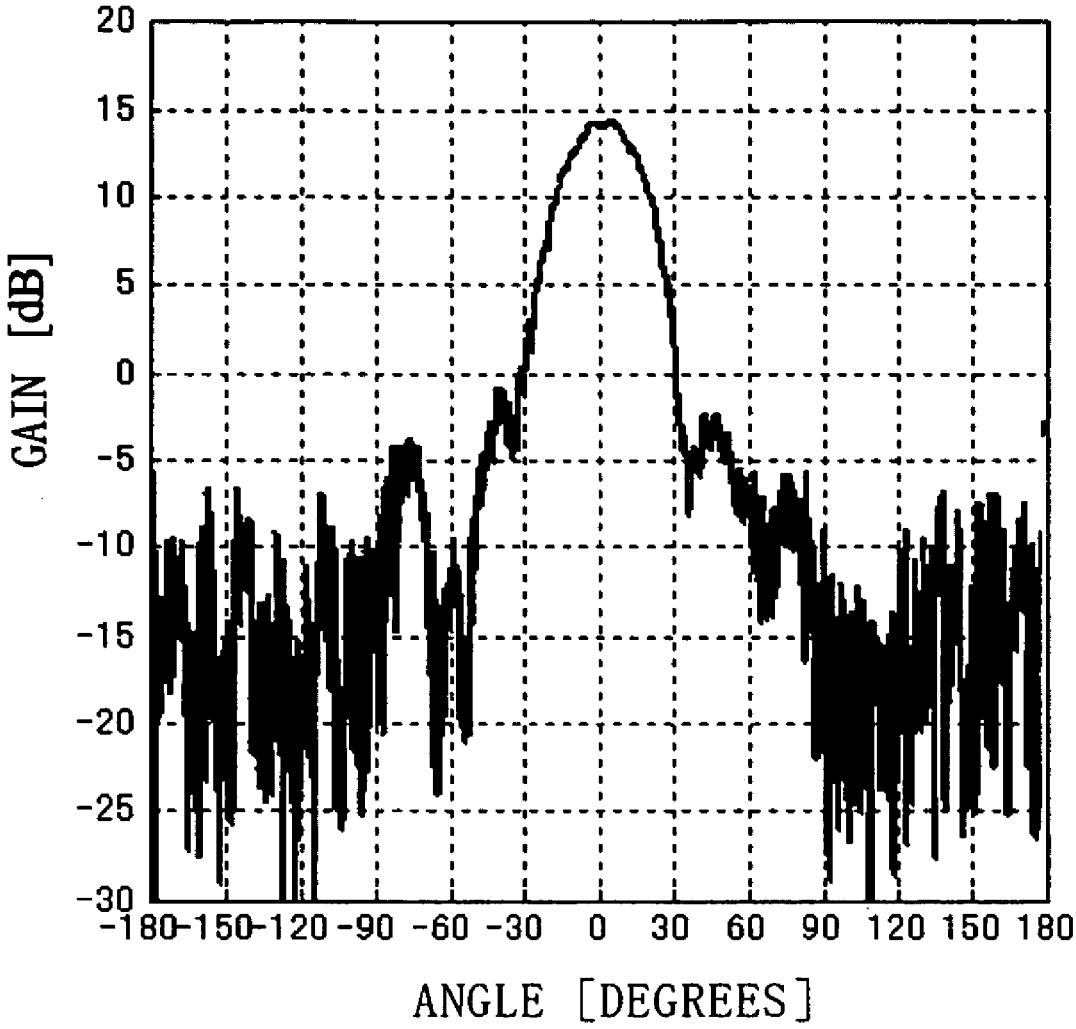
FIG. 63 PRIOR ART
FIG. 63 is a graph showing the radiation pattern along the xz plane (electric field plane) for the conventional dielectric antenna.

FIG. 61 is a view illustrating the reverse surface of the circuit board 2111. Referring to FIG. 60 and FIG. 61, the circuit board 2111 includes a ground conductor surface 2112 formed on the side that is to be in contact with the dielectric substrate 226, an aperture 2113 for coupling the circuit board 2111 with the feed port 221, a radio circuit 2115 on the reverse side including a modulation/demodulation circuit, etc., and a microstrip line 2114 connecting the radio circuit 2115 to the aperture 2113. The radio circuit 2115 is a semiconductor circuit using high frequency lines such as microstrip lines or coplanar lines. The aperture 2113 is formed by etching, or the like, at a position along the microstrip line 2114 near one end thereof that is away from the radio circuit 2115.

A signal generated from the radio circuit 2115 passes through the microstrip line 2114 to reach the aperture 2113. Since the aperture 2113 is electromagnetically coupled with the feed port 221 on the antenna side, the signal is then fed into the dielectric substrate waveguide and is radiated as an electromagnetic wave from the loading dielectric block 228. The matching between the antenna side and the circuit side is adjusted by the size and the position of the aperture 2113.

Thus, in the thirteenth embodiment, a dielectric substrate waveguide antenna and a circuit are integrated together, whereby it is possible to provide a small radio device.

Note that while the radio circuit 2115 and the aperture 2113 are connected to each other by a microstrip line in the embodiment above, they may be connected together by another high frequency line such as a coplanar line.

Note that while the radio device of the embodiment above uses the dielectric substrate waveguide antenna of the tenth embodiment, it may use any of the dielectric antennas of the other embodiments. The antenna used in the radio device may be either an antenna with a single loading dielectric or an array antenna. Moreover, the shape of the loading dielectric block may be any of various shapes illustrated in the first to third embodiments.

The dielectric antenna of the present invention and the radio device using the same have a high gain and a large beam width, while they are small and inexpensive and can easily be manufactured. Thus, they are useful in various applications such as communications applications using high frequency signals.

While the invention has been described in detail, the foregoing description is in all aspects illustrative and not restrictive. It is understood that numerous other modifications and variations can be devised without departing from the scope of the invention.

What is claimed is:

1. A dielectric antenna, comprising a pillar-shaped dielectric section for radiating an electromagnetic wave being fed thereto, wherein:

the dielectric section includes, in an upper portion thereof, a depressed portion whose bottom is a flat surface; and a vertical cross section of the depressed portion has such a shape that a height of the dielectric section gradually increases toward a side surface of the dielectric section.

2. The dielectric antenna according to claim 1, wherein the dielectric section has an elliptic cylinder shape.

3. The dielectric antenna according to claim 1, wherein:

the dielectric section is a pillar-shaped loading dielectric block; and the dielectric antenna further comprises a feed section for feeding the electromagnetic wave to a bottom surface of the loading dielectric block.

4. The dielectric antenna according to claim 3, wherein: the feed section includes:

a waveguide; and an aperture for feeding the electromagnetic wave to the loading dielectric block; and the loading dielectric block is placed over the aperture.

5. The dielectric antenna according to claim 4, wherein an inside of the waveguide is filled with a dielectric.

6. The dielectric antenna according to claim 4, wherein the aperture has a hexagonal shape.

7. The dielectric antenna according to claim 4, wherein the aperture includes two rectangular apertures which are not parallel to each other.

8. The dielectric antenna according to claim 3, wherein: the feed section includes:

a high frequency line formed on a dielectric substrate; and a feed patch formed at an end of the high frequency line; and the loading dielectric block is placed over the feed patch.

9. The dielectric antenna according to claim 8, wherein the feed patch has a hexagonal shape.

10. The dielectric antenna according to claim 1, further comprising:

a dielectric block integrally including the dielectric section in the form of a protrusion therefrom; and a conductor portion covering a surface of the dielectric block except for a feed port for feeding the electromagnetic wave and the protrusion.

11. The dielectric antenna according to claim 10, wherein the dielectric block includes a matching protrusion for impedance matching.

12. The dielectric antenna according to claim 1, further comprising:

a dielectric block integrally including the dielectric section in the form of a protrusion therefrom;

a plurality of through holes each passing through the dielectric block from a first surface of the dielectric block on which the protrusion is formed to a second surface opposing the first surface, wherein the through holes are arranged so as to surround the protrusion; and a conductor portion covering a surface of the dielectric block except for a feed port for feeding the electromagnetic wave and the protrusion, the conductor portion covering at least the first surface, the second surface and an inner wall surface of each of the through holes.

13. The dielectric antenna according to claim 12, wherein the dielectric block includes a matching protrusion for impedance matching.

14. The dielectric antenna according to claim 1, wherein:

the dielectric section is a pillar-shaped loading dielectric block;

the dielectric antenna further comprises a dielectric substrate including a feed port for feeding the electromagnetic wave to a bottom surface of the loading dielectric block and a slot aperture for radiating the electromagnetic wave over which the loading dielectric block is placed, wherein both surfaces of the dielectric substrate are covered with a conductor except for the feed port and the slot aperture; and a plurality of through holes, each having an inner wall covered with a conductor, pass through the dielectric substrate, wherein the through holes are arranged so as to surround the feed port and the slot aperture.

15. The dielectric antenna according to claim 14, wherein the slot aperture includes two rectangular apertures which are not parallel to each other.

16. The dielectric antenna according to claim 14, wherein the slot aperture has a hexagonal shape.

17. The dielectric antenna according to claim 14, wherein the plurality of through holes are periodically arranged with an interval which is less than or equal to ⅕ a wavelength of an electromagnetic wave to be transmitted.

18. The dielectric antenna according to claim 14, wherein the feed port is H-shaped.

19. The dielectric antenna according to claim 14, wherein the slot aperture is H-shaped.

20. The dielectric antenna according to claim 1, wherein:

the dielectric section is at least one of a plurality of pillar-shaped loading dielectric blocks which are arranged in an array;

the dielectric antenna further comprises a feed section for feeding the electromagnetic wave to a bottom surface of each of the loading dielectric blocks; and each of the loading dielectric blocks other than the dielectric section includes a sloped upper portion facing a direction in which the electromagnetic wave is intended to be radiated.

21. The dielectric antenna according to claim 20, wherein the plurality of loading dielectric blocks other than a central loading dielectric block are arranged in various directions according to an intended directivity.

22. The dielectric antenna according to claim 20, further comprising a switch circuit for feeding the electromagnetic wave to at least one of the loading dielectric blocks.

23. A radio device for high frequency communications applications, comprising:

a dielectric antenna for radiating an electromagnetic wave being fed thereto; and a communications circuit connected to the dielectric antenna, wherein:

the dielectric antenna includes a pillar-shaped dielectric section for radiating the electromagnetic wave;

the dielectric section includes, in an upper portion thereof, a depressed portion whose bottom is a flat surface; and a vertical cross section of the depressed portion has such a shape that a height of the dielectric section gradually increases toward a side surface of the dielectric section.

24. The radio device according to claim 23, wherein the communications circuit is provided in a feed section for feeding the electromagnetic wave.

25. The radio device according to claim 23, wherein the communications circuit is provided on a bottom surface of a feed section for feeding the electromagnetic wave.

26. The radio device according to claim 23, wherein the communications circuit is provided on a patch feed substrate for patch feeding of the electromagnetic wave.

27. The radio device according to claim 23, wherein:

the electromagnetic wave from the communications circuit is fed via a waveguide;

the communications circuit includes a high frequency line for feeding the electromagnetic wave to the waveguide; and the radio device further comprises a converter for impedance matching between the waveguide and the high frequency line.

28. A dielectric antenna, comprising a pillar-shaped dielectric section for radiating an electromagnetic wave being fed thereto, wherein:

the dielectric section includes a depressed portion in an upper portion thereof;

a vertical cross section of the depressed portion has such a shape that a height of the dielectric section gradually increases toward a side surface of the dielectric section;

the dielectric section is a pillar-shaped loading dielectric block;

the dielectric antenna further comprises a dielectric substrate including a feed port for feeding the electromagnetic wave to a bottom surface of the loading dielectric block and a slot aperture for radiating the electromagnetic wave over which the loading dielectric block is placed, wherein both surfaces of the dielectric substrate are covered with a conductor except for the feed port and the slot aperture;

a plurality of through holes, each having an inner wall covered with a conductor, pass through the dielectric substrate, wherein the through holes are arranged so as to surround the feed port and the slot aperture; and the plurality of through holes are periodically arranged with an interval which is less than or equal to ⅕ a wavelength of an electromagnetic wave to be transmitted.

29. A dielectric antenna, comprising a pillar-shaped dielectric section for radiating an electromagnetic wave being fed thereto, wherein:

the dielectric section includes a depressed portion in an upper portion thereof;

a vertical cross section of the depressed portion has such a shape that a height of the dielectric section gradually increases toward a side surface of the dielectric section;

the dielectric section is at least one of a plurality of pillar-shaped loading dielectric blocks which are arranged in an array;

the dielectric antenna further comprises a feed section for feeding the electromagnetic wave to a bottom surface of each of the loading dielectric blocks; and each of the loading dielectric blocks other than the dielectric section includes a sloped upper portion facing a direction in which the electromagnetic wave is intended to be radiated.

30. The dielectric antenna according to claim 29, wherein the plurality of loading dielectric blocks other than a central loading dielectric block are arranged in various directions according to an intended directivity.

31. The dielectric antenna according to claim 29, further comprising a switch circuit for feeding the electromagnetic wave to at least one of the loading dielectric blocks.

* * * * *